US005843628A

United States Patent [19]

Taguchi et al.

[11] Patent Number: 5,843,628

[45] Date of Patent: Dec. 1, 1998

[54] COLOR IMAGE FORMATION METHOD

[75] Inventors: Toshiki Taguchi; Kiyoteru Miyake, both of Kanagawa, Japan

[73] Assignee: Fuji Photo Film Co., Ltd., Kanagawa, Japan

[21] Appl. No.: 746,844

[22] Filed: Nov. 15, 1996

[30] Foreign Application Priority Data

Nov. 17, 1995 [JP] Japan ..... 7-322454

[51] Int. Cl.[6] ..... G03C 8/40

[52] U.S. Cl. ..... 430/351; 430/203; 430/224; 430/235; 430/247; 430/251; 430/354; 430/355; 430/543

[58] Field of Search ..... 430/351, 224, 430/203, 235, 247, 251, 234, 217, 567, 264, 354, 543, 355

[56] References Cited

U.S. PATENT DOCUMENTS 5,667,945 9/1997 Takeuchi et al. ..... 430/380

5,677,104 10/1997 Hirai et al. ..... 430/203

*Primary Examiner*—Thorl Chea

*Attorney, Agent, or Firm*—Sughrue, Mion, Zinn, Macpeak & Seas, PLLC

[57] ABSTRACT

A color image formation method excellent in discrimination and color image stability after processing which comprises overlaying a heat developable color light-sensitive material with a complexing agent sheet in the presence of a small amount of water therebetween after or during imagewise exposure, said light-sensitive material comprising a support having provided thereon at least a light-sensitive silver halide, a binder, a coupler, a reducing agent and a slightly-water-soluble basic metal compound, said sheet comprising a support having provided thereon at least a compound forming a complex with a metal ion constituting said basic metal compound; and heat developing the light-sensitive material to obtain a color image thereon, wherein the silver chloride content of said silver halide is 80 mol % or more, said complexing agent sheet comprises a physical development nucleus and a solvent for a silver halide, and said reducing agent is at least one compound of specified phenols, hydrazines and hydrazones.

17 Claims, 3 Drawing Sheets

COLOR IMAGE FORMATION METHOD

FIELD OF THE INVENTION

The present invention relates to a color image formation method by heat development, and more particularly to a color image formation method by heat development excellent in image discrimination and in stability of a color image after processing.

BACKGROUND OF THE INVENTION

Photographic methods using silver halides are excellent in photographic characteristics such as sensitivity and gradation control, as compared with other photographic methods such as electrophotographic methods and diazo photographic methods, and therefore have previously been most widely used. In particular, the photographic methods using silver halides provide highest image quality as color hard copies, so that intensive investigation has recently been conducted on them.

In recent years, systems which can obtain images easily and rapidly have been developed by shifting image forming processing of photographic materials using silver halides from conventional wet processing to instant photographic systems containing developing solutions and further to dry heat development processing by heating. Heat developable photographic materials are described in *Shashin Kohgaku no Kiso* (*Higinen Shashin*) (The Fundamentals of Photographic Engineering (Nonsilver Salt Photograph)), infra page 242, Corona Publishing Co. Ltd. However, black-and-white image formation methods represented by dry silver are merely described therein. Recently, commercial products as a heat developable color photographic material such as Color Dry Silver supplied from Minnesota Mining and Manufacturing Co. and PICTROGRAPHY and PICTROSTAT supplied from Fuji Photo Film Co., Ltd. have been put on the market. In the above-mentioned easy rapid processing methods, the former uses a leuco dye and the latter uses a redox color material to which a preformed dye is attached to form color images. Methods utilizing the coupling reaction of couplers and oxidation products of developing agents are most general as the color image forming methods of photographic materials. As to heat developable color photographic materials employing these methods, many ideas are also applied for patents, for example, U.S. Pat. Nos. 3,761,270 and 4,021,240, JP-A-59-231539 and JP-A-60-128438 (the term "JP-A" as used herein means an "unexamined published Japanese patent application").

On the other hand, it has recently become possible to easily conduct digital processing of image information on personal computers. This processing of image information generally called "DTP" usually comprises processes such as (1) uptake of image information from scanners, (2) image date conversion using image processing software represented by "Adobe Photoshop", and (3) output to printers. Recent developments in scanners, personal computers and printers are remarkable.

When such digital processing is applied to shooting materials, the image information is finally utilized as enlarged hard copies. For the shooting materials, therefore, the qualities of image information such as sharpness and granularity become important. In the system that formed diffusible dyes are transferred onto image receiving materials, blurs of images inevitably occur due to diffusion, resulting in deterioration of sharpness. Accordingly, when the shooting materials are designed, it is preferred that dye images are fixed to the sides of light-sensitive materials. In this case, problems arise such as separation of silver images from dye images after processing, and printout of residual silver halides and formation of unfavorable dyes produced thereby. First, the former problem can be solved by measuring the relationship between the silver images and the dye images in advance, followed by digital processing of the resulting images. However, as to the latter, the light-sensitive materials are exposed to light also when the image information thereon is measured. Accordingly, insufficient stability of the light-sensitive materials after processing to light causes a failure to accurately read the information. It is therefore a weighty subject to secure the stability of the light-sensitive materials to light. In particular, when high silver halide emulsions having the advantage of rapid development reaction are used as silver halide emulsions, the printout and the post development reaction are also remarkable. It is therefore indispensable to develop a technique for overcoming this problem.

SUMMARY OF THE INVENTION

It is therefore an object of the present invention to provide a color image formation method by heat development excellent in discrimination and in stability of a color image after processing.

According to the present invention, there is provided a color image formation method comprising overlaying a heat developable color photographic material with a complexing agent sheet in the presence of (via) a small amount of water therebetween after or during imagewise exposure, said light-sensitive material comprising a support having provided thereon at least a light-sensitive silver halide, a binder, a coupler, a reducing agent and a slightly water-soluble basic metal compound, said sheet comprising a support having provided thereon at least a compound forming a complex with a metal ion constituting said basic metal compound; and heat developing the light-sensitive material to obtain a color image thereon, wherein the silver chloride content of said silver halide is 80 mol % or more, said complexing agent sheet comprises a physical development nucleus and a solvent for a silver halide, and said reducing agent is a compound represented by at least one of the following general formulas (1) to (5):

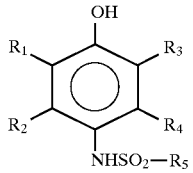

(1)

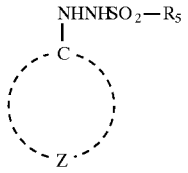

(2)

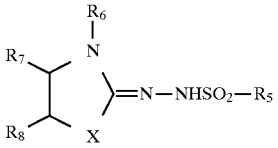

(3)

-continued (4)

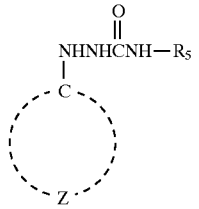

(5)

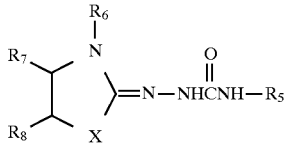

wherein $R_1$ to $R_4$ each represents a hydrogen atom, a halogen atom, an alkyl group, an aryl group, an alkylcarbonamido group, an arylcarbonamido group, an alkylsulfonamido group, an arylsulfonamido group, an alkoxyl group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl or an acyloxy group; $R_5$ represents an alkyl group, an aryl group or a heterocyclic group; Z represents a group of atoms forming an aromatic ring (including a heterocyclic aromatic ring), wherein when Z is a benzene ring, the total of Hammett constants (σ) of substituent groups thereof is 1 or more; $R_6$ represents an alkyl group; X, represents an oxygen atom, a sulfur atom, a selenium atom or an alkyl-substituted or aryl-substituted tertiary nitrogen atom; and $R_7$ and $R_8$, which may combine together to form a double bond or a ring, each represents a hydrogen atom or a substituent group. General formulas (1) to (5) each contains at least one ballast group having 8 or more carbon atoms in order to impart the oil solubility to the molecule.

DETAILED DESCRIPTION OF THE INVENTION

Figure 1:
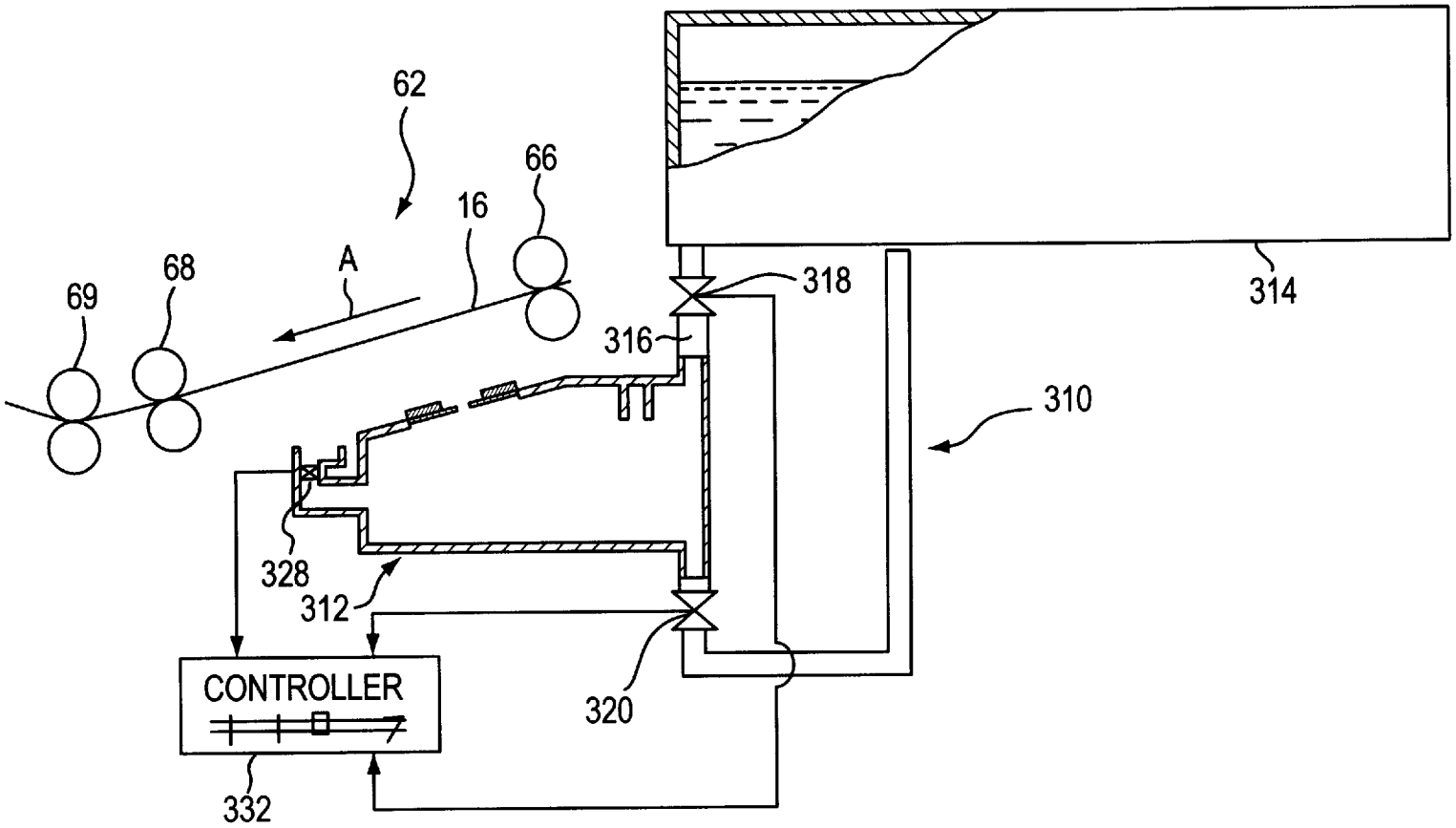
FIG. 1 is a schematic general view showing a solvent (water) coating device for image formation.

The present invention will be described in detail below.

First, solvents for silver halides used in the present invention are described. The "solvents for silver halides" mean compounds which form complex compounds with silver ions contained in silver halides to produce soluble silver salts. Such compounds include, for example, thiosulfates such as sodium thiosulfate and ammonium thiosulfate, sulfites such as sodium sulfite and sodium hydrogensulfite, thiocyanates such as potassium thiocyanate and ammonium tiocyanate, thioether compounds such as 1,8-dihydroxy-3,6-dithiaoctane, 2,2'-thiodiethanol and 6,9-dioxa-3,12-dithiatetradecane-1,14-diol described in JP-B-47-11386 (the term "JP-B" as used herein means an "examined Japanese patent publication"), compounds having 5- or 6-membered imide rings such as uracil and hydantoin described in Japanese Patent Application No. 6-325350, and compounds represented by the following general formula (6) described in JP-A-53-144319 can be used.

$$N(R^9)(R^{10})—C(=S)—X—R^{11} \quad (6)$$

wherein X represents a sulfur atom or an oxygen atom; $R^9$ and $R^{10}$, which may be the same or different, each represents an aliphatic group, an aryl group, a heterocyclic ring residue or an amino group; $R^{11}$ represents an aliphatic group or an aryl group; and $R^9$ and $R^{10}$ or $R^9$ and $R^{11}$ may combine together to form a 5- or 6-membered heterocyclic ring.

Further, trimethyltriazolium thiolate and mesoionic thiolate compounds described in *Analytica Chemica Acta*, 248, 604–614 (1991) are also preferably used. Compounds which can fix and stabilize silver halides described in Japanese Patent Application No. 6-206331 can also be used as the solvents for silver halides.

The above-mentioned solvents for silver halides may be used in combination. Of the above-mentioned compounds, sulfites and compounds having 5- or 6-membered imide rings such as uracil and hydantoin are particularly preferred.

The total amount of the solvents for silver halides contained in the complexing agent sheets of the present invention is 0.01 to 50 mmol/$m^2$, preferably 0.1 to 30 Mmol/$m^2$, and more preferably 1 to 20 mmol/$m^2$. The molar ratio thereof to the amount of silver coated of the light-sensitive materials is 1:20 to 20:1, preferably 1:10 to 10:1, and more preferably 1:3 to 3:1. The solvents for silver halides may be added to solvents such as water, methanol, ethanol, acetone, dimethyl-formamide and methylpropylglycol or to basic or acidic aqueous solutions, or may be dispersed in coating solutions as fine solid particles.

In the present invention, the complexing agent sheets can also contain polymers having repeating units of vinylimidazole and/or vinylpyrrolidone as constituents described in Japanese Patent Application No. 6-325350.

Combinations of the slightly water-soluble basic metal compounds used as base precursors in the present invention and the compounds (referred to as complex-forming compounds or complexing agents) which can undergo complex formation with the metal ions constituting the basic metal compounds are disclosed in JP-A-62-129848, EP-A-210660 and U.S. Pat. No. 4,740,445.

Preferred examples of the basic metal compounds include oxides, hydroxides and basic carbonates of zinc or aluminum, and zinc oxide, zinc hydroxide and basic zinc carbonate are particularly preferred.

The slightly water-soluble basic metal compounds are dispersed as fine particles in hydrophilic binders to use them, as described in JP-A-59-174830. The mean particle size of the fine particles is 0.001 to 5 μm, and preferably 0.01 to 2 μm. The amount of the fine particles contained in the light-sensitive materials is 0.01 to 5 g/$m^2$, and preferably 0.05 to 2 g/$m^2$.

The complex-forming compounds used in the sheets (hereinafter referred to as complexing agent sheets) containing the complex-forming compounds with the metal ions of the slightly water-soluble basic metal compounds are known as chelating agents in analytical chemistry and as water softeners in photochemistry. Details thereof are described in A. Ringbom, translated by Nobuyuki Tanaka and Haruko Sugi, *Complex Formation* (Sangyo Tosho), as well as the above-mentioned patent specifications. The complexing-forming compounds used in the present invention are preferably water-soluble compounds, which include, for example, aminopolycarboxylic acids (including salts thereof) such as ethylenediaminetetraacetic acid, nitrilotriacetic acid and diethylenetriaminepentaacetic acid, aminophosphonic acids (including salts thereof) such as aminotris(methylenephosphonic acid) and ethylenediaminetetramethylenephosphonic acid, and pyridinecarboxylic acids (including salts thereof) such as 2-picolinic acid, pyridine-2,6-dicarboxylic acid and 5-ethyl-2-picolinic acid. Of these, pyridinecarboxylic acids and salts thereof are particularly preferred.

In the present invention, it is preferred that the complex-forming compounds are used as salts neutralized with bases. In particular, salts of organic bases such as guanidines, amidines and tetraalkylammonium hydroxides, and salts of alkali metals such as sodium, potassium and lithium are preferably used. Preferred examples of the complex-forming compounds are described in JP-A-62-129848 and EP-A210660 described above. The amount of the complex-forming compounds contained in the complexing agent sheets is 0.01 to 10 g/m$^2$, and preferably 0.05 to 5 g/m$^2$.

In the present invention, physical development nuclei are added to the complexing agent sheets. The physical development nuclei reduce soluble silver salts diffused from the light-sensitive materials to convert them to physical development silver, thus fixing silver to the complexing agent sheets. As the physical development nuclei, all the physical development nuclei previously known can be used. Examples thereof include colloidal particles of heavy metals such as zinc, mercury, lead, cadmium, iron, chromium, nickel, tin, cobalt and copper, noble metals such as palladium, platinum, silver and gold, and chalcogen compounds thereof with sulfur, selenium and tellurium. These physical development nucleus compounds are obtained by reducing the corresponding metal ions with reducing agents such as ascorbic acid, sodium boron hydrate and hydroquinone to produce metal colloidal dispersions, or by mixing metal ion solutions with solutions of soluble sulfides, selenides or tellurides to produce colloidal dispersions of water-insoluble metal sulfides, metal selenides or metal tellurides. These dispersions are preferably formed in hydrophilic binders such as gelatin. Methods for preparing colloidal silver particles are described in U.S. Pat. No. 2,688,601, etc. The desalting process for removing excess salts, which is known in the preparation of silver halide emulsions, may be applied.

The physical development nuclei having a particle size of 2 to 200 nm are preferably used. These physical development nuclei are added to the complexing agent sheets usually in an amount of $10^{-3}$ to 100 mg/m$^2$, preferably $10^{-2}$ to 10 mg/m$^2$. The physical development nuclei separately prepared can also be added to coating solutions. However, for example, silver nitrate and sodium sulfide, or silver chloride and a reducing agent may be allowed to react with each other in a coating solution containing a hydrophilic binder to produce the physical development nuclei. Silver, silver sulfide, palladium sulfide, etc are preferably used as the physical development nuclei. When physical development silver transferred to the complexing agent sheets is used as images, palladium sulfide and silver sulfide are preferably used in respect to low Dmin.

Silver halide grains which can be used in the present invention are silver chloride, silver iodochloride, silver chlorobromide or silver iodochlorobromide, and the content of silver chloride is 80 mol % or more. The content of silver iodide is preferably 10 mol % or less, more preferably 1 mol % or less, and most preferably 0.5 mol % or less.

The silver halide emulsions used in the present invention may be either surface latent image type emulsions or internal latent image type emulsions. The internal latent image type emulsions are used as direct reversal emulsions in combination with nucleating agents or light fogging. Further, multiple structure grains the insides of which are different from the surfaces thereof in halogen composition may be used, and silver halides different in composition may be joined by epitaxial junction.

In particular, in silver chlorobromide emulsions having a silver chloride content of 80 mol % or more, silver halide grains having silver bromide-localized phases in the insides and/or on surfaces thereof in a layer form or in a non-layer form can also be used. For the halogen composition of the localized phases, the silver bromide content is preferably at least 20 mol %, and more preferably above 30 mol %. The silver bromide content of the silver bromide-localized phases is measured by, for example, X-ray diffraction. For example, application of X-ray diffraction to silver halide grains is described in C. R. Berry and S. J. Marino, *Photographic Science and Technology*, vol. 2, page 149 (1955) and ibid., vol. 4, page 22 (1957). The silver bromide-localized phases can exist inside the grains, on edges and corners of surfaces of the grains, and on the surfaces thereof. Preferred examples thereof include localized phases formed on the corner portions of the grains by epitaxial junction.

The silver halide grains can be used, selected from normal crystals free from twin planes, a single twin containing one twin plane, parallel multiple twins containing two or more parallel twin planes, non-parallel multiple twins containing two or more non-parallel twin planes, spherical grains, potato-like grains, tabular grains having a high aspect ratio and combined systems thereof according to their purpose. The form of twin grains is described in *Shashin Kohgaku no Kiso* (*Ginen Shashin*) (The Fundamentals of Photographic Engineering (Silver Salt Photograph)), page 163, edited by Nippon Shashin Gakkai, Corona Publishing Co. Ltd.

In the case of normal crystals, the grains having the cubic form comprising a (100) face, the octahedral form comprising a (111) face, and the dodecahedral form comprising a (110) face can be used. The dodecahedral grains are described in JP-B-55-42737 and JP-A-60-222842, and further reported in *Journal of Imaging Science*, vol. 30, page 247 (1986). Grains having (h11) faces, (hh1) faces, (hk0) faces and (hk1) faces can also be used according to their purpose. Tetradecahedral grains having (111) and (100) faces and grains having (111) and (110) faces can also be utilized. Polyhedral grains such as octatriacontahedral grains, deformed rhombic tetracosahedral grains, hexatetracontahedral grains and octahexacontahedral grains can also be used as needed.

The tabular grains having a high aspect ratio can also be preferably used. The tabular grains of high silver chloride emulsions having (111) faces are described in U.S. Pat. Nos. 4,399,215, 4,400,463 and 5,217,858, and JP-A-2-32. Further, an empirical rule of the formation of tabular silver chloride grains is reported in *Journal of Photographic Science*, 36, 182 (1988). The tabular grains of high silver chloride emulsions having (100) faces are described in U.S. Pat. Nos. 4,946,772, 5,275,930 and 5,264,337, JP-A-6-59360, JP-A-6-308648 and EP-A-534395. Such grains having a high aspect ratio are larger in surface area than normal crystals having the same volume, so that the amount of sensitizing dyes adsorbed can be increased. This is advantageous in respect to color sensitization sensitivity. Further, this is advantageous in respect to covering power, so that a small amount of silver can achieve high Dmax. The grains have the feature that the developing activity is high because of their high specific surface area.

The silver halide grains may have any mean grain size, ranging from fine grains having a mean grain size of 0.05 μm or less to large-sized grains having a diameter of a projected area exceeding 10 μm. The mean grain size is preferably 0.1 to 2 μm, and more preferably 0.1 to 0.9 μm.

The monodisperse emulsions having a narrow grain size distribution may be used. The monodisperse emulsions are, for example, silver halide emulsions having such a grain size distribution that 80% or more of the weight or the number of the total grains fall within the range of ±30% of a mean grain size.

The polydisperse emulsions having a wide grain size distribution may also be used.

Further, for adjusting gradation, two or more kinds of monodisperse silver halide emulsions may be used in combination which have a substantially identical color sensitivity and are different in grain size, as described in JP-A-1-167743 and JP-A-4-223463. The two or more kinds of emulsions may be added to the same layer or separately added to different layers. Combinations of two or more kinds of polydisperse silver halide emulsions or combinations of monodisperse emulsions and polydisperse emulsion can also be used.

In the course of preparation of the silver halide emulsions in the present invention, salt removal for removing excess salts is preferably conducted. Water washing with noodle may be used which is conducted by gelation of gelatin, and precipitation (flocculation) may also be used in which multiply charged anionic inorganic salts (for example, sodium sulfate), anionic surfactants, anionic polymers (for example, sodium polystyrenesulfonate) or gelatin derivatives (for example, aliphatic acylated gelatin, aromatic acylated gelatin and aromatic carbamoylated gelatin) are utilized. Ultrafilters shown in U.S. Pat. No. 4,758,505, JP-A-62-113137, JP-B-59-43727 and U.S. Pat. No. 4,334,012 may also be used, and spontaneous precipitation and centrifugation may also be used. Usually, precipitation is preferably used.

Methods for preparing the silver halide emulsions are described in P. Glafkides, *Chemie et Physique Photoqraphique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964).

The preparation methods may be any of acidic, neutral and ammonia processes. The pH may be elevated to a degree that fog is not generated. A soluble silver salt and a soluble halogen salt may be allowed to react with each other by using any of a single jet process, a double jet process and a combination thereof. A so-called reverse mixing process in which grains are formed in the presence of excess silver ions can also be used. As a type of double jet process, there can also be used a process for maintaining constant the pAg in a liquid phase in which a silver halide is formed, namely a so-called controlled double jet process. According to this process, silver halide emulsions in which the crystal system is regular and the grain size is nearly uniform.

In the preparation of the silver halide emulsions, it is preferred to adjust the pAg and the pH during formation of the grains. The adjustment of the pAg and the pH are described in *Photographic science and Engineering*, vol. 6, pages 159 to 165 (1962), *Journal of Photographic Science*, vol. 12, pages 242 to 251 (1964), U.S. Pat. No. 3,655,394 and British Patent 1,413,748. As protective colloids used in the preparation of the emulsions in the present invention, gelatin is advantageously used, but other hydrophilic colloids can also be used. The hydrophilic colloids can be used alone or in combination with gelatin. Examples of the hydrophilic colloids which can be preferably used include proteins such as gelatin derivatives, graft polymers of gelatin with other polymers, albumin and casein; cellulose derivatives such as hydroxyethyl cellulose and cellulose sulfates; sodium alginate; starch derivatives; polysaccharides; carrageenan; and synthetic hydrophilic polymers such as homopolymers and copolymers of polyvinyl alcohol, modified alkyl polyvinyl alcohols, poly-N-vinylpyrrolidone, polyacrylic acid, polymethacrylic acid, polyacrylamide, polyvinylimidazole and polyvinylpyrazole. Thioether polymers described in U.S. Pat. No. 3,615,624 can also be preferably used.

As gelatin, gelatin derivatives such as acid-treated gelatin, delimed gelatin and phthalated gelatin, and low molecular weight gelatin, besides lime-treated gelatin, can be used. Further, gelatin oxidized with an oxidizing agent such as hydrogen peroxide and enzyme-treated gelatin can also be used. Hydrolyzed or enzymatically decomposed products of gelatin can also be used.

In the course of preparation or physical ripening of the silver halide grains, metal salts (including complex salts) may be allowed to coexist. Examples of the metal salts include salts or complex salts of noble metals or heavy metals such as cadmium, zinc, lead, thallium, iridium, platinum, palladium, osmium, rhodium, chromium, ruthenium and rhenium. These compounds may be used alone or in combination. The amount to be added is about $10^{-9}$ to about $10^{-3}$ mol per mol of silver halide. As complex ions and coordination compounds, bromine ions, chlorine ions, cyanogen ions, nitrosyl ions, thionitrosyl ions, water, ammonia and combinations thereof are preferably used. For example, yellow prussiate, $K_2IrCl_6$, $K_3IrCl_6$, $(NH_4)_2RhCl_5(H_2O)$, $K_2RuCl_5(NO)$, $K_3Cr(CN)_6$, etc. are preferably used. The amount to be added is about $10^{-9}$ to about $10^{-2}$ mol per mol of silver halide, although it depends on the purpose of use. They may be uniformly incorporated into the silver halide grains, localized in the insides or on the surfaces of the grains, in the silver bromide-localized phases or in the high silver halide grain bases. These compounds are added by mixing solutions of the metal salts with aqueous solutions of halides in formation of the grains, adding fine grains of the silver halide emulsions doped with the metal ions, or directly adding solutions of the metal salts during or after formation of the grains.

In order to increase the sensitivity and the density at high illumination exposure, complex metal salts having cyanogen ions such as iridium and yellow prussiate as ligands, lead chloride, cadmium chloride and zinc chloride can be preferably used. When spectral sensitization is conducted in the red or infrared region, complex metal salts having cyanogen ions such as yellow prussiate as ligands, lead chloride, cadmium chloride and zinc chloride are preferably used. For hard gradation enhancement, rhodium salts, ruthenium salts and chromium salts are preferably used.

The rate of addition, the amount or the concentration of silver salt solutions (for example, an aqueous solution of $AgNO_3$) and halogen compound solutions (for example, an aqueous solution of KBr) added in formation of the silver halide grains may be increased to speed up the formation of the grains. Methods for thus rapidly forming the silver halide grains are described in British Patent 1,335,925, U.S. Pat. Nos. 3,672,900, 3,650,757 and 4,242,445, JP-A-55-142329, JP-A-55-158124, JP-A-58-113927, JP-A-58-113928, JP-A-58-111934 and JP-A-58-111936.

Halogen may be substituted with halogen which forms slightly soluble silver halide grains on surfaces of the silver halide grains during or after the grain formation (halogen conversion). This halogen conversion process is described in *Die Grundlagen der Photographischen Prozesse mit Silverhalogeniden*, pages 662 to 669, and *The theory of Photographic Process*, the fourth edition, pages 97 and 98. In this process, halogen may be added either in the form of a solution of a soluble halogen compound or in the form of fine silver halide grains.

During and/or after the grain formation, thiosulfonates, dichalcogen compounds described in U.S. Pat. Nos. 5,219,721 and 5,364,754, lipoic acid, cysteine, elementary sulfur and inorganic metal complexes such as cobalt-ammonium complexes may be added.

In the present invention, the silver halide emulsions can be used as such, without chemical sensitization, but usually with chemical sensitization. With respect to chemical sensitization used in the present invention, chalcogen sensitization such as sulfur sensitization, selenium sensitization or tellurium sensitization, noble metal sensitization using gold, platinum or palladium, and reduction sensitization can be used alone or in combination (for example, JP-A-3-110555 and JP-A-5-241267). Such chemical sensitization can be conducted in the presence of nitrogen-containing heterocyclic compounds (JP-A-62-253159). Further, antifoggants given later can be added after termination of chemical sensitization. Specifically, methods described in JP-A-5-45833 and JP-A-62-40446 can be used.

As sulfur sensitizers, unstable sulfur compounds are used. Examples of the sulfur compounds include known sulfur compounds such as thiosulfates (for example, hypo), thiourea derivatives (for example, diphenylthiourea, triethylthiourea and allyl-thiourea), allyl isothiocyanate, cystine, p-toluenethio-sulfonates, rhodanine derivatives and mercapto compounds. The sulfur sensitizers may be added in an amount sufficient to effectively enhancing the sensitivity of the emulsions, and preferably used within the range of $10^{-9}$ to $10^{-1}$ mol per mol of silver halide as a guide, although the suitable amount thereof varies in balance with the pH, the temperature and other sensitizers, and depending on various conditions such as the size of the silver halide grains.

In selenium sensitization, known unstable selenium compounds are used. Examples of the selenium compounds include colloidal metallic selenium, selenourea derivatives (for example, N,N-dimethylselenourea and N,N-diethylselenourea), selenoketones, selenoamides, aliphatic isoselenocyanates (for example, allyl isoselenocyanate), selenocarboxylic acids and esters thereof, selenophoshpates and selenides such as diethyl selenide and diethyl diselenide. The selenium sensitizers are preferably used within the range of $10^{-10}$ to $10^{-1}$ mol per mol of silver halide as a guide, although the amount varies depending on various conditions as is the case with the sulfur sensitizers.

In the present invention, noble metal sensitization can also be employed, in addition to chalcogen sensitization. First, in gold sensitization, the valence of gold may be either +1 or +3, and various kinds of gold compounds are used. Typical examples thereof include chloroaurates such as potassium chloroaurate, auric trichloride, potassium aurothiocyanate, potassium iodoaurate, tetraauric acid, ammonium aurothiocyanate, pyridyltrichlorogold, gold sulfide, gold selenide and gold telluride.

The gold sensitizers are preferably used within the range of $10^{-10}$ to $10^{-1}$ mol per mol of silver halide as a guide, although the amount varies depending on various conditions.

The gold sensitizers may be added simultaneously with sulfur sensitization, selenium sensitization or tellurium sensitization, or during, before or after sulfur sensitization, selenium sensitization or tellurium sensitization. It is also possible to use the gold sensitizers alone.

There is no particular limitation on the pAg and the pH of the emulsions which are subjected to sulfur sensitization, selenium sensitization, tellurium sensitization or gold sensitization in the present invention. However, the pAg is preferably within the range of 5 to 11, and more preferably within the range of 6.8 to 9.0, and the pH is preferably within the range of 3 to 10, and more preferably within the range of 5.5 to 8.5.

In the present invention, noble metals other than gold can also be used as chemical sensitizers. The noble metals other than gold include, for example, salts of metals such as platinum, palladium, iridium and rhodium, and complex salts thereof.

In the present invention, reduction sensitization can be further employed. As reduction sensitizers used in the present invention, there are known sulfites, ascorbic acid, stannous salts, amines, polyamines, hydrazine derivatives, formamidinesulfinic acids, silane compounds and borane compounds. In the present invention, one selected from these known compounds can be used, or two or more of them can also be used in combination. Preferred examples of the reduction sensitizers include stannous chloride, thiourea dioxide, dimethylamine borane, L-ascorbic acid and aminoiminomethane-sulfinic acid. The amount of the reduction sensitizers depends on emulsion conditions, and therefore must be selected. However, it is suitably within the range of $10^{-9}$ to $10^{-2}$ mol per mol of silver halide.

Besides addition of the above-mentioned reduction sensitizers, growth or ripening in an atmosphere of a low pAg of 1 to 7 which is called silver ripening, growth or ripening in an atmosphere of a high pH of 8 to 11 which is called high pH ripening, or reduction sensitization by passing a hydrogen gas or by use of nascent hydrogen produced by electrolysis can also be selected. Further, two or more of them can be used in combination.

This reduction sensitization can be used alone, but can also be used in combination with the above-mentioned chalcogen sensitization or noble metal sensitization.

In order to give the color sensitivities of green, red and infrared sensitivities to the light-sensitive silver halide emulsions used in the present invention, the light-sensitive silver halide emulsions are spectrally sensitized with methine dyes or the like. Further, spectral sensitization of a blue region may be applied to blue-sensitive emulsions as needed.

The dyes used include cyanine dyes, merocyanine dyes, complex cyanine dyes, complex merocyanine dyes, holopolarcyanine dyes, hemicyanine dyes, styryl dyes and hemioxanol dyes. Dyes belonging to the cyanine dyes, the merocyanine dyes and the complex merocyanine dyes are particularly useful. Any nuclei usually utilized in cyanine dyes as basic heterocyclic ring nuclei can be applied to these dyes. That is, there can be applied pyrroline, oxazoline, thiazoline, pyrrole, oxazole, thiazole, selenazole, imidazole, tetrazole and pyridine nuclei; nuclei in which alicyclic hydrocarbon rings are fused together with these nuclei; and benzoindolenine, indole, benzoxazole, naphthoxazole, benzothiazole, naphthothiazole, benzoselenazole, benzimidazole and quinoline nuclei. These nuclei may be substituted on carbon atoms.

To the merocyanine dyes or the complex merocyanine dyes, 5- and 6-membered heterocyclic ring nuclei such as pyrazoline-5-one, thiohydantoin, 2-thioxazolidine-2,4-dione, thiazolidine-2,4-dione, rhodanine and thiobarubituric acid nuclei can be applied as nuclei having the keto-methylene structure.

Examples thereof include sensitizing dyes described in U.S. Pat. No. 4,617,257, JP-A-59-180550, JP-A-64-13546, JP-A-5-45828 and JP-A-5-45834.

These sensitizing dyes may be used alone or in combination. The combinations of the sensitizing dyes are often used, particularly for wavelength adjustment in supersensitization and spectral sensitization.

The emulsions may contain dyes having no spectral sensitization action themselves or compounds which do not substantially absorb visible light, but exhibit supersensitization, in combination with the sensitizing dyes (for example, ones described in U.S. Pat. No. 3,615,641, JP-A-59-192242, JP-A-59-191032 and JP-A-63-23145). In particular, the compounds described in JP-A-59-191032 and JP-A-59-192242 are preferably used, when the sensitizing dyes having the spectral sensitization sensitivity from the red region to the infrared region are used.

The sensitizing dyes may be added in any stage of the emulsion preparation. Most normally, they are added during a period from completion of chemical sensitization up to before coating, but they can be added simultaneously with addition of the chemical sensitizers to conduct spectral sensitization and chemical sensitization at the same time as described in U.S. Pat. Nos. 3,628,969 and 4,225,666, or they can be added prior to chemical sensitization as described in JP-A-58-114928. Further, they can be added before completion of precipitation formation of the silver halide grains to initiate spectral sensitization. Furthermore, it is also possible to add these compounds in parts, namely to add a part thereof prior to chemical sensitization and the residue after chemical sensitization, as taught in U.S. Pat. No. 4,225,666, and they may be added at any time during formation of the silver halide grains, including methods described in U.S. Pat. No. 4,183,756. The sensitizing agents can be added in an amount of about $9\times10^{-9}$ to about $9\times10^{-3}$ mol per mol of silver halide.

These sensitizing dyes and supersensitizers may be added as solutions thereof in hydrophilic organic solvents such as methanol, aqueous solutions thereof (in some cases, they may be basic or acidic to enhance the solubility), dispersions in gelatin or solutions thereof in surfactants.

In order to enhance adsorption of the sensitizing dyes, soluble Ca compounds, soluble Br compounds, soluble I compounds, soluble Cl compounds or soluble SCN compounds may be added before, after or during addition of the sensitizing dyes. These compounds may be used in combination. $CaCl_2$, KI, KCl, KBr and KSCN are preferably used. Further, they may be fine grains of silver bromide, silver chlorobromide, silver iodobromide, silver iodide and silver rhodanide emulsions.

There is no particular limitation on other additives added to the photographic materials to which the emulsions are applied in the present invention. For example, reference can be made to the descriptions of *Research Disclosure*, vol. 176, item 17643 (RD-17643), ibid., vol. 187, item 18716 (RD-18716), and ibid., vol. 307, item 307105 (RD-307105).

As to additives used in such stages and known photographic additives available in the light-sensitive materials and the complexing agent sheets used in the present invention, portions of RD-17643, RD-18716 and RD-307105 are listed in which the various additives are described.

| Additive | RD17643 | RD18716 | RD307105 |
|---|---|---|---|
| 1. Chemical Sensitizer | p.23 | p.648, right column | p.866 |
| 2. Sensitivity Increasing Agent | | p.648, right column | |
| 3. Spectral Sensitizer, Supersensitizer | pp.23–24 | p.648, right column to p.649, right column | pp.866–868 |
| 4. Brightening Agent | p.24 | p.648, right column | p.868 |
| 5. Antifoggant, Stabilizer | pp.24–25 | p.649, right column | pp.868–870 |
| 6. Light Absorber, Filter dye, UV Absorber | pp.25–26 | p.649, right column to p.650, left column | p.873 |
| 7. Stain Inhibitor | p.25, right column | p.650. left column to right column | |
| 8. Dye Image Stabilizer | p.25 | p.650, left column | p.872 |
| 9. Hardener | p.26 | p.651, left column | pp.874–875 |
| 10. Binder | p.26 | p.651, left column | pp.873–874 |
| 11. Plasticizer, Lubricant | p.27 | p.650, right column | p.876 |
| 12. Coating Aid, Surfactant | pp.26–27 | p.650 right column | pp.875–876 |
| 13. Antistatic Agent | p.27 | p.650 right column | pp.876–877 |
| 14. Matte Agent | | | pp.878–879 |

Further, the compounds shown below can also be used.

| Item | Corresponding Portions |
|---|---|
| 1) Silver Halide Emulsion and the Preparation thereof | JP-A-2-97937, pages 20, lower right column, line 12 to page 21, lower left column, line 14; JP-A-2-12236, page 7, upper right column, line 19 to page 8, lower right column, line 12; JP-A-4-330430 and JP-A-5-11389 |
| 2) Spectral Sensitizing Dye | Spectral sensitizing dyes described in JP-A-2-55349, page 7, upper left column, line 8 to page 8, lower right column, line 8; JP-A-2-39042, page 7, lower right column, line 8 to page 13, lower right column, line 5; JP-A-2-12236, page 8, lower left column, line 13 to lower right column, line 4; JP-A-2-103536, page 16, lower right column, line 3 to page 17, lower left column, line 20; JP-A-1-112235; JP-A-2-124560; JP-A-3-7928; and JP-A-5-11389 |
| 3) Surfactant Antistatic Agent | JP-A-2-12236, page 9, upper right column, line 7 to lower right column, line 7; and JP-A-2-18542, page 2, lower left column, line 13 to page 4, lower right column, line 18 |
| 4) Antifoggant Stabilizers | Thiosulfinic acids described in JP-A-2-103536, page 17, lower right column, line 19 to page 18, upper right column, line 4 and page 18, lower right column, line 1 to line 5; and JP-A-1-237538 |
| 5) Polymer Latex | JP-A-2-103536, page 18, lower left column, line 12 to line 20 |
| 6) Compound Having | JP-A-2-103536, page 18, lower |

-continued

| Item | Corresponding Portions |
|---|---|
| Acid Group | right column, line 6 to page 19, upper left column, line 1; and JP-A-2-55349, page 8, lower right column, line 13 to page 11, upper left column, line 8 |
| 7) Polyhydroxybenzene | JP-A-2-55349, page 11, upper left column, line 9 to lower right column, line 17 |
| 8) Matte Agent Lubricant Plasticizer | JP-A-2-103536, page 10, upper left column, line 15 to page 19, upper right column, line 15 |
| 9) Hardening Agent | JP-A-2-103536, page 18, upper right column, line 5 to line 17 |
| 10) Dye | JP-A-2-103536, page 17, lower right column, line 1 to line 18; and JP-A-2-39042, page 4, upper right column line 1 to page 6, upper right column, line 5 |
| 11) Binder | JP-A-2-18542, page 3, lower right column, line 1 to line 20 |
| 12) Developing Solution and Developing Method | JP-A-2-55349, page 13, lower right column, line 1 to page 16, upper left column, line 10; and JP-A-2-103536, page 19, upper right column, line 16 to page 21, upper left column, line 8 |
| 13) Black Pepper Inhibitor | Compounds described in U.S. Patent 4,956,257 and JP-A-1-118832 |
| 14) Redox Compound | Compounds represented by general formula (I) of JP-A-2-301743 (particularly, compound examples 1 to 50); general formulas (R-1), (R-2) and (R-3) and compounds 1 to 75 described in JP-A-3-174143, pages 3 to 20; and compounds described in JP-A-5-257239 and JP-A-4-278939 |
| 15) Monomethine Compound | Compounds of general formula (II) of JP-A-2-287532 (particularly compound examples II-1 to II-26) |
| 16) Hydrazine Compound | Descriptions in JP-A-2-12236, page 2, upper right column, line 19 to page 7, upper right column, line 3; and general formula (II) and compound examples II-1 to II-54 of JP-A-3-174143, page 20, lower right column, line 1 to page 27, upper right column, line 20 |
| 17) Nucleating Accelerator | General formulas (II-m) to (II-p) and compounds examples II-1 to II-22 of JP-A-2-103536, page 9, upper right column, line 13 to page 16, upper left column, line 10; and compounds described in JP-A-1-179939 |

Of the above-mentioned additives, the antifoggants and stabilizers which can be preferably used include azoles (for example, benzothiazolium salts, nitroimidazoles, nitrobenzimidazoles, chlorobenzimidazoles, bromobenzimidazoles, nitroindazoles, benzotriazoles and aminotriazoles); mercapto compounds (for example, mercaptothiazoles, mercaptobenzo-thiazoles, mercaptobenzimidazoles, mercaptothiadiazoles, mercaptotetrazoles (particularly 1-phenyl-5-mercaptotetrazole and derivatives thereof), mercaptopyrimidines and mercaptotriazines); thioketo compounds such as oxazolinethione; azaindene compounds (for example, triazaindenes, tetraazaindenes (particularly, 4-hydroxy-6-methyl(1,3,3a,7)tetraazaindenes) and pentaazaindenes); benzenethiosulfones; benzenesulfinic acid; and benzenesulfonic acid amides.

In the present invention, organic metal salts can also be used as oxidizing agents in combination with the light-sensitive silver halide emulsions. Of these organic metal salts, organic silver salts are particularly preferably used.

Organic compounds which can be used for formation of the above-mentioned organic silver salt oxidizing agents include benzotriazole compounds, fatty acids and other compounds described in U.S. Pat. No. 4,500,626, columns 52 and 53. Silver acetylide described in U.S. Pat. No. 4,775,613 is also useful. The organic silver salts may be used in combination.

The organic silver salts described above can be used in combination with the light-sensitive silver halides in an amount of 0.01 to 10 mol, preferably 0.01 to 1 mol, per mol of light-sensitive silver halide. The total amount of the organic silver salts and the light-sensitive silver halides coated is 0.05 to 10 g/m$^2$, preferably 0.1 to 4 g/m$^2$, in terms of silver.

Then, the reducing agents (developing agents) represented by general formulas (I) to (5) are illustrated.

The compounds represented by general formula (1) are named generically sulfonamidophenols and well known in the art. However, in the present invention, the compounds are characterized by that at least one of substituent groups $R_1$ to $R_5$ has a ballast group having 8 or more carbon atoms.

In formula (1), $R_1$ to $R_4$ each represents a hydrogen atom, a halogen atom (for example, chlorine or bromine), an alkyl group (for example, methyl, ethyl, isopropyl, n-butyl or t-butyl), an aryl group (for example, phenyl, tolyl or xylyl), an alkylcarbonamido group (acetylamino propionylamino or butyroyl-amino), an arylcarbonamido group (for example, benzoylamino), an alkylsulfonamido group (for example, methanesulfonylamino or ethanesulfonylamino), an arylsulfonamido group (for example, benzenesulfonylamino or toluenesulfonylamino), an alkoxyl group (for example, methoxy, ethoxy or butoxy), an aryloxy group (for example, phenoxy), an alkylthio group (for example, methylthio, ethylthio or butylthio), an arylthio group (for example, phenylthio or tolylthio), an alkylcarbamoyl group (for example, methylcarbamoyl, dimethylcarbamoyl, ethylcarbamoyl, diethyl-carbamoyl, dibutylcarbamoyl, piperidylcarbamoyl or morpholyl-carbamoyl), an arylcarbamoyl group (for example, phenyl-carbamoyl, methylphenylcarbamoyl, ethylphenylcarbamoyl or benzylphenylcarbamoyl), a carbamoyl group, an alkylsulfamoyl group (for example, methylsulfamoyl, dimethylsulfamoyl, ethylsulfamoyl, diethylsulfamoyl, dibutylsulfamoyl, piperidyl-sulfamoyl or morpholylsulfamoyl), an arylsulfamoyl group (for example, phenylsulfamoyl, methylphenylsulfamoyl, ethylphenylsulfamoyl or benzylphenylsulfamoyl), a sulfamoyl group, a cyano group, an alkylsulfonyl group (for example, methanesulfonyl or ethanesulfonyl), an arylsulfonyl group (for example, phenylsulfonyl, 4-chlorophenylsulfonyl or p-toluenesulfonyl), an alkoxycarbonyl group (for example, methoxycarbonyl, ethoxycarbonyl or butoxycarbonyl), an aryloxycarbonyl group (for example, phenoxycarbonyl), an alkylcarbonyl group (for example, acetyl, propionyl or butyroyl), an arylcarbonyl group (for example, benzoyl or alkylbenzoyl) or an acyloxy group (for example, acetyloxy, propionyloxy or butyroyloxy). Of $R_1$ to $R_4$, $R_2$ and $R_4$ are preferably hydrogen atoms. The total of Hammett constants $O_p$ of $R_1$ to $R_4$ is preferably 0 or more.

$R_5$ represents an alkyl group (for example, methyl, ethyl, butyl, octyl, lauryl, cetyl or stearyl), an aryl group (for example, phenyl, tolyl, xylyl, 4-methoxyphenyl, dodecylphenyl, chlorophenyl, trichlorophenyl, nitrochlorophenyl, triisopropyl-phenyl, 4-dodecyloxyphenyl or 3,5-di(methoxy-carbonyl)phenyl) or a heterocyclic group (for example, pyridyl).

The compounds represented by general formula (2) are named generically sulfonylhydrazines. Further, the compounds represented by general formula (4) are named generically carbamoylhydrazines. Both are well known in the art. However, in the present invention, the compounds are characterized by that $R_5$ or a substituent group of the ring has a ballast group having 8 or more carbon atoms.

In general formulas (2) and (4), Z represents a group of atoms (atomic group) forming an aromatic ring. An aromatic ring formed by Z imparts silver development activity to the compound, so that it is required to be sufficiently electron-attractive. Accordingly, an aromatic ring is preferably used in which a nitrogen-containing aromatic ring is formed or an electron-attractive (electron-withdrawing) group is introduced into a benzene ring. Preferred examples of such aromatic rings include pyridine, pyrazine, pyrimidine, quinoline and quinoxaline rings. For the benzene ring, substituent groups thereof include alkylsulfonyl groups (for example, methanesulfonyl and ethanesulfonyl), halogen atoms (for example, chlorine and bromine), alkylcarbamoyl groups (for example, methylcarbamoyl, dimethylcarbamoyl, ethylcarbamoyl, diethylcarbamoyl, dibutylcarbamoyl, piperidyl-carbamoyl and morpholinocarbamoyl), arylcarbamoyl groups (for example, phenylcarbamoyl, methylphenylcarbamoyl, ethylphenyl-carbamoyl and benzylphenylcarbamoyl), a carbamoyl group, alkylsulfamoyl groups (for example, methylsulfamoyl, dimethylsulfamoyl, ethylsulfamoyl, diethylsulfamoyl, dibutylsulfamoyl, piperidylsulfamoyl and morpholylsulfamoyl), arylsulfamoyl groups (for example, phenylsulfamoyl, methylphenylsulfamoyl, ethylphenylsulfamoyl and benzylphenylsulfamoyl), a sulfamoyl group, a cyano group, arylsulfonyl groups (for example, phenylsulfonyl, 4-chlorophenylsulfonyl and p-toluenesulfonyl), alkoxycarbonyl group (for example, methoxy-carbonyl, ethoxycarbonyl and butoxycarbonyl), aryloxycarbonyl groups (for example, phenoxycarbonyl), alkylcarbonyl groups (for example, acetyl, propionyl and butyroyl) and arylcarbonyl groups (for example,. benzoyl and alkylbenzoyl). The total of Hammett constants σ of the above-mentioned substituent groups is preferably 1 or more.

The compounds represented by general formula (3) are named generically sulfonylhydrazones. Further, the compounds represented by general formula (5) are named generically carbamoylhydrazones. Both are well known in the art. However, in the present invention, the compounds are characterized by that at least one of $R_5$ to $R_8$ has a ballast group having 8 or more carbon atoms.

In general formulas (3) and (5), $R_6$ represents an alkyl group (for example, methyl or ethyl); X represents an oxygen atom, a sulfur atom, a selenium atom or an alkyl-substituted or aryl-substituted tertiary nitrogen atom, and an alkyl-substituted tertiary nitrogen atom is preferred; and $R_7$ and $R_8$, which may combine together to form a double bond or a ring, each represents a hydrogen atom or a substituent group (examples thereof include the above-mentioned substituent groups for the benzene ring of Z).

Of the compounds represented by general formulas (1) to (5), the compounds represented by general formulas (1) and (4) are preferred from the viewpoint of raw stock storability in the present invention.

In the above, each of $R_1$ to $R_8$ may have a possible substituent group. Examples of the substituent groups include the above-mentioned substituent groups for the benzene ring of Z.

Specific examples of the compounds represented by general formulas (1) to (5) are enumerated below, but the compounds used in the present invention are not, of course, limited thereby.

D-1

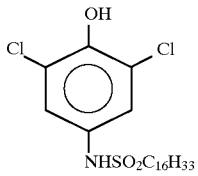

D-2

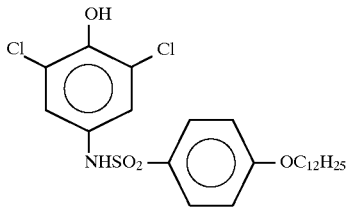

D-3

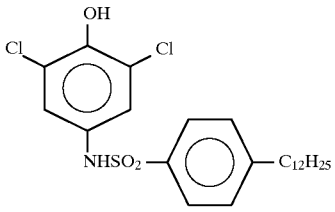

D-4

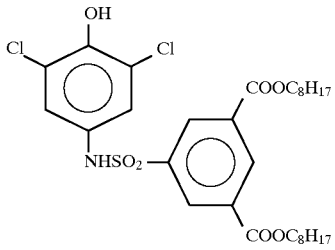

D-5

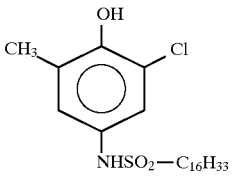

D-6

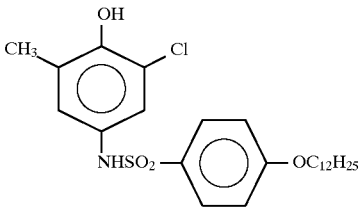

-continued
D-7
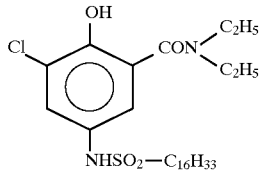
D-8
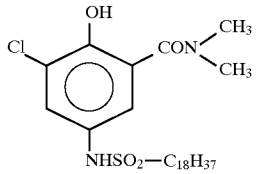
D-9
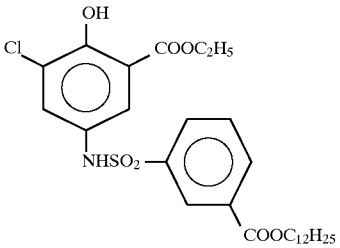
D-10
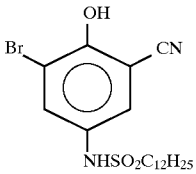
D-11
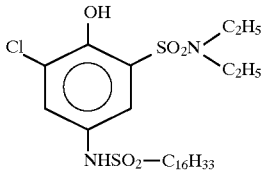
D-12
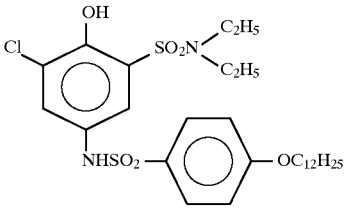
D-13
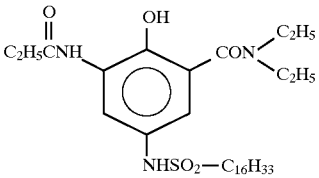
D-14
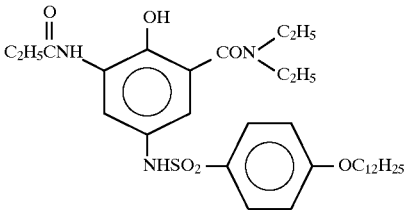
D-15
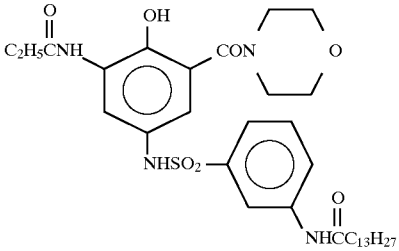
D-16
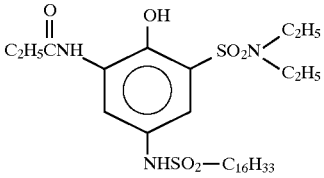
D-17
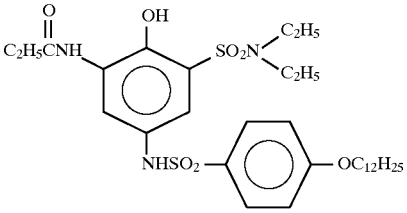
D-18
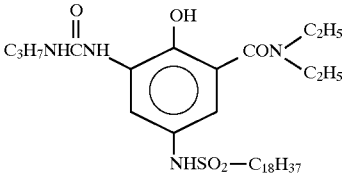
D-19
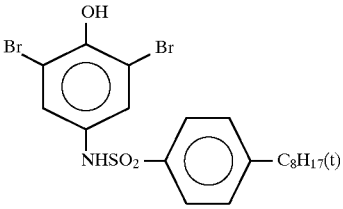
D-20
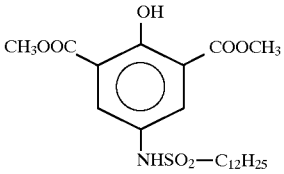

-continued
D-21
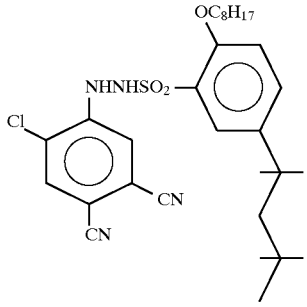
D-22
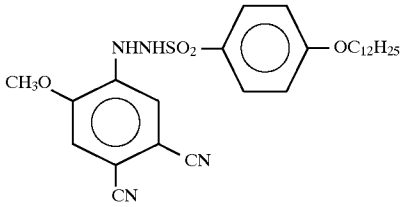
D-23
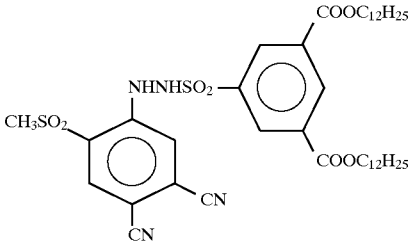
D-24
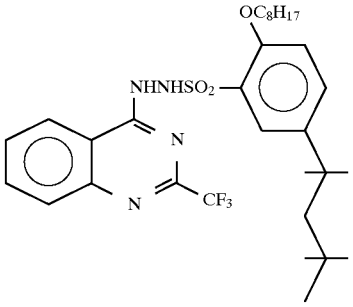
D-25
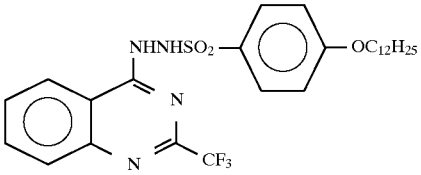
D-26
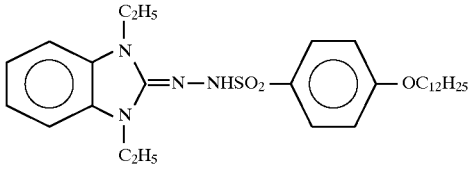
D-27
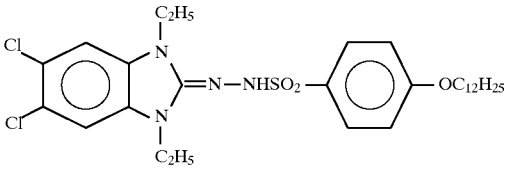
D-28
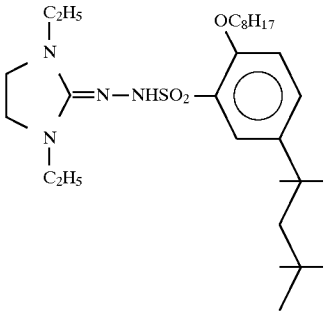
D-29
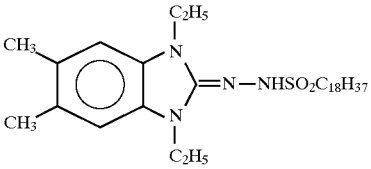
D-30
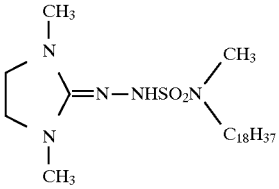
D-31
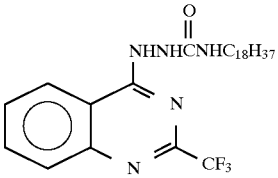
D-32
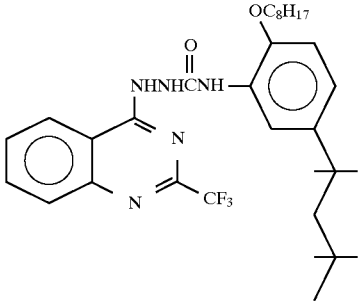

-continued
D-33
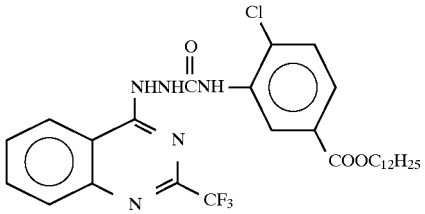
D-34
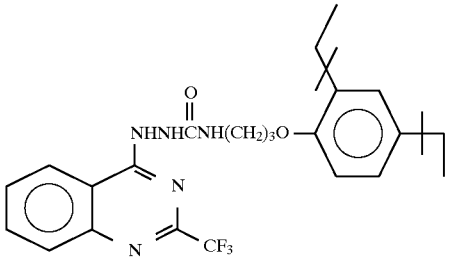
D-35
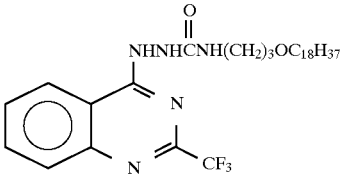
D-36
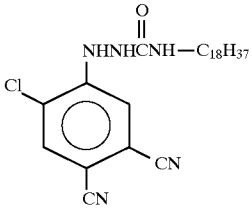
D-37
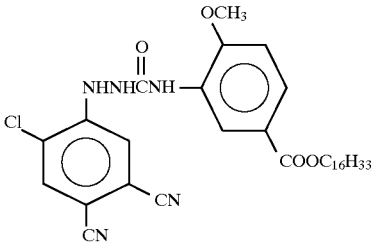
D-38
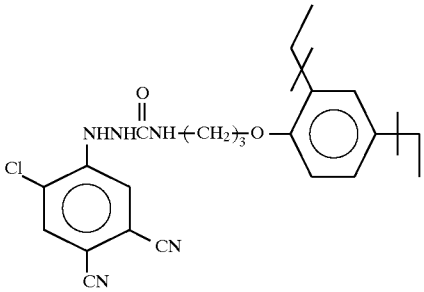
D-39
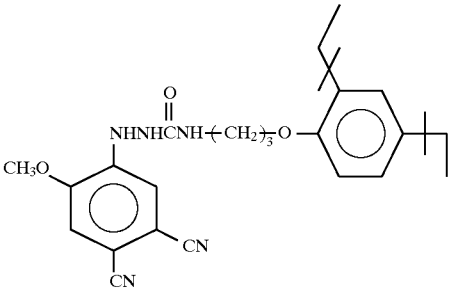
D-40
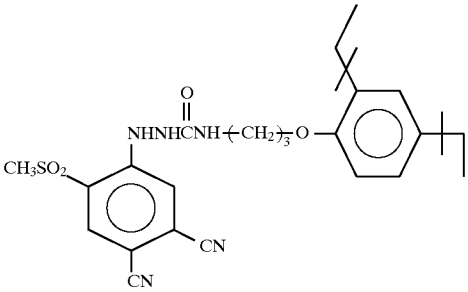
D-41
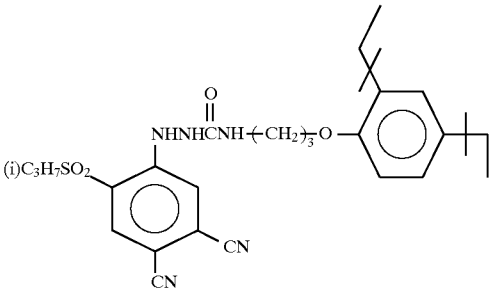
D-42
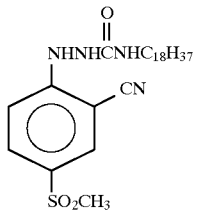

-continued
D-43
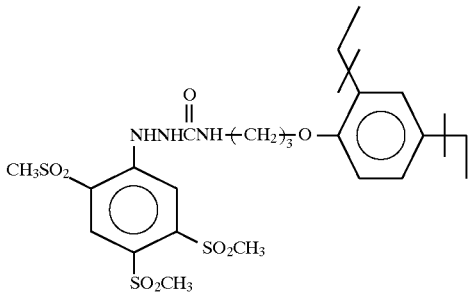
D-44
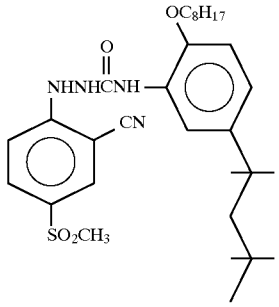
D-45
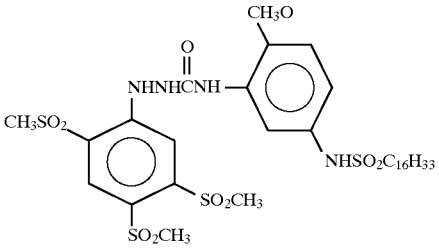
D-46
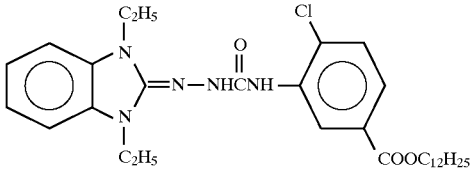
D-47
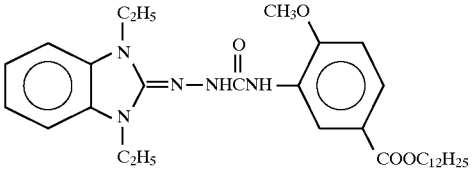
D-48
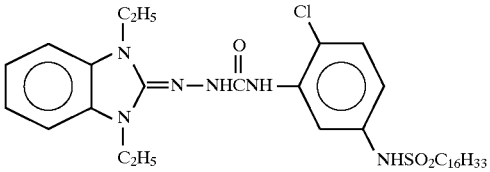
D-49
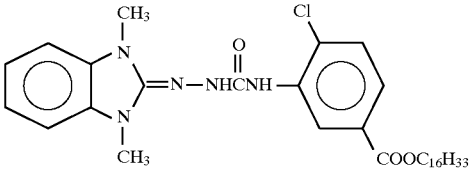
D-50
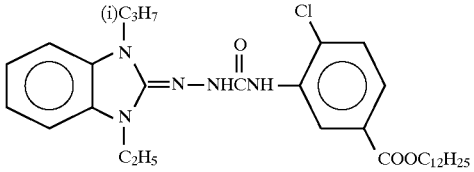
D-51
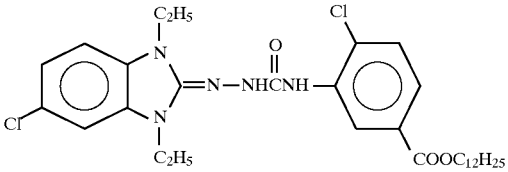
D-52
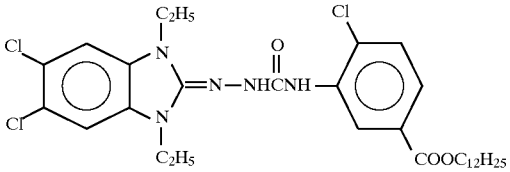
D-53
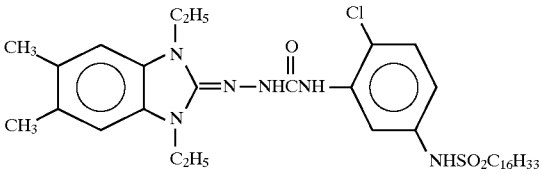
D-54
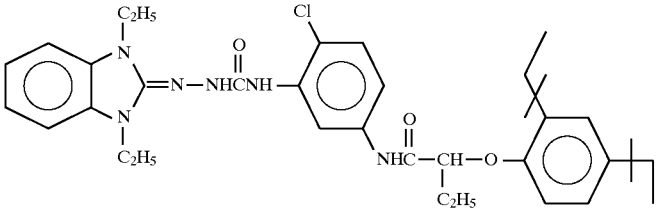

-continued
D-55
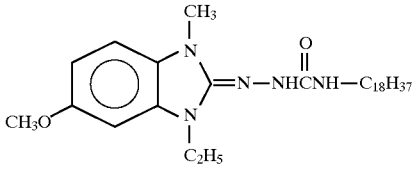
D-56
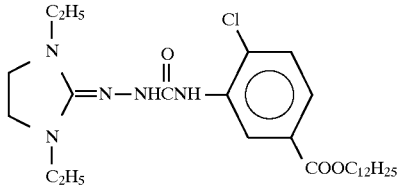
D-57
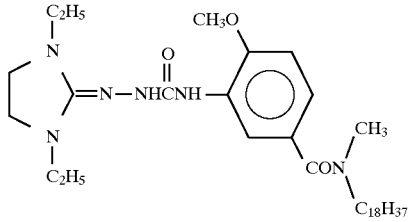
D-58
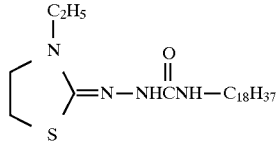
D-59
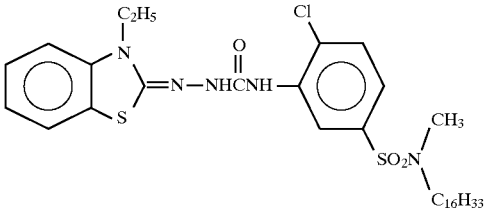
D-60
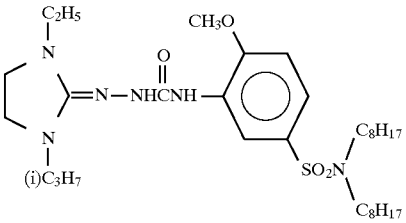
Generally, the above-mentioned compounds can be synthesized by known methods. Synthesis routes are briefly enumerated below.
Synthesis of Developing Agent D-2
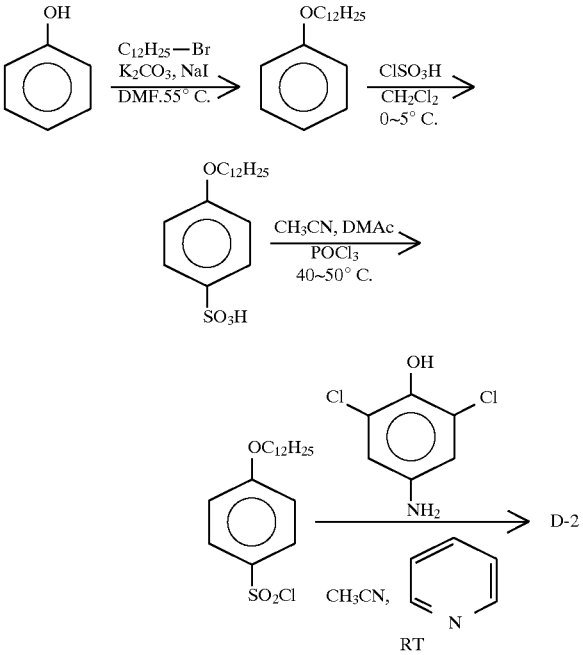
Synthesis of Developing Agent D-31
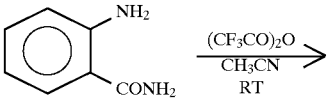
-continued
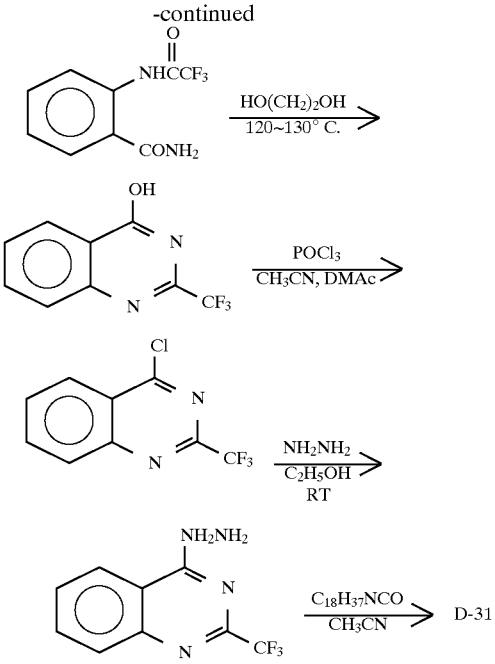
Synthesis of Developing Agent D-46
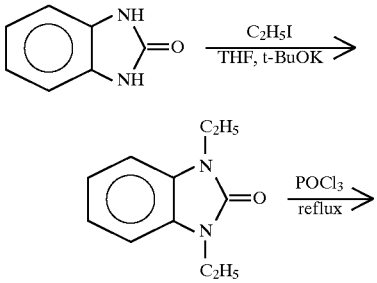

-continued

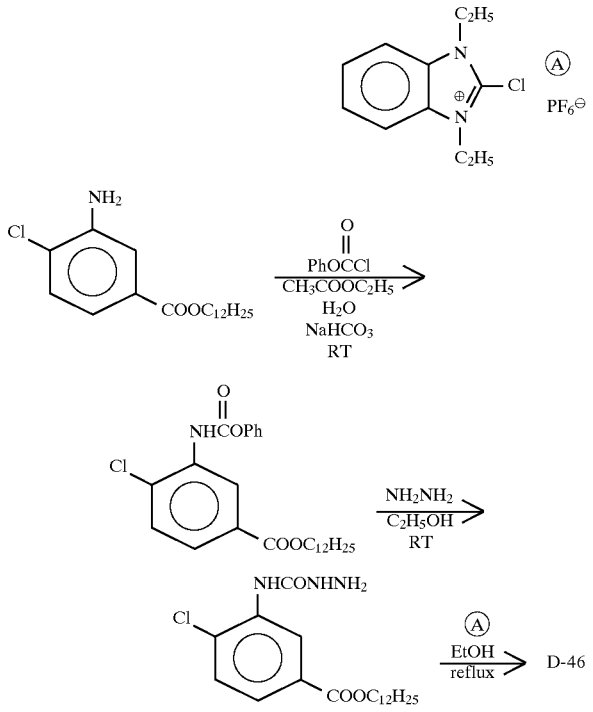

In the present invention, compounds (couplers) which form dyes by the oxidation coupling reaction are used as dye donating compounds. In the present invention, 4-equivalent couplers and 2-equivalent couplers are properly used as the couplers depending on the type of developing agents. First, the 4-equivalent couplers are used for the developing agents represented by general formulas (1) to (3). In the developing agents represented by general formulas (1) to (3), coupling sites are substituted with sulfonyl groups, and the sulfonyl groups are released as sulfinic acid in coupling. Accordingly, elimination groups of the couplers must be released as cations. For this reason, these developing agents react with the 4-equivalent couplers which can release protons as elimination groups in coupling, but do not react with the 2-equivalent couplers which release anions as elimination groups. Conversely, the 2-equivalent couplers are used for the developing agents represented by general formulas (4) and (5). In the developing agents represented by general formulas (4) and (5), coupling sites are substituted with carbamoyl groups, and hydrogen atoms on nitrogen atoms are released as protons in coupling. Accordingly, elimination groups of the couplers must be released as anions. For this reason, these developing agents react with the 2-equivalent couplers which can release anions as elimination groups in coupling, but do not react with the 4-equivalent couplers which release protons as elimination groups.

Examples of both the 4-equivalent and 2-equivalent couplers are described in detail in *Theory of the Photographic Process*, 4th ed., edited by T. H. James, pages 291 to 334 and 354 to 361, Macmillan (1977), JP-A-58-12353, JP-A-58-149046, JP-A-58-149047, JP-A-59-11114, JP-A-59124399, JP-A-59-174835, JP-A-59-231539, JP-A-59-231540, JP-A60-2951, JP-A-60-14242, JP-A-60-23474 and JP-A-60-66249.

Preferred examples of the couplers used in the present invention are enumerated below.

Compounds having structures as represented by the following general formulas (7) to (18) are preferably used as the couplers in the present invention. These compounds are generically named active methylenes, pyrazolones, pyrazoloazoles, phenols and naphthols, respectively, and well known in the art.

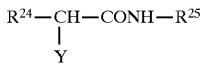

(7)

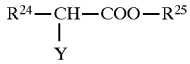

(8)

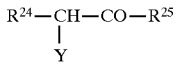

(9)

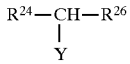

(10)

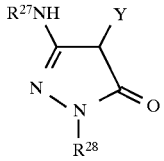

(11)

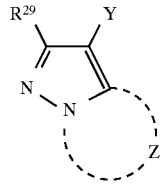

(12)

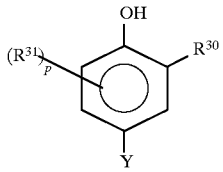

(13)

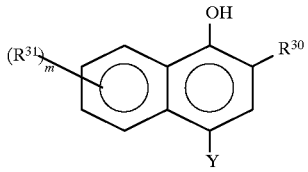

(14)

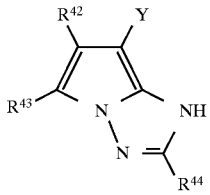

(15)

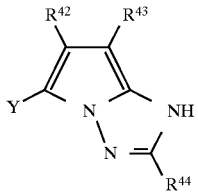

(16)

-continued (17)

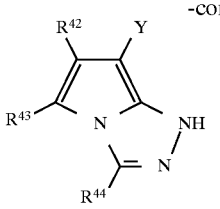

(18)

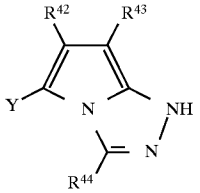

General formulas (7) to (10) indicate couplers referred to as active methylene couplers, wherein $R_{24}$ is an acyl group, a cyano group, a nitro group, an aryl group, a heterocyclic group, an alkoxycarbonyl group, an aryloxycarbonyl group, a carbamoyl group, a sulfamoyl group, an alkylsulfonyl group or an arylsulfonyl group, which may have a substituent group.

In general formulas (7) to (10), $R_{25}$ is an alkyl group, an aryl group or a heterocyclic group, which may have a substituent group. In general formula (10), $R_{26}$ is an aryl group or a heterocyclic group, which may have a substituent group. The substituent groups which $R_{24}$, $R_{25}$ and $R_{26}$ may have include various substituent groups such as alkyl, alkenyl alkynyl, aryl, heterocyclic, alkoxyl, aryloxy, cyano, acylamino, sulfonamido, carbamoyl, sulfamoyl, alkoxycarbonyl, aryloxycarbonyl, alkylamino, arylamino, hydroxyl and sulfo groups and halogen atoms. Preferred examples of $R_{24}$ include acyl, cyano, carbamoyl and alkoxycarbonyl groups.

In general formulas (7) to (10), Y is a hydrogen atom or a group removable by the coupling reaction with an oxidation product of developing agent. As examples of the groups represented by Y, the groups functioning as anionic elimination groups of the 2-equivalent couplers include halogen atoms (for example, chlorine and bromine), alkoxyl group (for example, methoxy and ethoxy), alkyl groups ( for example, methyl, ethyl, isopropyl, n-butyl and t-butyl), aryloxy groups (for example, phenoxy, 4-cyanophenoxy and 4-alkoxycarbonylphenyl), alkylthio groups (for example, methylthio, ethylthio and butylthio), arylthio groups (for example, phenylthio and tolylthio), alkylcarbamoyl groups (for example, methylcarbamoyl, dimethylcarbamoyl, ethylcarbamoyl, diethylcarbamoyl, dibutylcarbamoyl, piperidylcarbamoyl and morpholinocarbamoyl), arylcarbamoyl groups (for example, phenylcarbamoyl, methylphenylcarbamoyl, ethylphenylcarbamoyl and benzylphenylcarbamoyl), a carbamoyl group, alkylsulfamoyl groups (for example, methylsulfamoyl, dimethylsulfamoyl, ethylsulfamoyl, diethylsulfamoyl, dibutylsulfamoyl, piperidylsulfamoyl and morpholylsulfamoyl), arylsulfamoyl groups (for example, phenylsulfamoyl, methylphenylsulfamoyl, ethylphenylsulfamoyl and benzylphenylsulfamoyl), a sulfamoyl group, a cyano group, alkylsulfonyl groups (for example, methanesulfonyl and ethanesulfonyl), arylsulfonyl groups (for example, phenylsulfonyl, 4-chlorophenylsulfonyl and p-toluenesulfonyl), alkylcarbonyloxy (for example, acetyloxy, propionyloxy and butyroyloxy), arylcarbonyloxy groups (for example, benzoyloxy, toluyloxy and anisyloxy) and nitrogen-containing heterocyclic groups (for example, imidazolyl and benzotriazolyl).

The groups functioning as cationic elimination groups of the 4-equivalent couplers include a hydrogen atom, a formyl group, a carbamoyl group, methylene groups having substituent groups (the substituent groups include aryl groups, a sulfamoyl group, a carbamoyl group, alkoxyl groups, an amino group and a hydroxyl group), acyl groups and a sulfonyl group.

In general formulas (7) to (10), $R_{24}$ and $R_{25}$, or $R_{24}$ and $R_{26}$ may combine together to form a ring.

General formula (11) represents couplers called 5-pyrazolone magenta couplers. In general formula (11), $R_{27}$ represents an alkyl group, an aryl group, an acyl group or a carbamoyl group. $R_{28}$ represents a phenyl group or a phenyl group having at least one halogen atom, alkyl, cyano, alkoxyl, alkoxycarbonyl or acylamino group as a substituent group. Y has the same meaning as with general formulas (7) to (10).

Of the 5-pyrazolone magenta couplers represented by general formula (11 ), couplers are preferred in which $R_{27}$ is an aryl group or an acyl group, $R_{28}$ is a phenyl group having at least one halogen atom as a substituent group.

These preferred groups are described in detail. $R_{27}$ is an aryl group such as phenyl, 2-chlorophenyl, 2-methoxyphenyl, 2-chloro-5-tetradecaneamidophenyl, 2-chloro-5(3-octadecenyl-1-succinimido)phenyl, 2-chloro-5-octadecylsulfonamidophenyl or 2-chloro-5-[2-(4-hydroxy-3-t-butylphenoxy)tetradecaneamido]-phenyl, or an acyl group such as acetyl, pivaloyl, tetra-decanoyl, 2-(2,4-di-t-pentylphenoxy)acetyl, 2-(2,4-di-t-pentylphenoxy) butanoyl, benzoyl or 3-(2,4-di-t-aminophenoxy-acetazido) benzoyl. These groups may further have substituent groups, each of which is an organic substituent group linked through a carbon atom, an oxygen atom, a nitrogen atom or a sulfur atom; or a halogen atom.

$R_{28}$ is preferably a substituted phenyl group such as 2,4,6-trichlorophenyl, 2,5-dichlorophenyl or 2-chlorophenyl.

General formula (12) represents couplers called pyrazoloazole couplers. In general formula (12), $R_{29}$ represents a hydrogen atom or a substituent group. Z represents a nonmetal atomic group necessary for forming a 5-membered azole ring containing 2 to 4 nitrogen atoms, and said azole ring may have a substituent group (including a condensed ring). Y has the same meaning as with general formulas (7) to (10).

Of the pyrazoloazole couplers represented by general formula (12), imidazo[1,2-b]pyrazoles described in U.S. Pat. No. 4,500,630, pyrazolo[1,5-b][1,2,4]triazoles described in U.S. Pat. No. 4,540,654 and pyrazolo[5,1-c][1,2,4]triazoles described in U.S. Pat. No. 3,725,067 are preferred in respect to absorption characteristics of color developing dyes. Of these, pyrazolo[1,5-b][1,2,4]triazoles are preferred in respect to light fastness.

Details of the substituent groups of the azole ring represented by $R_{29}$, Y and Z are described, for example, in U.S. Pat. No. 4,540,654, the second column, line 41 to the eight column, line 27. Preferred examples thereof include pyrazoloazole couplers in each of which a branched alkyl group is directly connected to the 2-, 3- or 6-position of a pyrazolotriazole ring as described in JP-A-61-65245, pyrazoloazole couplers containing sulfonamido groups in their molecules described in JP-A-61-65245, pyrazoloazole couplers having alkoxyphenylsulfonamido ballast groups described in JP-A-61-147254, pyrazolotriazole couplers each having an alkoxyl group or an aryloxy group at the 6-position described in JP-A-62-209457 or JP-A-63-307453, and pyrazolotriazole couplers having carbonamido groups in their molecules described in JP-A-2-201443.

General formulas (13 ) and (14 ) represent couplers called phenol couplers and naphthol couplers, respectively. In formulas (13 ) and (14 ), $R_{30}$ represents a hydrogen atom or a group selected from the group consisting of —$NHCOR_{32}$, —$SO_2NR_{32}R_{33}$, —$NHSO_2R_{32}$, —$NHCOR_{32}$, —$NHCONR_{32}R_{33}$ and —$NHSO_2NR_{32}R_{33}$ $R_{32}$ and $R_{33}$ each represents a hydrogen atom or a substituent group. In general formulas (13 ) and (14 ), $R_{31}$ represents a substituent group, p represents an integer selected from 0 to 2, and m represents an integer selected from 0 to 4. Y has the same meaning as with general formulas (7 ) to (10 ). The substituent groups represented by $R_{31}$ to $R_{33}$ include the substituent groups for $R_{24}$ to $R_{26}$ described above.

Preferred examples of the phenol couplers represented by general formula (13 ) include 2-alkylamino-5-alkylphenol couplers described in U.S. Pat. Nos. 2,369,929, 2,801,171, 2,772,162, 2,895,826 and 3,772,002, 2,5-diacylaminophenol couplers described in U.S. Pat. Nos. 2,772,162, 3,758,308, 4,126,396, 4,334,011 and 4,327,173, West German Patent (OLS) 3,329,729 and JP-A-59-166956, and 2-phenylureido-5-acylaminophenol couplers described in U.S. Pat. Nos. 3,446,622, 4,333,999, 4,451,559 and 4,427,767.

Preferred examples of the naphthol couplers represented by general formula (14 ) include 2-carbamoyl-1-naphthol couplers described in U.S. Pat. Nos. 2,474,293, 4,052,212, 4,146,396, 4,228,233 and 4,296,200, and 2-arbamoyl-5-amido-1-naphthol couplers described in U.S. Pat. No. 4,690,889.

General formulas (15) to (18) represent couplers called pyrrolotriazole couplers, wherein $R_{42}$, $R_{43}$ and $R_{44}$ each represents a hydrogen atom or a substituent group. Y has the same meaning as with general formulas (7 ) to (10 ). The substituent groups represented by $R_{42}$, $R_{43}$ and $R_{44}$ include the substituent groups for $R_{24}$ to $R_{26}$ described above. Preferred examples of the pyrrolotriazole couplers represented by general formulas (15) to (18) include couplers in each of which at least one of $R_{42}$ and $R_{43}$ is an electron attractive group, which are described in EP-A-488,248, EP-A-491,197 and EP-A-545,300.

In addition, couplers can be used which have cyclocondensed phenol, imidazole, pyrrole, 3-hydroxypyridine, active methine, 5,5-cyclocondensed heterocycle and 5,6-cyclocondensed heterocycle structures.

As the cyclocondensed phenol couplers, couplers described in U.S. Pat. Nos. 4,327,173, 4,564,586 and 4,904,575 can be used.

As the imidazole couplers, couplers described in U.S. Pat. Nos. 4,818,672 and 5,051,347 can be used.

As the pyrrole couplers, couplers described in JP-A4-188137 and JP-A-4-190347 can be used.

As the 3-hydroxypyridine couplers, couplers described in JP-A-1-315736 can be used.

As the active methine couplers, couplers described in U.S. Pat. Nos. 5,104,783 and 5,162,196 can be used.

As the 5,5-cyclocondensed heterocyclic couplers, pyrrolo-pyrazole couplers described in U.S. Pat. No. 5,164,289 and pyrroloimidazole couplers described in JP-A-4-174429 can be used.

As the 5,6-cyclocondensed heterocyclic couplers, pyrazolo-pyrimidine couplers described in U.S. Pat. No. 4,950,585, pyrrolotriazine couplers described in JP-A-4204730, and couplers described in EP-A-556,700 can be used.

In the present invention, besides the above-mentioned couplers, couplers can also be used which are described in West German Patents 3,819,051A and 3,823,049, U.S. Pat. Nos. 4,840,883, 5,024,930, 5,051,347 and 4,481,268, EP-A-304,856, EP-A-329,036, EP-A-354,549, EP-A-374,781, EP-A-379,110 EP-A386,930, JP-A-63-141055, JP-A-64-32260, JP-A-64-32261, JP-A2-297547, JP-A-2-44340, JP-A-2-110555, JP-A-3-7938, JP-A-3160440, JP-A-3-172839, JP-A-4-172447, JP-A-4-179949, JP-A-4182645, JP-A-4-184437, JP-A-4-188138, JP-A-4-188139, JP-A-4194847, JP-A-4-204532, JP-A-4-204731and JP-A-4-204732.

Examples of the couplers which can be used in the present invention are shown below, but the present invention are not, of course, limited thereby.

Examples of 4-Equivalent Couplers

C-1

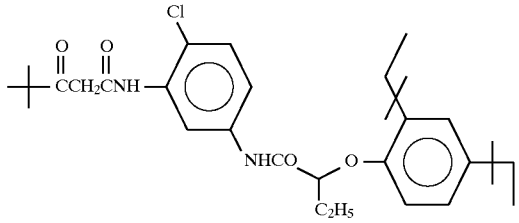

C-2

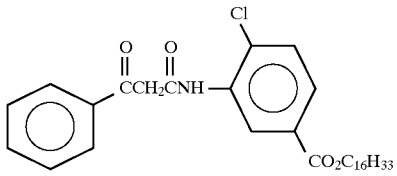

C-3

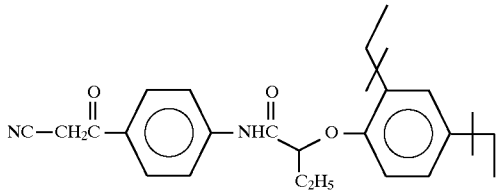

-continued
C-4
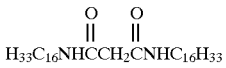
C-5
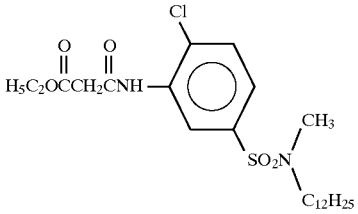
C-6
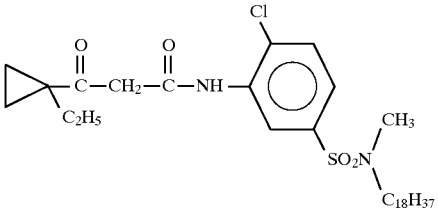
C-7
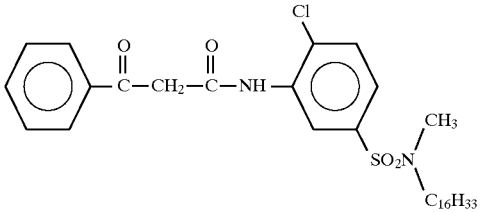
C-8
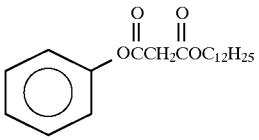
C-9
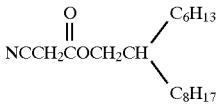
C-10
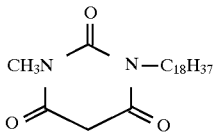
C-11
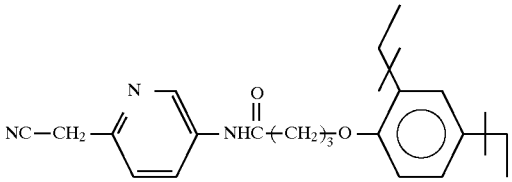
C-12
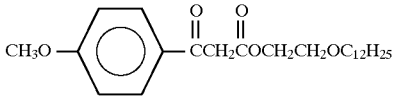
C-13
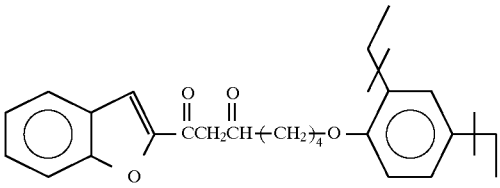

-continued
C-14
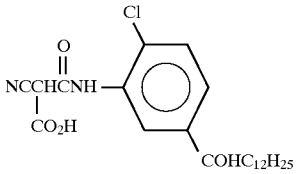
C-15
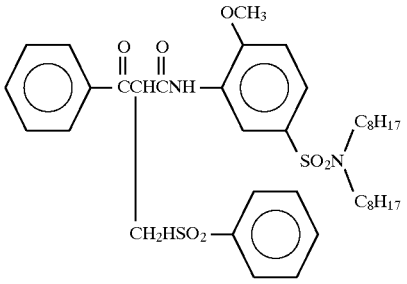
C-16
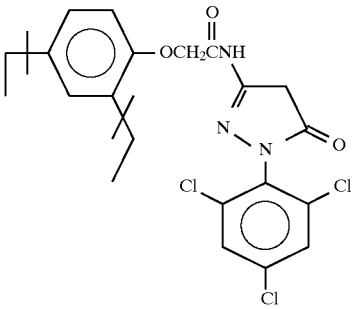
C-17
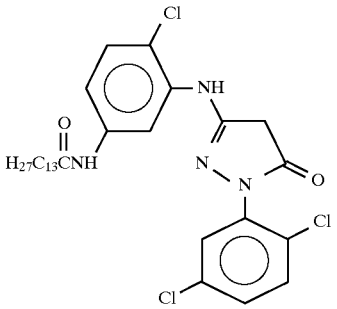
C-18
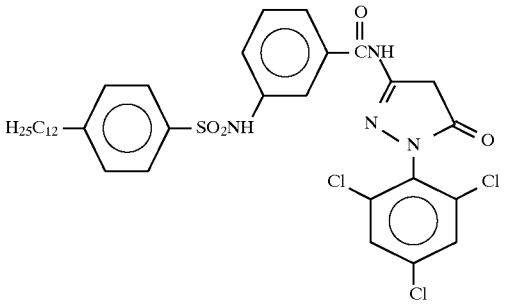

-continued
C-19
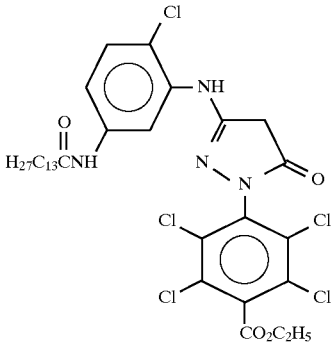
C-20
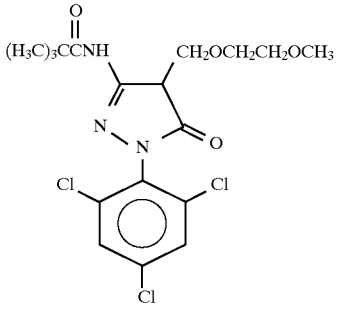
C-21
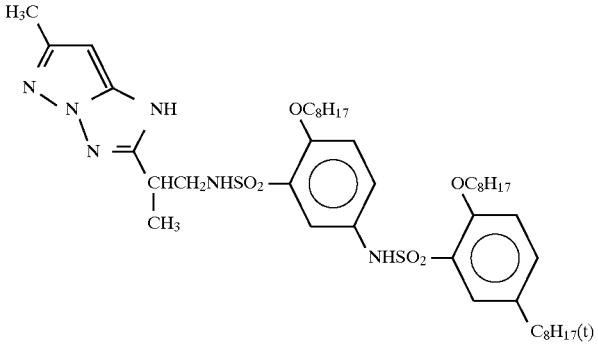
C-22
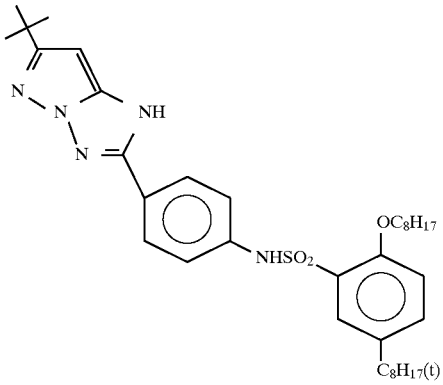

-continued
C-23
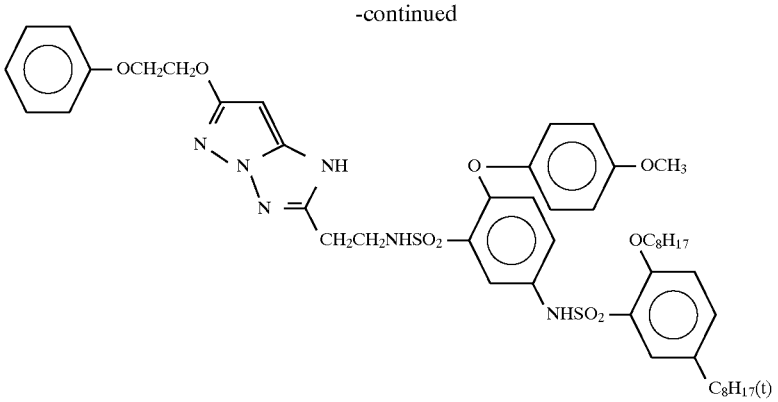
C-24
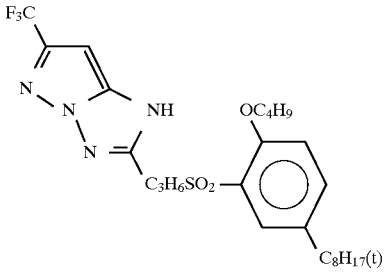
C-25
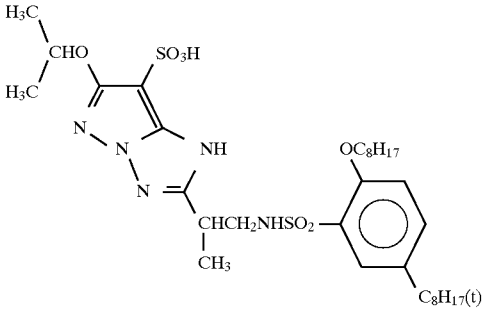
C-26
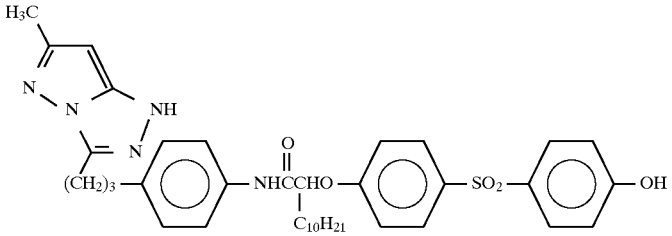
C-27
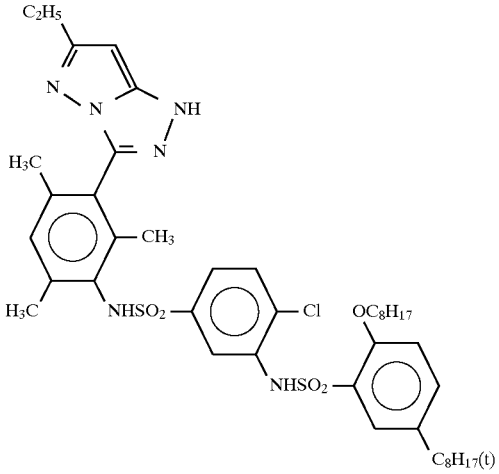

-continued
C-28
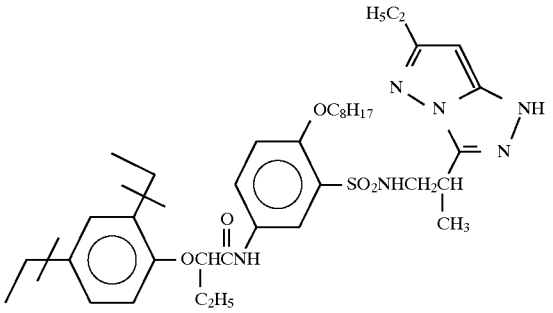
C-29
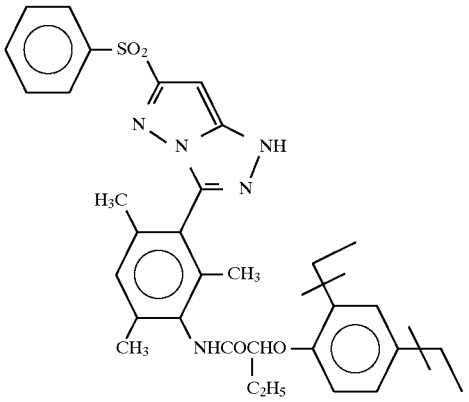
C-30
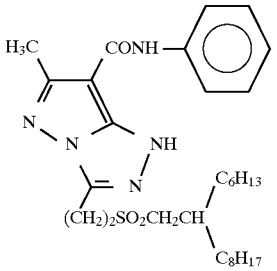
C-31
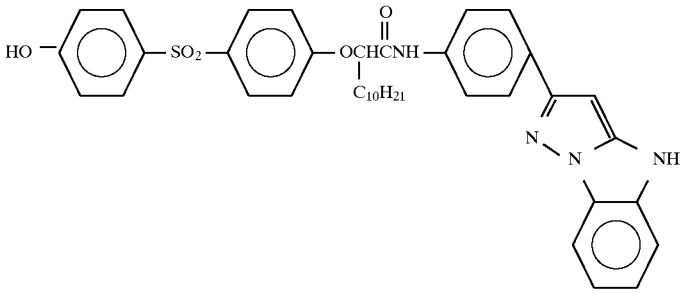
C-32
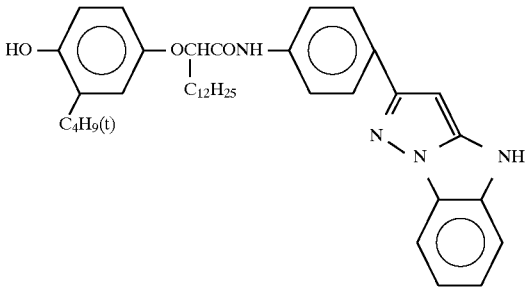

-continued
C-33
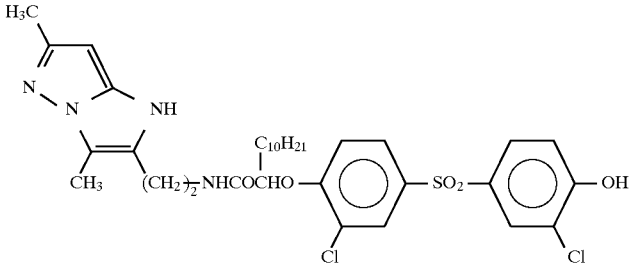
C-34
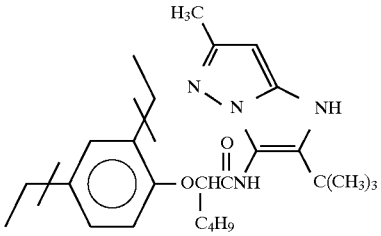
C-35
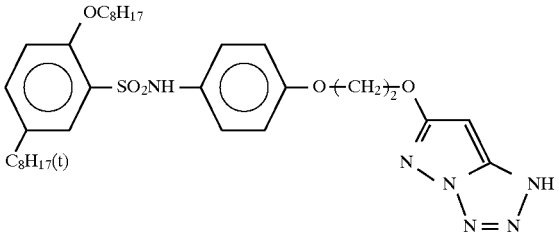
C-36
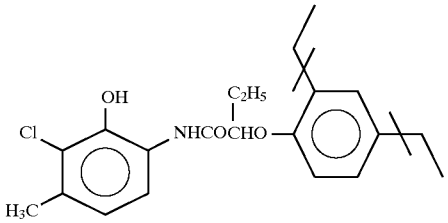
C-37
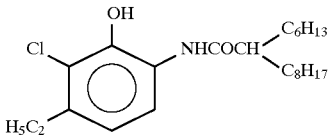
C-38
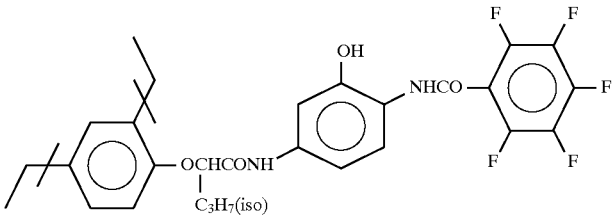
C-39
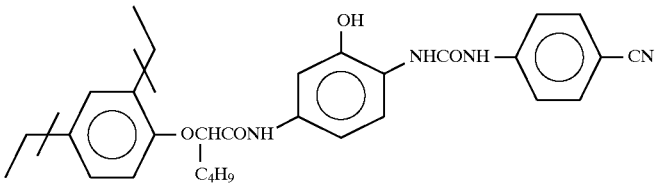

-continued
C-40
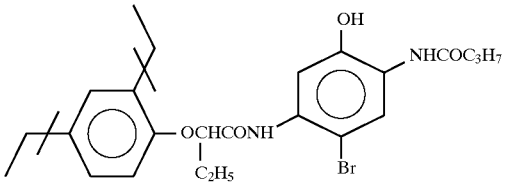
C-41
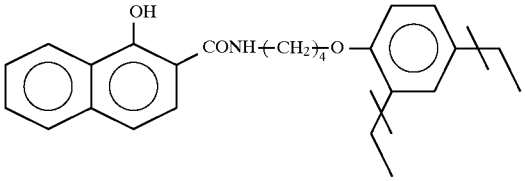
C-42
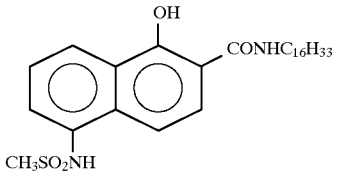
C-43
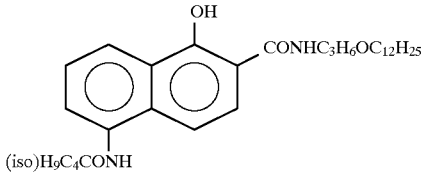
C-44
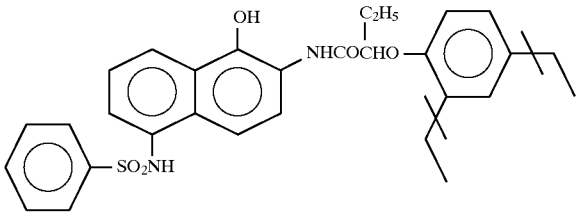
C-45
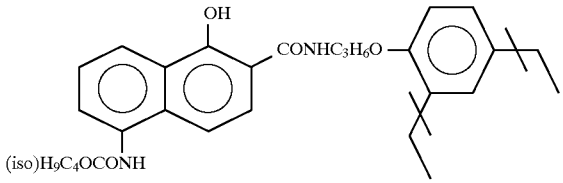
C-46
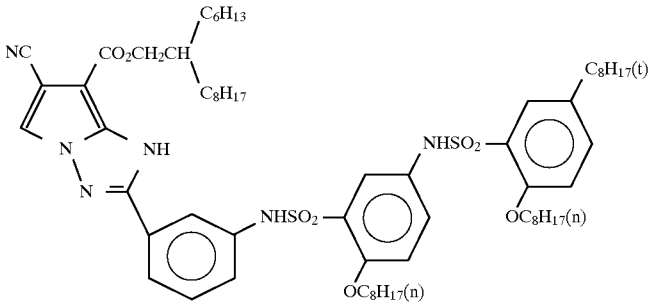

-continued
C-47
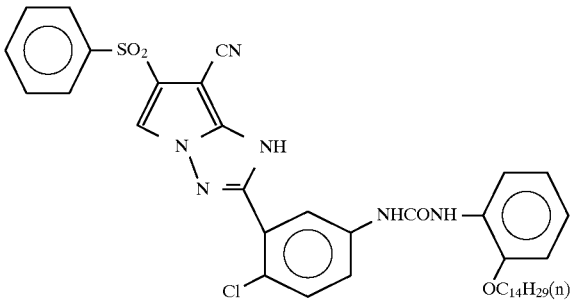
C-48
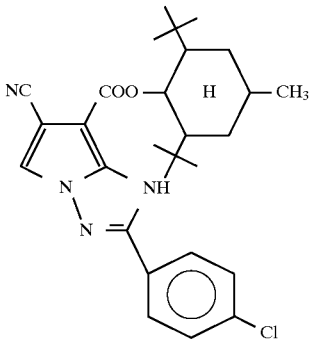
C-49
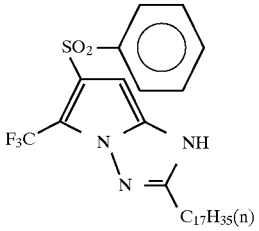
C-50
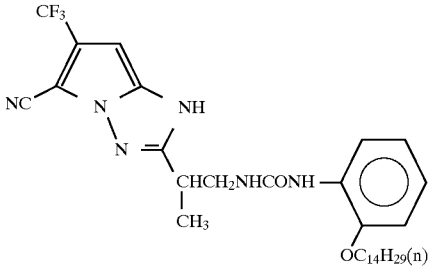
C-51
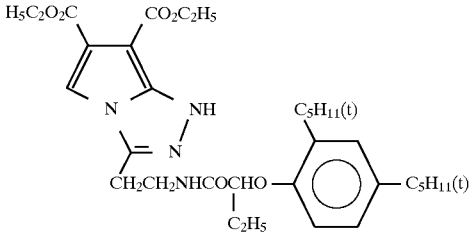

-continued
C-52
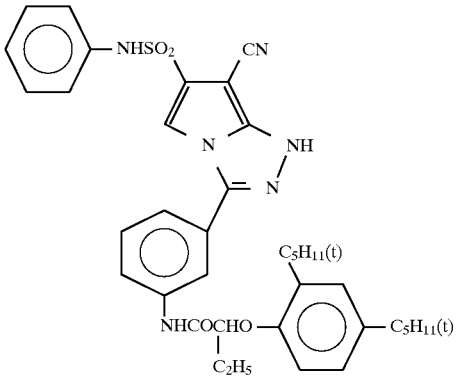
C-53
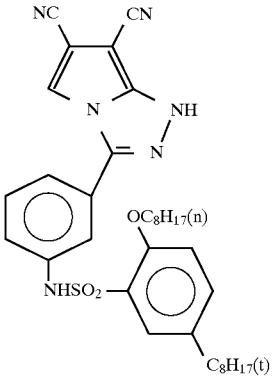
C-54
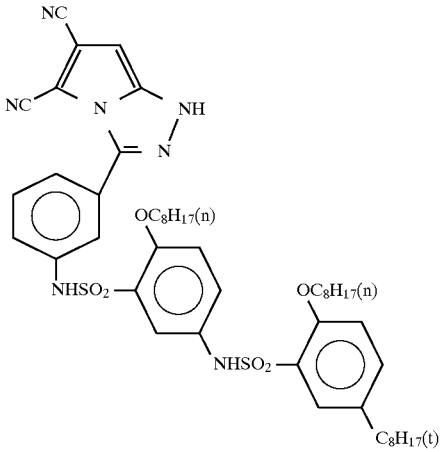
C-55
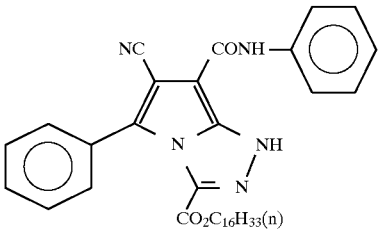
C-56
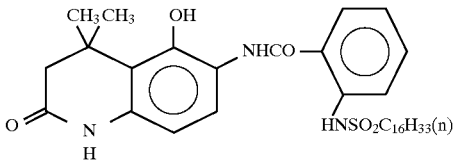

-continued
C-57
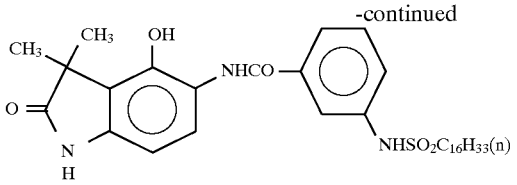
C-58
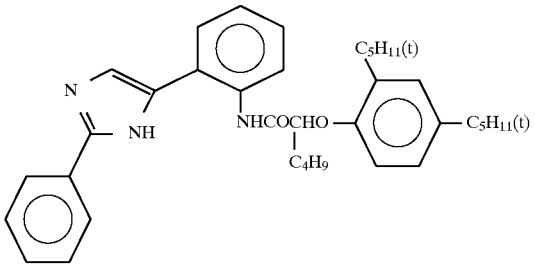
C-59
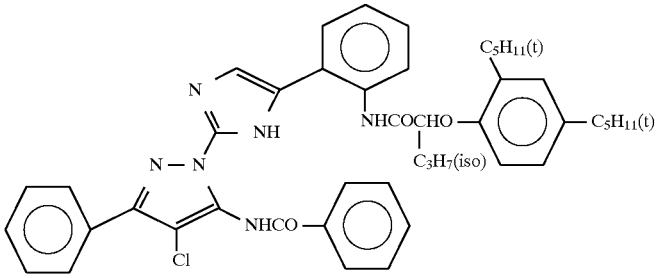
C-60
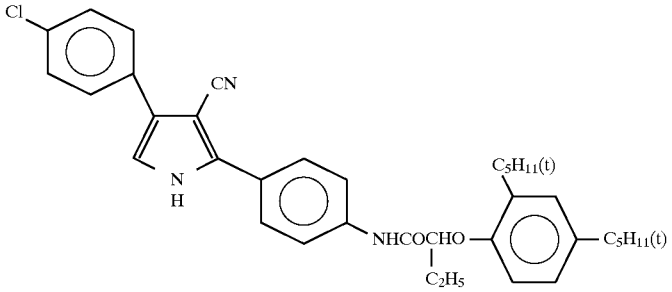
C-61
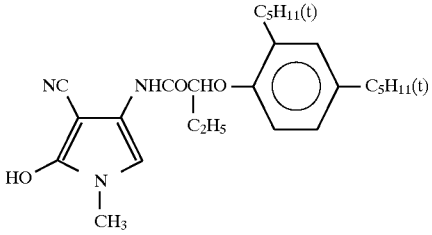
C-62
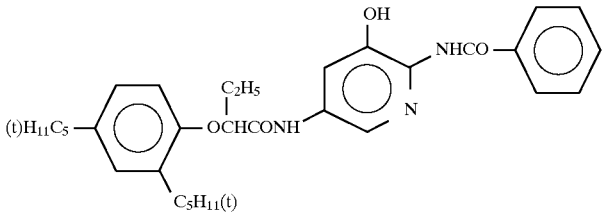
C-63
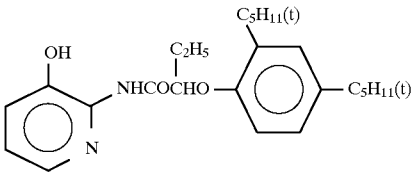

-continued
C-64
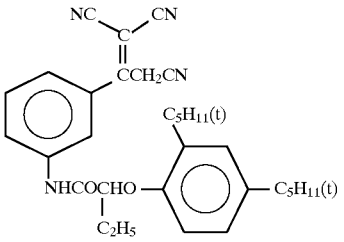
C-65
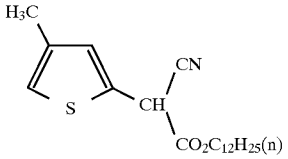
C-66
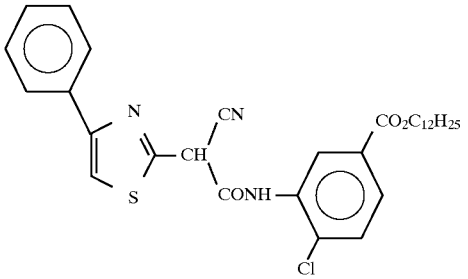
C-67
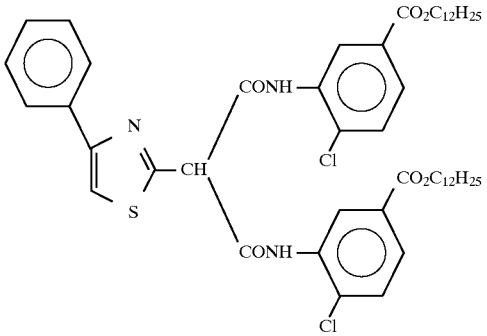
C-68
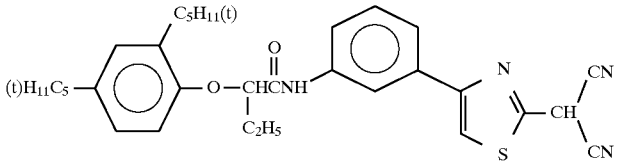
C-69
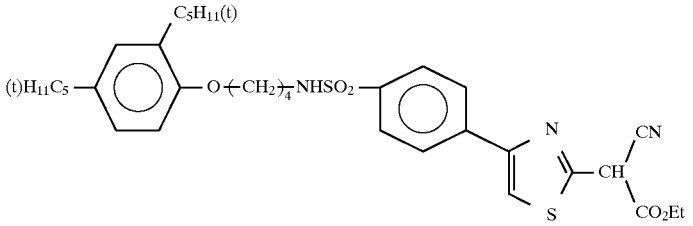

-continued
C-70
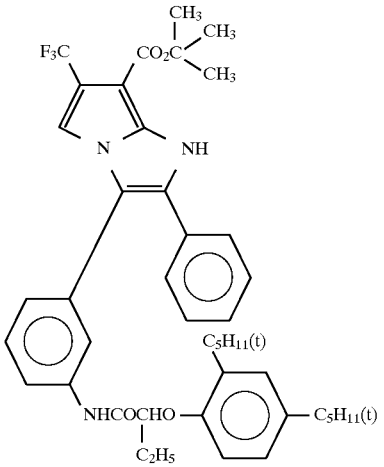
C-71
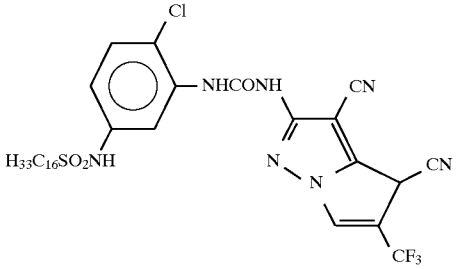
C-72
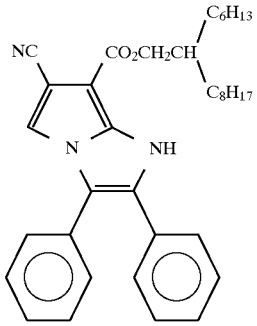
C-73
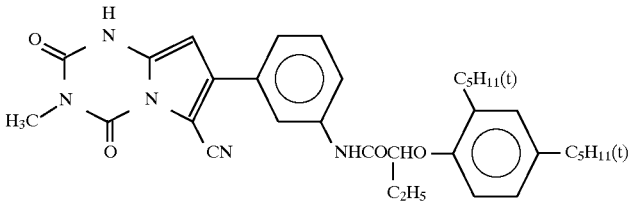
C-74
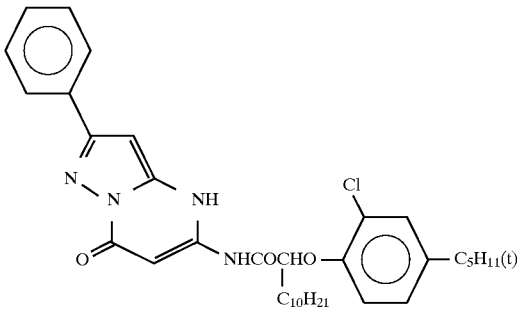

-continued
C-75
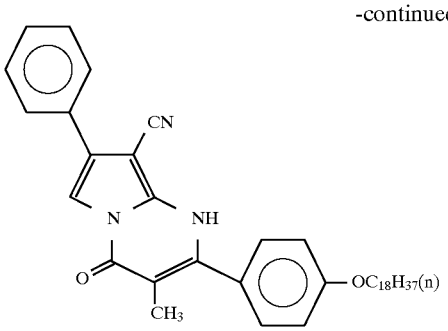
Example of 2-Equivalent Couplers
C-76
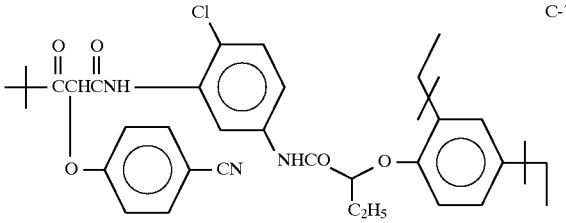
C-77
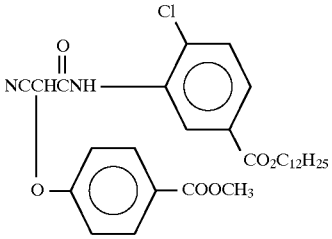
C-78
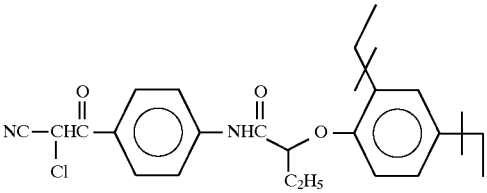
C-79
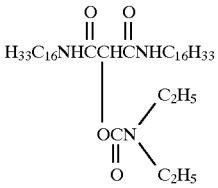
C-80
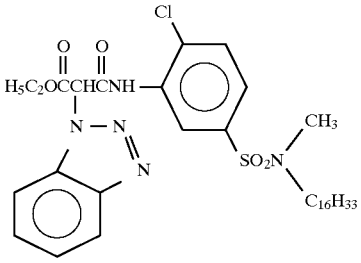
C-81
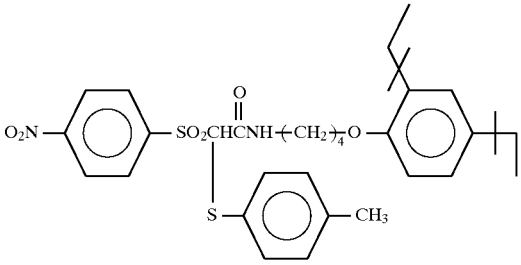
C-82
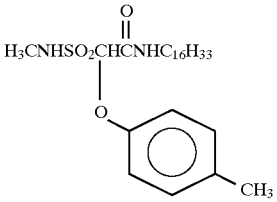
C-83
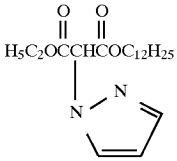
C-84
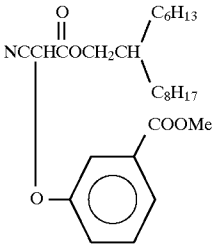
C-85
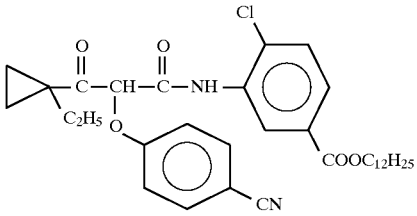

-continued
C-86
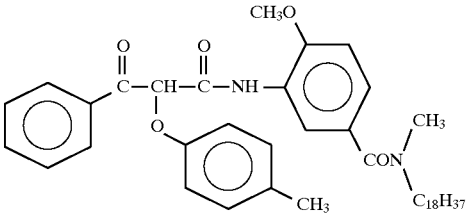
C-87
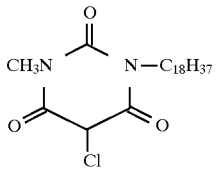
C-88
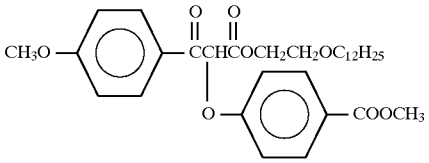
C-89
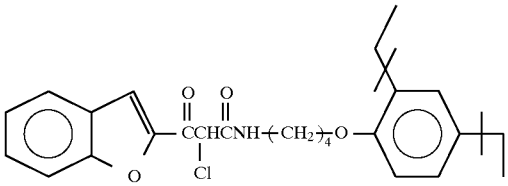
C-90
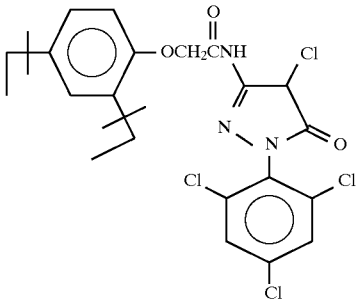
C-91
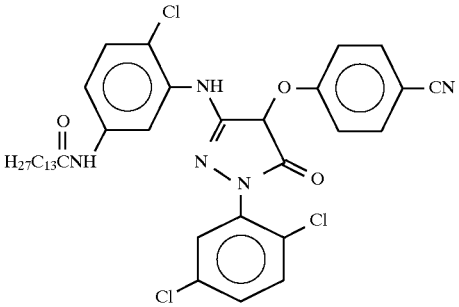
C-92
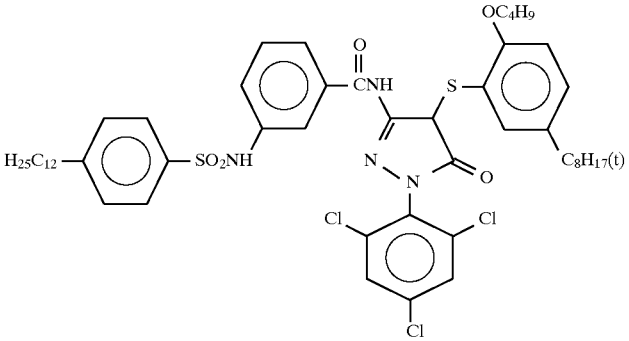
C-93
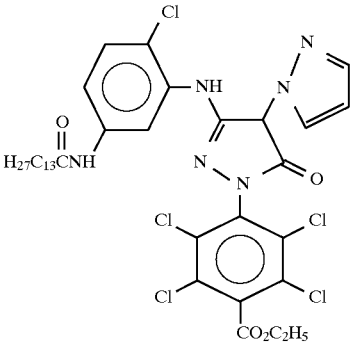
C-94
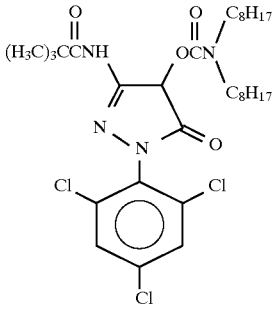

-continued
C-95
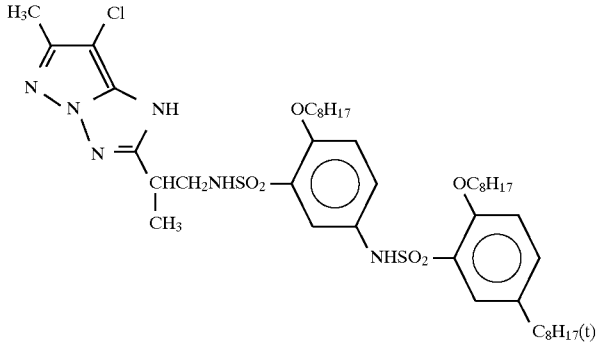
C-96
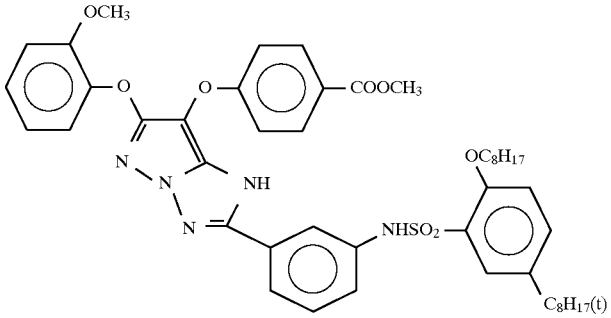
C-97
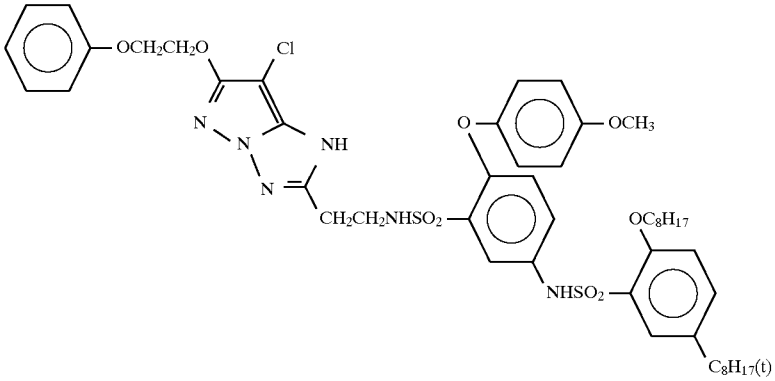
C-98
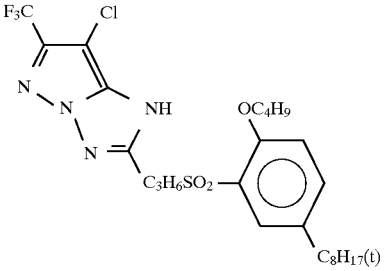
C-99
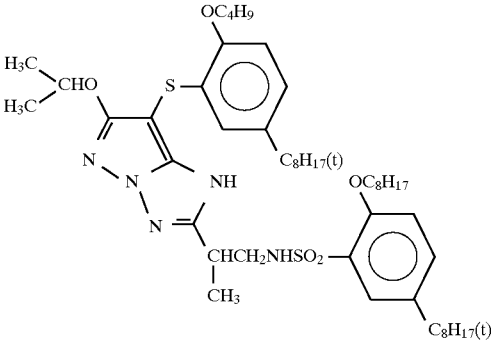
C-100
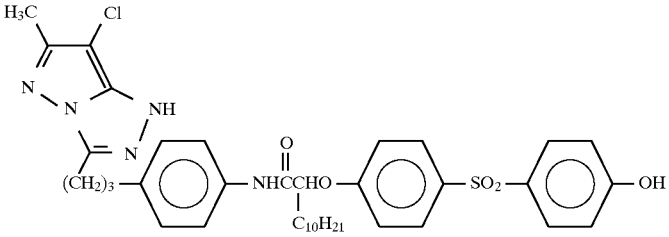

-continued
C-101
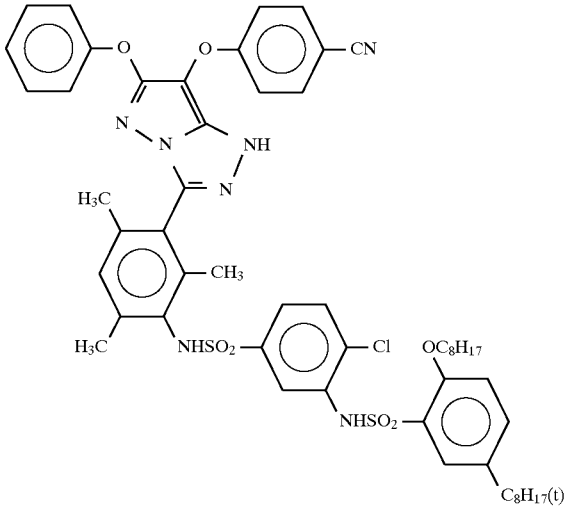
C-102
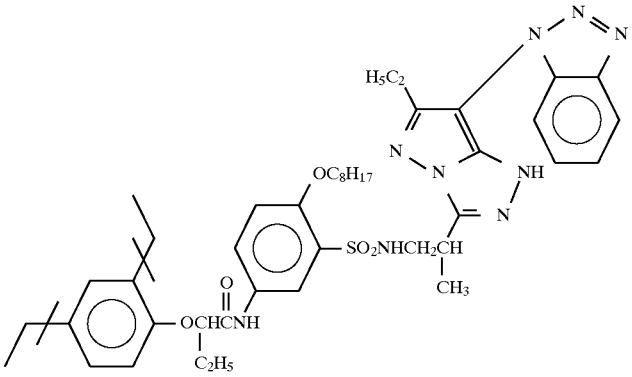
C-103
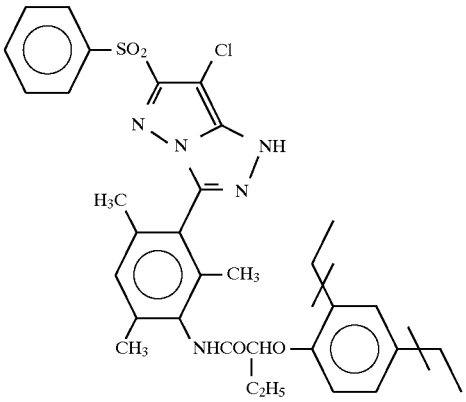
C-104
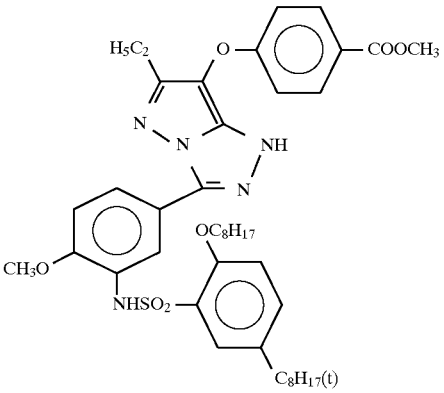
C-105
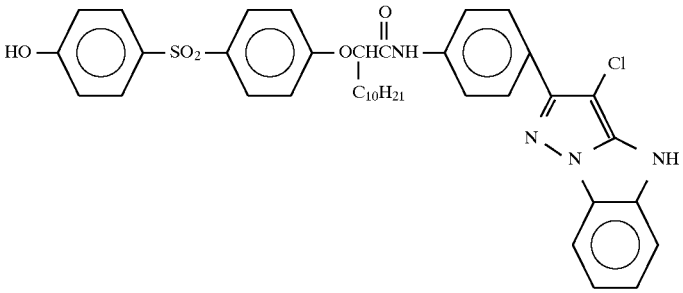

-continued
C-106
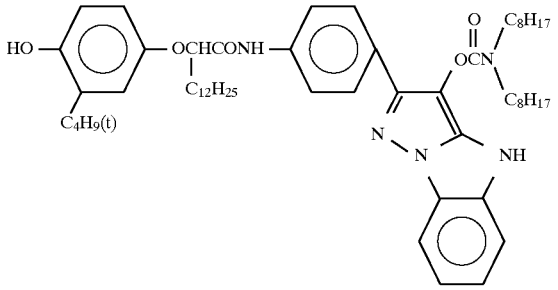
C-107
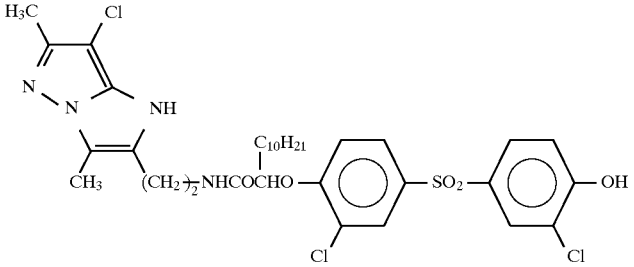
C-108
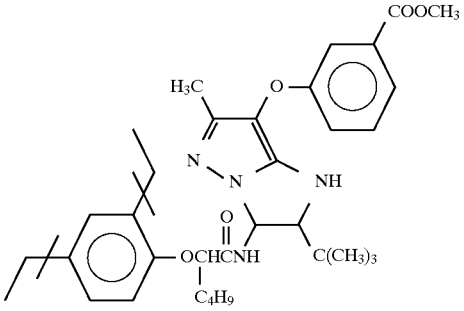
C-109
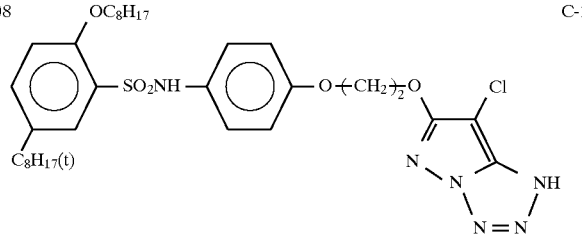
C-110
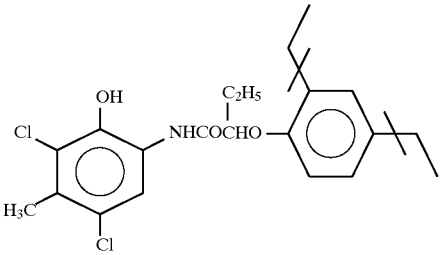
C-111
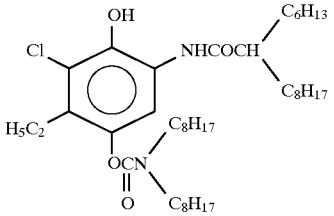
C-112
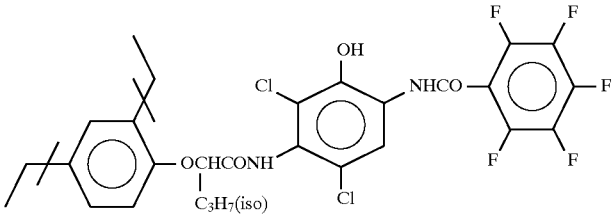
C-113
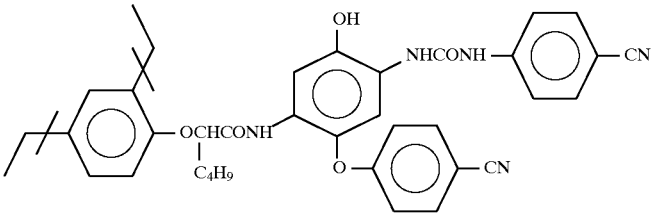

-continued
C-114
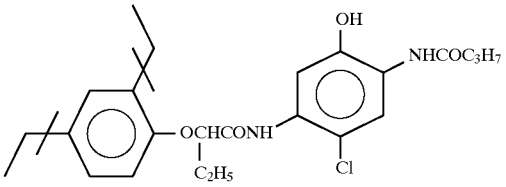
C-115
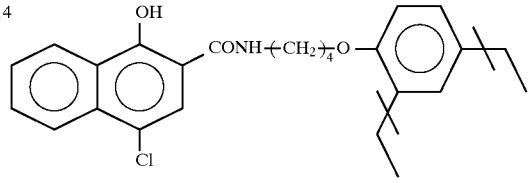
C-116
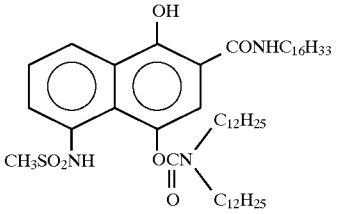
C-117
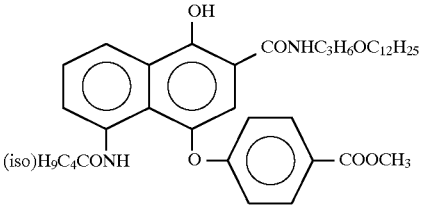
C-118
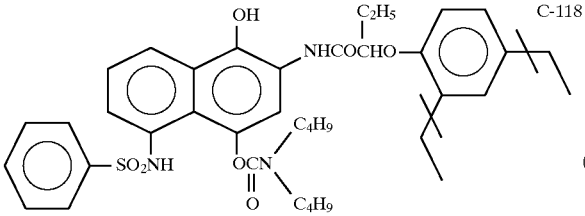
C-119
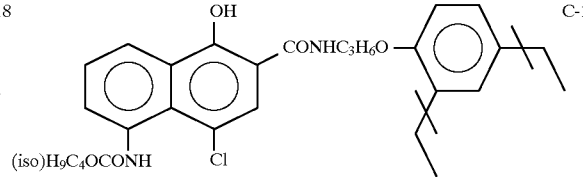
C-120
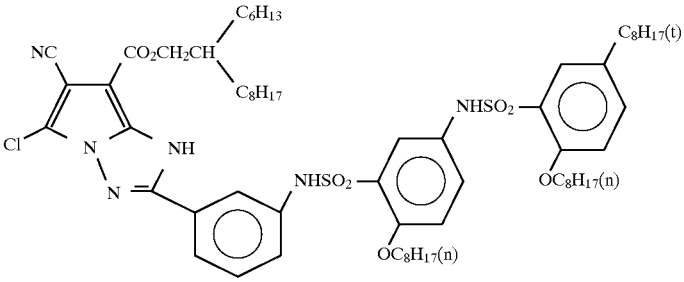
C-121
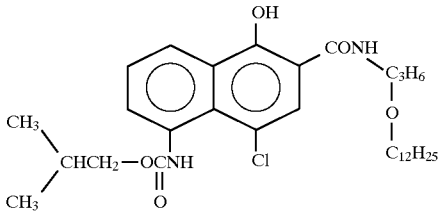
C-122
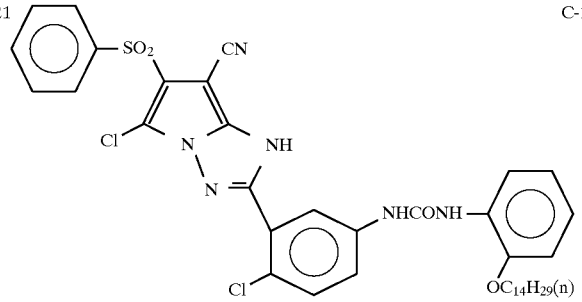

-continued
C-123
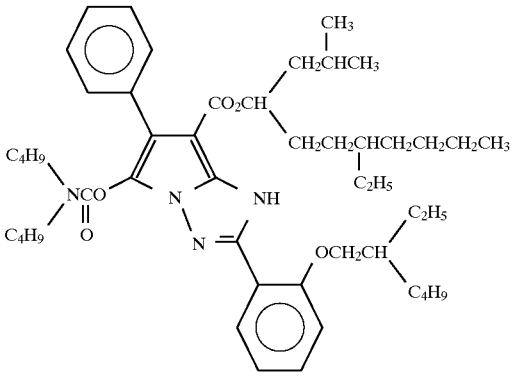
C-124
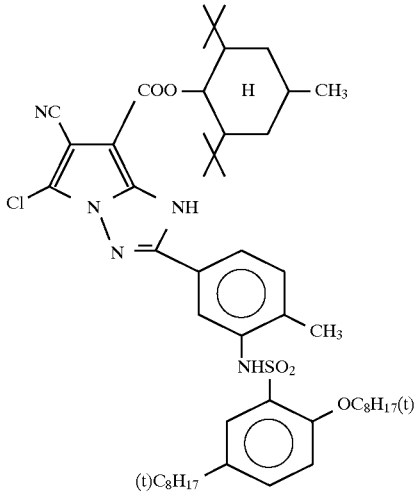
C-125
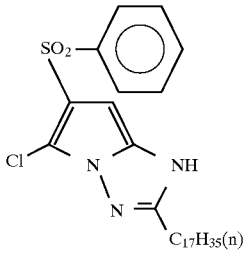
C-126
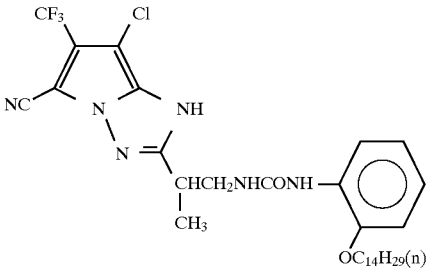
C-127
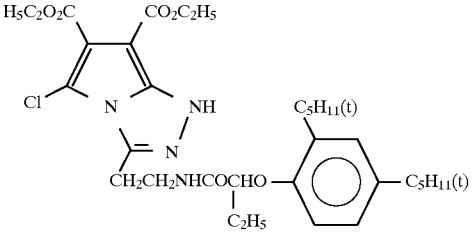
C-128
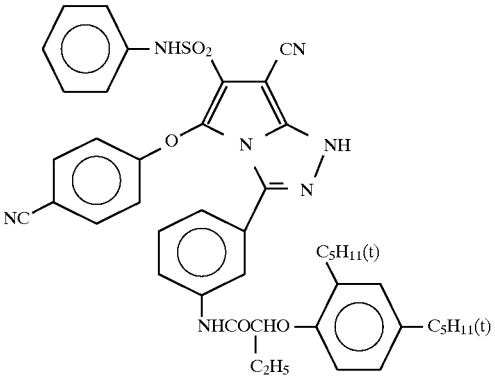
C-129
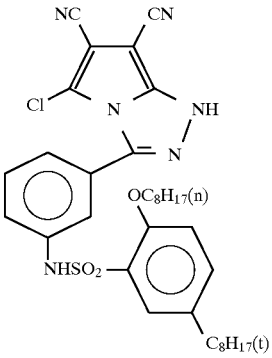
C-130
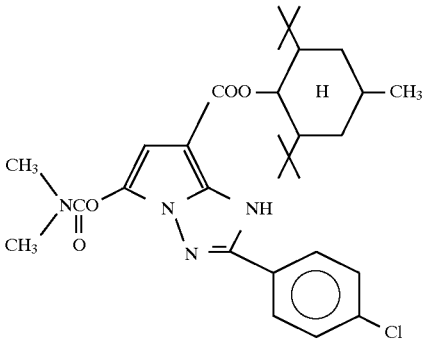

-continued
C-131
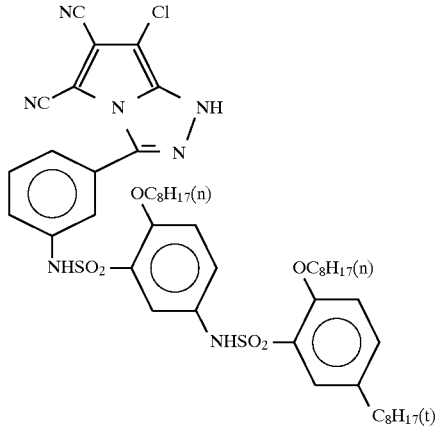
C-132
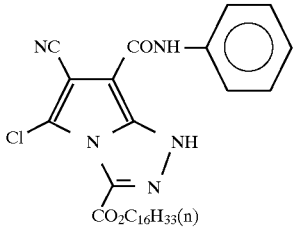
C-133
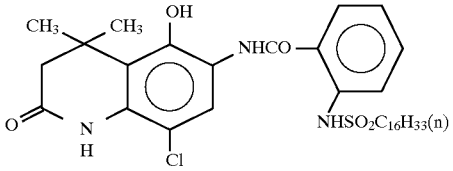
C-134
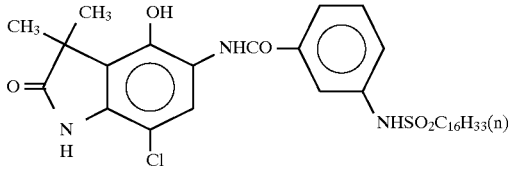
C-135
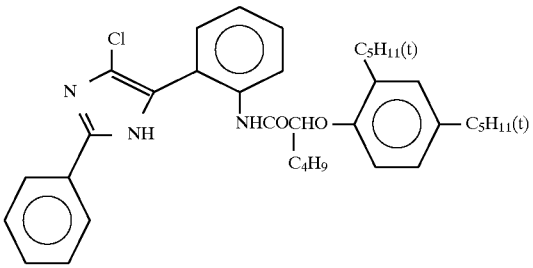
C-136
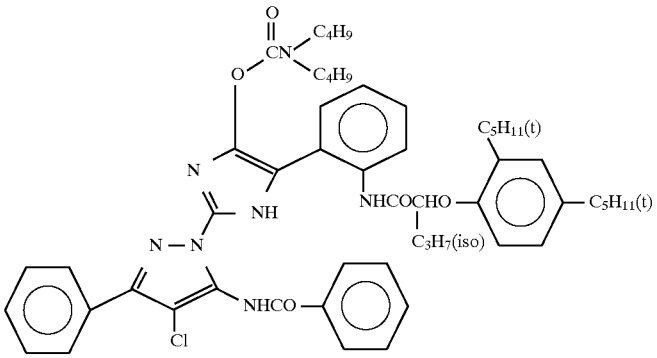
C-137
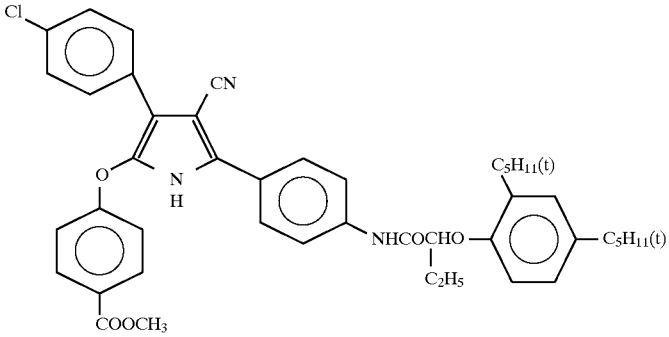

-continued
C-138
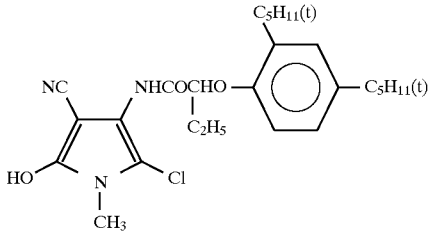
C-139
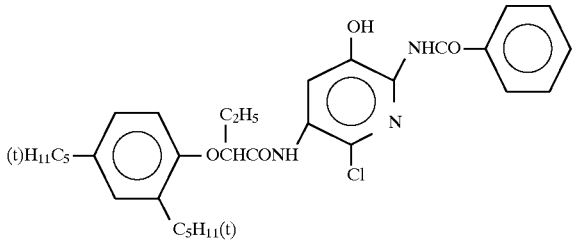
C-140
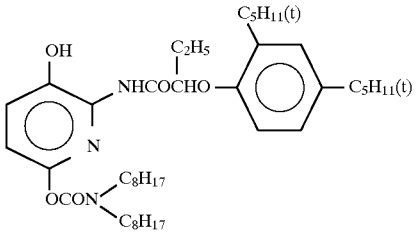
C-141
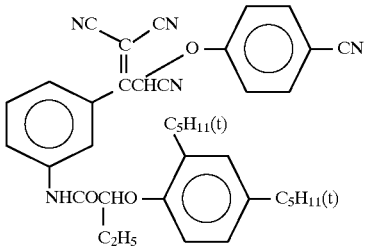
C-142
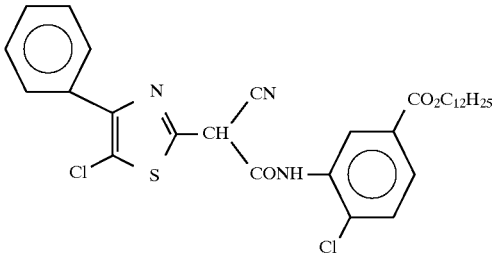
C-143
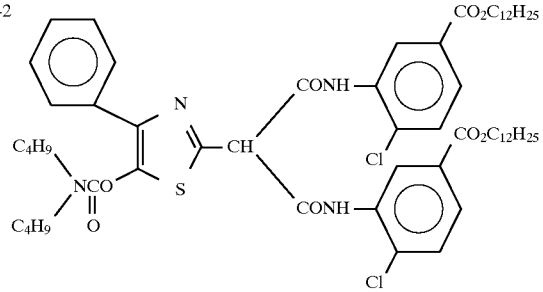
C-144
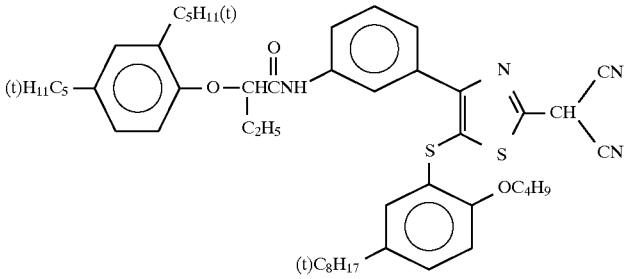
C-145
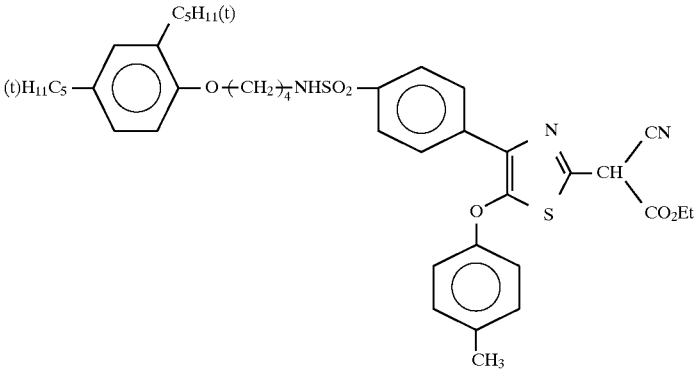

-continued
C-146
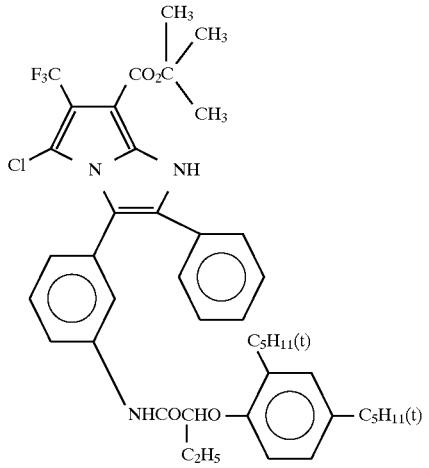
C-147
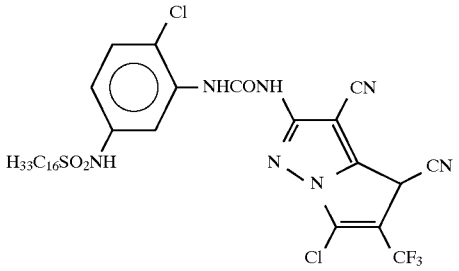
C-148
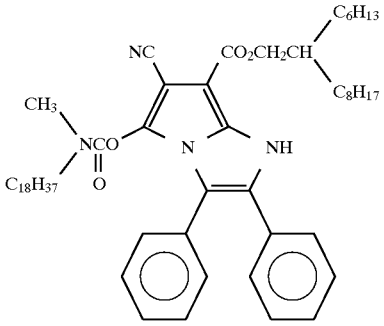
C-149
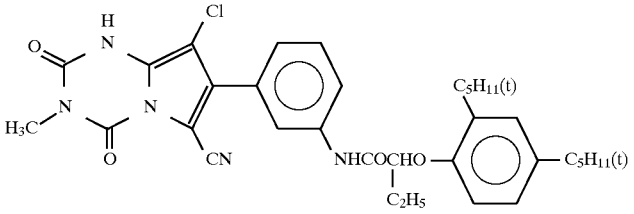
C-150
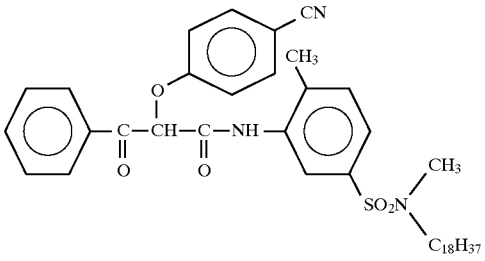
C-151
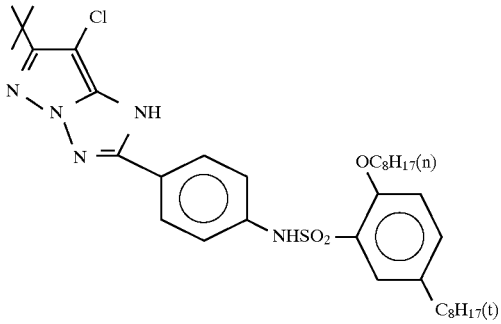

-continued
C-152
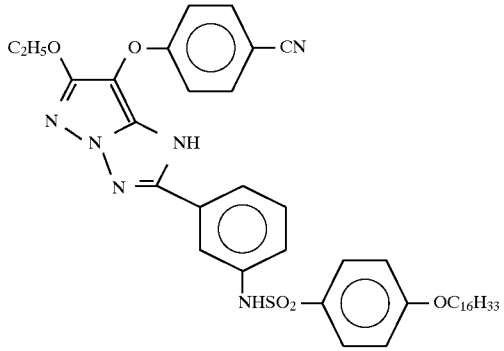
C-153
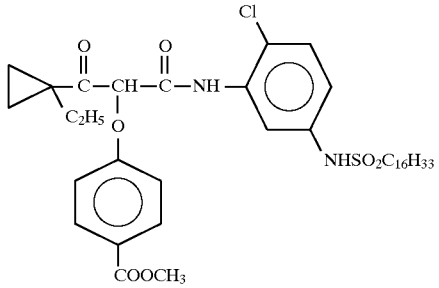
C-154
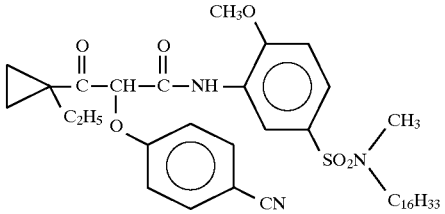
C-155
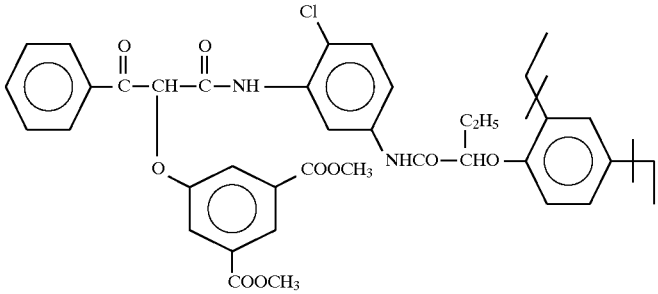
C-156
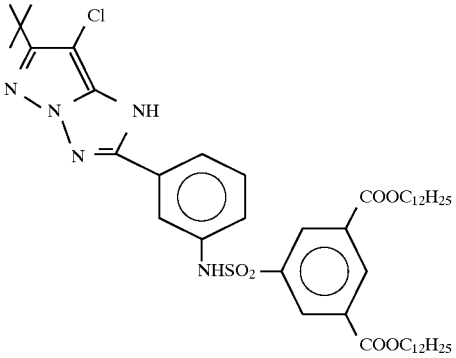
C-157
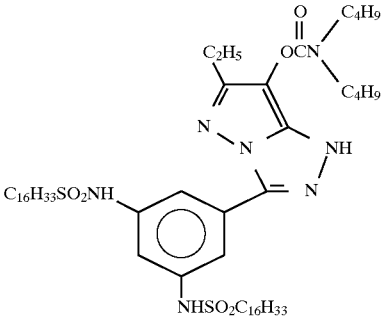
C-158
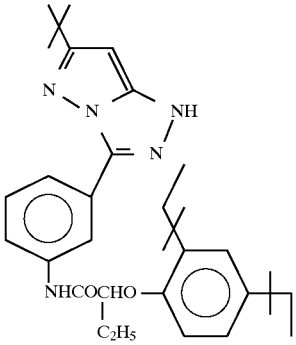
C-159
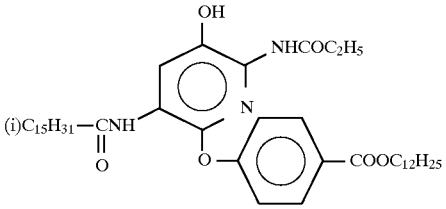

-continued
C-160
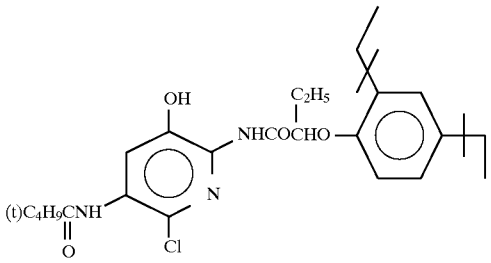
C-161
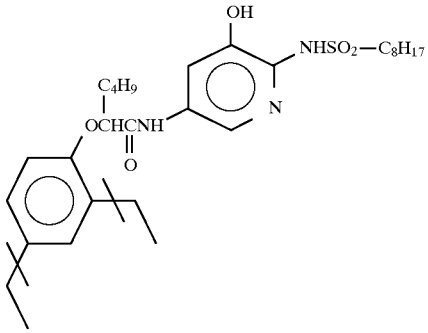
C-162
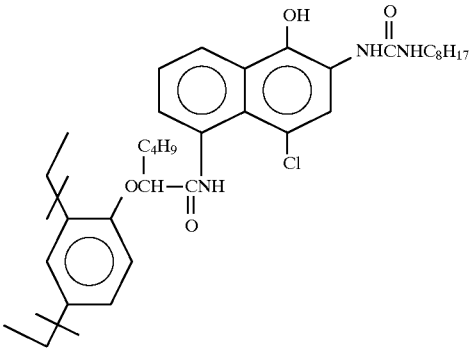
C-163
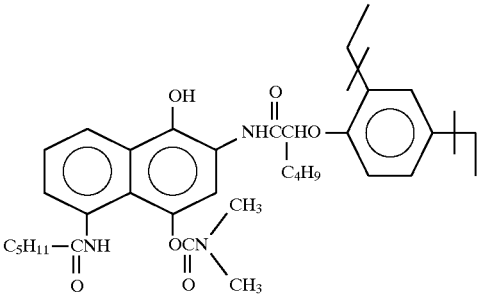
C-164
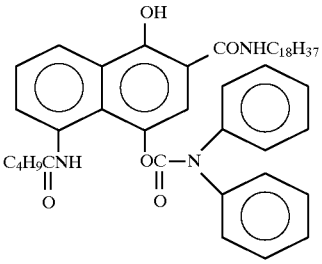
C-165
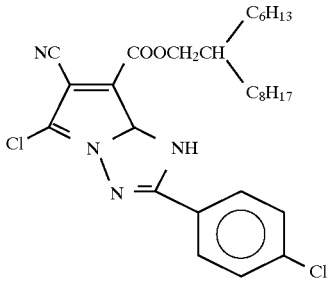
C-166
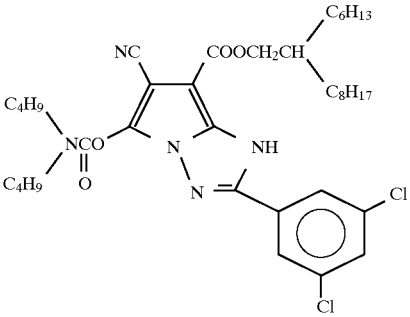
C-167
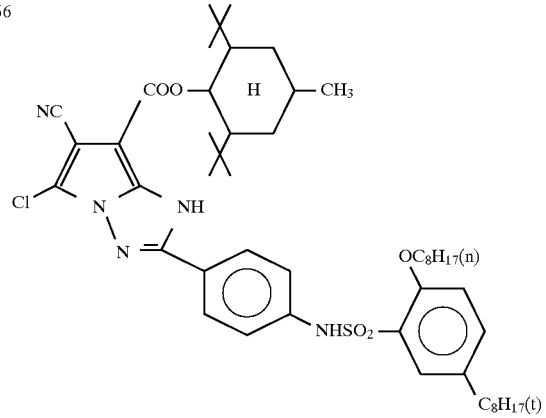

-continued

C-168

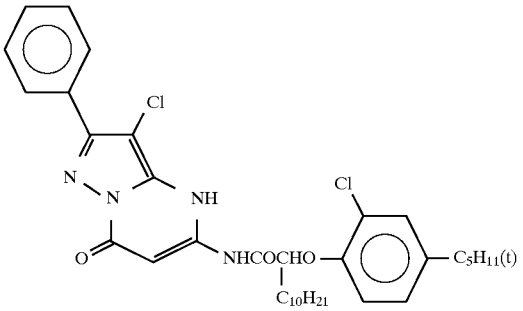

C-169

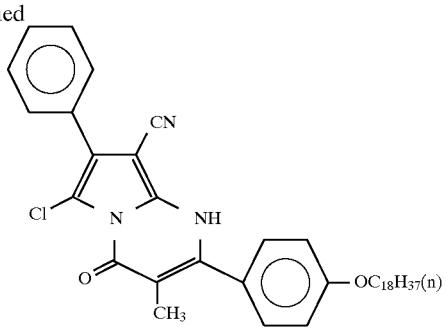

The developing agent and the coupler are first mixed with a high boiling organic solvent (for example, an alkyl phosphate ester or an alkyl phthalate ester), the resulting mixture is dissolved in a low boiling organic solvent (for example, ethyl acetate or methyl ethyl ketone), and the resulting solution is dispersed in water by the emulsion dispersing method well known in the art, followed by addition of the resulting dispersion. Further, they can also be added by the solid dispersing method described in JP-A-63-271339.

Although the amount of the coupler added depends upon the molar absorption coefficient ($\epsilon$) thereof, in order to obtain an image density of 1.0 or more as a transmission density, it is suitably about 0.001 to about 100 mmol/$m^2$, preferably about 0.01 to about 10 mmol/$m^2$, and more preferably about 0.05 to about 5 mmol/$m^2$ as the amount of the couplers applied, when the coupler produces a dye having a molar absorption coefficient ($\epsilon$) of about 5,000 to about 500,000 by coupling.

The developing agent is added in a wide range of amounts, but suitably at a molar ratio of the developing agent to the coupler of 0.01:1 to 100:1, preferably 0.1:1 to 10:1.

The light-sensitive material used in the present invention may contain at least three kinds of light-sensitive layers different from one another in spectral sensitivity and hue of color forming dyes. Each of the light-sensitive layers may be divided into a plurality of silver halide emulsion layers substantially identical in color sensitivity, but different in light sensitivity. The above-mentioned three kinds of light-sensitive layers are each preferably sensitive to either of blue light, green light and red light. They are generally disposed in the order of the red-sensitive layer, the green-sensitive layer and the blue-sensitive layer. However, another arrangement may be employed according to the purpose. For example, the arrangement described in JP-A-7-152129, column 162 may be used. In the present invention, although the silver halide, the dye donating coupler and the developing agent may be contained in the same layer, they can be separately contained in different layers as long as they are in the reactable state. For example, when the developing agent is contained in a layer different from a layer containing the silver halide, the raw stock storability of the light-sensitive materials is improved.

The relationship between the spectral sensitivity of the respective layers and hues of the couplers is arbitrary. However, the use of a cyan coupler in the red-sensitive layer, a magenta coupler in the green-sensitive layer and a yellow coupler in the blue-sensitive layer makes possible direct projection exposure to the conventional color paper.

The light-sensitive materials may be provided with various non-light-sensitive layers such as protective layers, intermediate layers, yellow filter layers and antihalation layers, between the above-mentioned silver halide emulsion layers and as the uppermost and/or lowermost layers, and can be provided with supplementary layers such as back layers on the opposite side of supports. Specifically, they can be provided with the layer constitutions as described above, under coat layers as described in U.S. Pat. No. 5,051,335, intermediate layers containing solid pigments as described in JP-A-1-167838 and JP-A-61-20943, intermediate layers having reducing agents and DIR compounds as described in JP-A-1120553, JP-A-5-34884 and JP-A-2-64634, intermediate layers having electron transmitting agents as described in U.S. Pat. No. 5,017,454 and 5,139,919 and JP-A-2-235044, protective layers having reducing agents as described in JP-A-4-249245, and combinations thereof.

Dyes which are decolored or dissolved on development not to contribute to the density after processing can be preferably used in the yellow filter layers and the antihalation layers.

Decoloration or removal of the dyes contained in the yellow filter layers and the antihalation layers on development means that the amount of the dyes remaining therein after processing is decreased to a third or less that of the dyes just before processing, and preferably a tenth or less. The components of the dyes may be eluted from the light-sensitive materials or transferred to processing materials on development, or may react to be converted to colorless compounds.

In the light-sensitive materials used in the present invention, known dyes can be used. For example, dyes soluble in alkalis of developing solutions and dyes reacting with the components contained in developing solutions, sulfite ions, developing agents or alkalis, to decolorize them can also be used.

Specific examples thereof include dyes described in EP-A-549,489 and dyes of ExF2-6 described in JP-A-7-152129. A solid-dispersed dyes as described in JP-A-6-259805 can also be used. Although this dye can also be used in development using processing solutions, it is particularly preferably used when the light-sensitive materials are heat developed by use of processing sheets described later.

Further, mordants and binders can also be mordanted with dyes. In this case, the mordants and the dyes well known in the photographic field can be used, and examples thereof include mordants described in U.S. Pat. No. 4,500,626, columns 58 and 59, JP-A-61-88256, pages 32 to 41, JP-A-62244043 and JP-A-62-244036. Further, using compounds reacting with reducing agents to release diffusible dyes and the reducing agents, movable dyes can also be released with alkalis on development to elute them in processing solutions or transferring them to processing sheets, thereby removing them. Specifically, they are described in Japanese Patent Application No. 6-259805 (corresponding to JP-A-8-

101487), paragraph Nos. 0080 and 0081, as well as U.S. Pat. No. 4,559,290 and 4,783,396, EP-A-220,746 and Kohkai Gihoh (Journal of Technical Disclosure) 87-6119.

Decolorizable leuco dyes can also be used, and specifically, silver halide light-sensitive materials are disclosed in JP-A-1-150132 which contain leuco dyes previously developed in color with color developers of metal salts of organic acids. Leuco dyes and color developer complexes react by heat or with alkali agents to decolorize them. Accordingly, when the light-sensitive materials are heat developed, combinations of these leuco dyes and color developers are preferred.

As the leuco dyes, known ones can be used which are described, for example, in Moriga and Yoshida, *Senryo to Yakuhin* (*Dyes and Agents*), 9, 84, Kaseihin Kogyo Kyokai; *Shinpan Senryo Binran* (*New Dye Handbook*), page 242, Maruzen (1970); R. Garner, *Reports on the Progress of Appl. Chem.*, 56, 199 (1971); *Senryo to Yakuhin* (*Dyes and Agents*), 19, 230, Kaseihin Kogyo Kyokai (1974); *Shikizai* (*Coloring Materials*), 62, 288 (1989); *Senshoku Kogyo* (*Dying Industry*), 32, 208.

As the color developers, metal salts of organic acids are preferably used, as well as color developers of the acid clay family and phenol-formaldehyde resins. As the metal salts of the organic acids, metal salts of salicylic acid derivatives, metal salts of phenol-salicylic acid-formaldehyde resins, rhodanides and metal salts of xanthogenic acid are useful. Zinc is particularly preferred as the metal. Of the above-mentioned color developers, oil-soluble zinc salicylate which can be used herein is described in U.S. Pat. No. 3,864,146 and 4,046,941, and JP-B-52-1327.

As the binders for the layers constituting the light-sensitive materials or the complexing agent sheets, hydrophilic binders are preferably used. Examples thereof include binders described in *Research Disclosures* stated above and JP-A-64-13546, pages 71 to 75. Specifically, transparent or translucent hydrophilic binders are preferred, and examples thereof include natural compounds such as proteins (for example, gelatin and gelatin derivatives) and polysaccharides (for example, cellulose derivatives, starch, gum arabic, dextran and pullulan), and synthetic polymers such as polyvinyl alcohol, polyvinylpyrrolidone and polyacrylamide. Further, there can also be used high water-absorptive polymers described in U.S. Pat. No. 4,960,681 and JP-A-62-245260, namely homopolymers of vinyl monomers having —COOM or —$SO_3$M (wherein M represents a hydrogen atom or an alkali metal), or copolymers of these vinyl monomers with each other or with other monomers (for example, sodium methacrylate, ammonium methacrylate and Sumikagel L-5H manufactured by Sumitomo Chemical Co, Ltd.). These binders can be used in combination. In particular, combinations of gelatin and the above-mentioned binders are preferred. Gelatin is selected from lime-treated gelatin, acid-treated gelatin and so-called delimed gelatin reduced in content of calcium, etc., depending on various purposes, and they are also preferably used in combination.

The hardeners used in the layers constituting the light-sensitive materials or the complexing agent sheets include hardeners described in Research Disclosures stated above, U.S. Pat. No. 4,678,739, column 41, and 4,791,042, JP-A-59-116655, JP-A-62-245261, JP-A-61-18942 and JP-A-4-218044. More specifically, examples thereof include aldehyde hardeners (such as formaldehyde), aziridine hardeners, epoxy hardeners, vinyl sulfone hardeners (such as N,N'-ethylene-bis(vinylsulfonyl-acetamido)ethane), N-methylol hardeners (dimethylolurea) and polymer hardeners (compounds described in JP-A-62-234157).

These hardeners are used in an amount of 0.001 to 1 g, preferably 0.005 to 0.5 g, per g of gelatin coated. They may be added to any of the layers constituting the light-sensitive materials or dye fixing materials, and may be divided to add them to at least two layers.

In the layers constituting the light-sensitive materials or the complexing agent sheets, various antifoggants or photographic stabilizers and precursors thereof can be used. Examples thereof include compounds described in *Research Disclosures* stated above, U.S. Pat. No. 5,089,378, 4,500,627 and 4,614,702, JP-A-64-13546, pages 7–9, 57–71 and 81–97, U.S. Pat. No. 4,775,610, 4,626,500 and 4,983,494, JP-A-62-174747, JP-A-62-239148, JP-A-63-264747, JP-A-1-150135, JP-A-2-110557, JP-A-2-178650 and RD, 17648 (1978), pages 24 and 25.

These compounds are preferably used in an amount of $5\times10^{-6}$ to $1\times10^{-1}$ mol, more preferably $1\times10^{-5}$ to $1\times10^{-2}$ mol, per mol of silver.

In the layers constituting the light-sensitive materials or the complexing agent sheets, various surfactants can be used for the purposes of assisting coating, improving separation, improving sliding property, preventing electric charge, and accelerating development. Examples of the surfactants are described in *Research Disclosures* stated above, JP-A-62-173463 and JP-A-62-183457.

The layers constituting the light-sensitive materials or the complexing agent sheets may contain organic fluoro compounds for the purposes of improving sliding property, preventing electric charge and improving separation. Typical examples of the organic fluoro compounds include fluorine surfactants described in JP-B-57-9053, columns 8 to 17, JP-A61-20944 and JP-A-62-135826, and hydrophobic fluorine compounds such as oily fluorine compounds (for example, fluorine oil) and solid fluorine compounds (for example, ethylene tetrafluoride resins).

The light-sensitive materials or the complexing agent sheets can contain matte agents for the purposes of preventing adhesion, improving sliding property and delustering surfaces of the materials or the sheets. The matte agents include compounds such as benzoguanamine resin beads, polycarbonate resin beads and AS resin beads described in JP-A-63-274944 and JP-A-63-274952, as well as compounds such as silicon dioxide, polyolefins and polymethacrylates described in JP-A-61-88256, page 29. In addition, compounds described in *Research Disclosures* stated above can be used. These matte agents can be added not only to the uppermost layers (protective layers), but also to lower layers as needed.

Besides, the layers constituting the light-sensitive materials or the complexing agent sheets may contain heat solvents, defoaming agents, microbicidal antifungal agents and colloidal silica. Examples of these additives are described in JP-A-61-88256, pages 26 to 32, JP-A-3-11338 and JP-B-2-51496.

In the present invention, image formation accelerating agents can be used in the light-sensitive materials or the complexing agent sheets. The image formation accelerating agents have the functions of accelerating the oxidation-reduction reaction of silver salt oxidizing agents with reducing agents, and accelerating the dye formation reaction, and can be classified into bases or base precursors, nucleophilic compounds, high boiling organic solvents (oils), heat solvents, surfactants, Compounds having interaction with silver or silver ions, etc. according to the physicochemical functions. However, a group of these substances generally has combined functions, and therefore, it has usually a combinations of some of the above-mentioned accelerating effects. The details thereof are described in U.S. Pat. No. 4,678,739, columns 38 to 40.

In the present invention, various development stoppers can be used in the light-sensitive materials or the complexing agent sheets for the purpose of obtaining always constant images against fluctuations in processing temperature and processing time on development.

The development stopper as used herein is a compound which, after normal development, rapidly neutralizes or reacts with a base to reduce the concentration of the base contained in a film, thereby stopping development, or a compound which interacts with silver and a silver salt to inhibit development. Examples thereof include acid precursors releasing acids by heating, electrophilic compounds which conduct replacement reaction with coexisting bases by heating, nitrogen-containing heterocyclic compounds, mercapto compounds and precursors thereof. More specifically, they are described in JP-A-62-253159, pages 31 and 32.

Methods for exposing the light-sensitive materials to record images include, for example, methods of exposing the light-sensitive materials through reversal films or negative films by use of printers or enlargers, methods of subjecting original pictures to scanning exposure through slits by use of exposing devices of copying machines, methods of allowing light emitting diodes or various lasers (such as laser diodes and gas lasers) to emit light by image information through electric signals to subject the light-sensitive materials to scanning exposure (methods described in JP-A-2-129625, JP-A5-176144, JP-A-5-199372 and JP-A-6-127021), and methods of supplying image information to image displays such as CRTs and liquid crystal displays, to expose the photographic materials directly or through optical systems, as well as methods of directly taking landscape photographs or human subject photographs by use of cameras.

As described above, light sources and exposing methods such as natural light, tungsten lamps, light emitting diodes, laser sources and CRT light sources described in U.S. Pat. No. 4,500,626, column 56, JP-A-2-53378 and JP-A-2-54672 can be used to record images on the light-sensitive materials.

Further, images can also be exposed using wavelength conversion elements in which non-linear optical materials and coherent light sources such as laser beams. Here, the non-linear optical material is a material which can express non-linearity between an electrical field and polarization appearing when a strong optical electrical field such as a laser beam is given. Examples of such materials preferably used include inorganic compounds represented by lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A61-53462 and JP-A-62-210432. As the forms of the wavelength conversion elements, the single crystal light guide type and the fiber type are known, and both are useful.

Further, as the above-mentioned image information, ther can be utilized image signals obtained from video cameras, electronic still cameras, etc., television signals represented by the Nippon Television Signal Criteria (NTSC), image signals obtained by dividing original pictures into many picture elements with scanners and image signals produced by use of computers represented by CGs and CADs.

In the present invention, heating is carried out in the presence of a trace (small) amount of water to conduct development. In this system, the heating temperature is preferably from 50° C. to the boiling point of water.

The water for use in the present invention may be (i) basic aqueous solutions containing inorganic alkali metal salts or organic bases, (ii) low boiling solvents, or (iii) mixed solutions of low boiling solvents and water or the above-mentioned basic aqueous solutions, besides water generally used. Further, the solvents may contain surfactants, antifoggants, complex forming compounds with slightly soluble metal salts, antifungal agents or microbiocides.

As the water used in heat development, any water may be used as long as it is generally used. Specifically, distilled water, tap water, well water, mineral water can be used. In heat development equipment in which the light-sensitive materials and the complexing agent sheets are processed, water may be used in the disposable form, or repeatedly circulated. Further, equipment and water described in JP-A-63-144354, JP-A-63-144355, JP-A-62-38460 and JP-A-3-210555 may be used.

In the present invention, the amount of water given to the light-sensitive materials or the complexing agent sheets may be the weight of water corresponding to the maximum swelled volume of the whole coated films of the light-sensitive materials or the complexing agent sheets, or less.

Examples of methods for giving water include methods described in JP-A-62-253159, page 5, and JP-A-63-85544. Further, solvents enclosed in microcapsules or hydrated can be previously contained in the light-sensitive materials or dye fixing elements or both.

The water for use in heat development may be used in an amount of 0.1 to 100 $cc/m^2$, preferably 1 to 50 $cc/m^2$.

Water may be given by the following method.

That is, the light-sensitive material is coated with water by spraying with a water coating device comprising a tank for reserving a solvent which is disposed opposite to a conveying path of the light-sensitive material subjected to image exposure, a nozzle mounted on said tank as a part of a wall of said tank opposite to the conveying path of the light-sensitive material, and having a plurality of nozzle holes for spraying the solvent (water) which are linearly arranged at definite intervals along a direction to intersect a conveying direction of the light-sensitive material, and an actuator for displacing said nozzle toward the light-sensitive material on the conveying path.

The function of this water coating device is illustrated below.

The plurality of nozzle holes for spraying water reserved in the tank are arranged on the nozzle mounted on the tank, and the actuator displaces the nozzle toward the light-sensitive material on the conveying path. Accordingly, with this displacement of the nozzle, water is ejected through each of the plurality of nozzle holes to adhere to the light-sensitive material. In this case, the plurality of nozzle holes for spraying water are linearly arranged at definite intervals along the direction to intersect the conveying direction of the light-sensitive material, so that one displacement with the actuator makes it possible to widely adhere water to the light-sensitive material conveyed.

From the above, the particle size of sprayed water is determined by the dimension of the nozzle holes. Further, no mixing of gas and liquid results in no variation in the particle size, and the linear arrangement of the nozzle holes at definite intervals causes no variation in adhering positions. Hence, the uniformity of water on a coated surface is not deteriorated by the variations.

Further, the plurality of nozzle holes are linearly arranged at definite intervals along the direction to intersect the conveying direction of the light-sensitive material, so that it becomes unnecessary to scan the nozzle on a two-dimensional plane, making it possible to coating a large area for a short period of time.

Furthermore, the nozzle having the nozzle holes is not brought into contact with the light-sensitive material, resulting in no clogging and no contamination, improvement in durability, and lower precision prescribed of alignment.

On the other hand, the nozzle requires only the formation of the plurality of nozzle holes, so that the integration technique becomes unnecessary. It becomes therefore possible to produce the coating device at low cost.

When a plurality of lines of the nozzle holes linearly arranged at definite intervals along the direction to intersect the conveying direction of the light-sensitive material are disposed in the zigzag form on the nozzle, a larger number of liquid droplets are adhered to the light-sensitive material at a fewer displacement cycles, and the closest packing or multiple coating is possible, resulting in the increased amount coated and improved uniformity.

The above-mentioned solvent (water) coating device 310 are illustrated below with reference to the drawings. FIG. 1 is a schematic general view showing the water coating device. As shown in FIG. 1, a spray tank 312 is arranged in a position opposite to a conveying path A of a light-sensitive material 16 in a water coating section 62. A pair of conveying rollers 66 are arranged upstream from the spray tank 312 in a conveying direction of the light-sensitive material 16, and two pairs of conveying rollers 68 and 69 are arranged downstream from the spray tank 312 in the conveying direction of the light-sensitive material 16.

Further, a pool tank 314 filled with water, a solvent for image formation, is arranged above the spray tank 312, and a pipe 316 in which the spray tank 312 intervenes is connected to a bottom of the pool tank 314 in the loop form.

The pipe 316 is provided with an upper valve 318 and a lower valve 320 over and under the spray tank 312, respectively, and a flow path in the pipe 316 can be opened and closed with the pair of valves 318 and 320. Water fed from the pool tank 314 through the pipe 316 by gravity is reserved in the spray tank 312.

Figure 2:
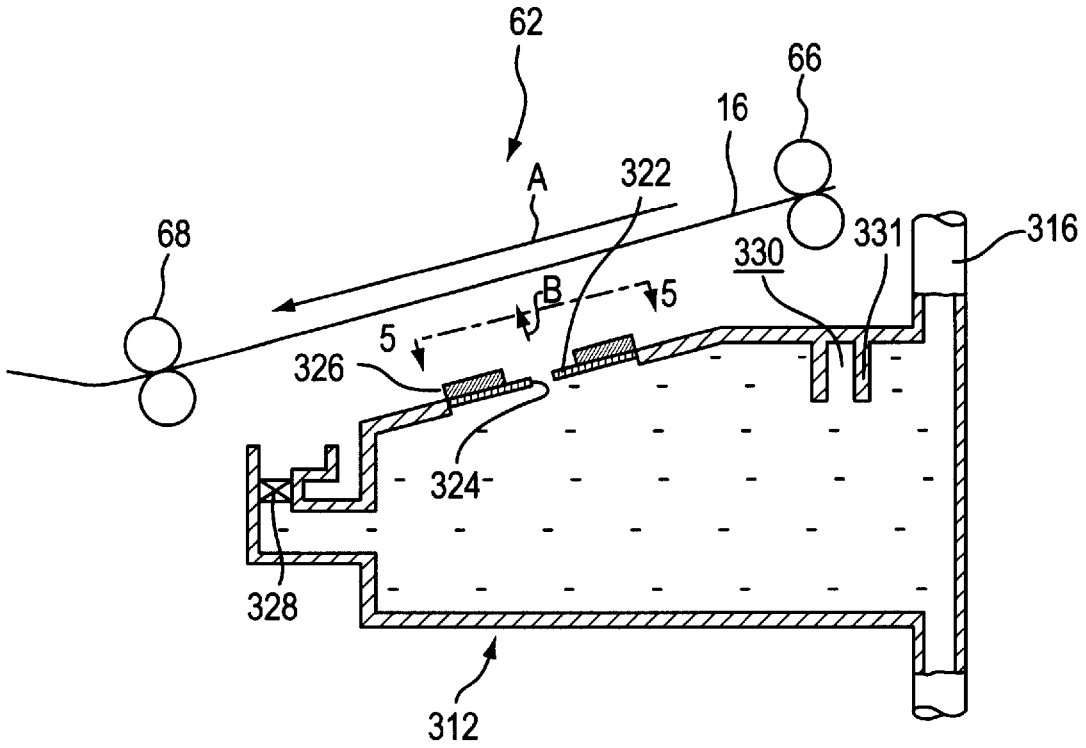
FIG. 2 is an enlarged partial cross sectional view showing the spray tank indicated in FIG. 1.

Further, as shown in FIG. 2 which is an enlarged view of the spray tank 312, a part of a wall of the spray tank 312 opposite to the conveying path A of the light-sensitive material 16 is fitted with a head plate 322 which is a nozzle formed of a thin elastic deformable plate.

Figure 3:
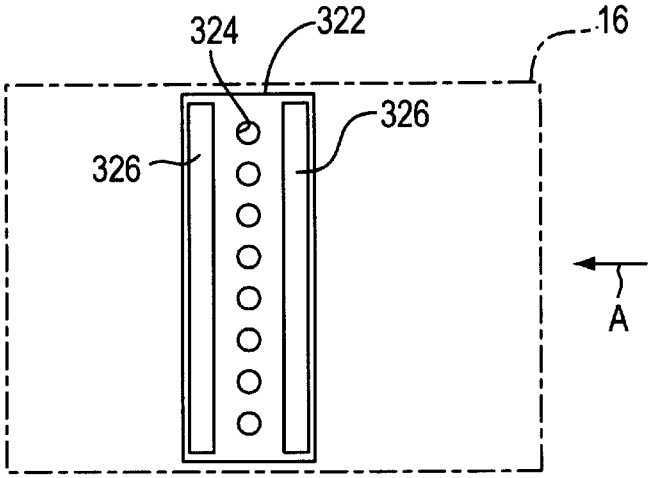
FIG. 3 is a view taken along line 5–5 in the direction indicated by the arrow.

As shown in FIG. 3, a plurality of nozzle holes 324 (for example, having a diameter of tens of $\mu$m) are linearly arranged at definite intervals along a direction to intersect the conveying direction of the light-sensitive material 16. Water contained in the spray tank 312 can therefore be discharged through each of the nozzle holes 324.

Further, monomorph or bimorph piezoelectric elements 326 acting as an actuator are adhered to the head plate 322, to which an electric source not shown in the drawing is connected.

Figure 4:
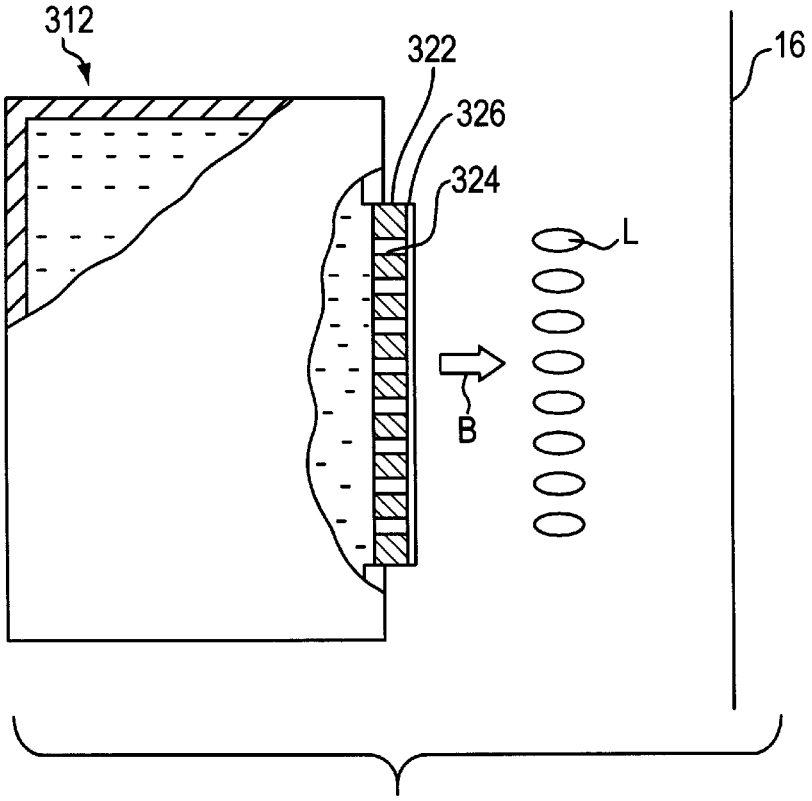
FIG. 4 is a schematic view showing the spray tank indicated in FIG. 1.

Accordingly, when the piezoelectric elements 326 are electrified from the electric source, they bend the head plate 322 to displace a central portion of the head plate 322 toward the light-sensitive material on the conveying path A (namely, displacement along the arrow B normal to the head plate 322). With the displacement of the head plate 322 toward the light-sensitive material 16, water droplets L are ejected through the plurality of nozzle holes, as shown in FIG. 4 indicating a schematic view of the spray tank 312.

On the other hand, as shown in FIG. 2, this spray tank 312 is provided with a tank valve 328 at a position somewhat below the nozzle holes 324 thereof, and an inside of the spray tank 312 can be communicated with and disconnected from the air by the opening and closing movements of the tank valve 328. The upper valve 318, the lower valve 320 and the tank valve 328 are each connected to a controller 332 as shown in FIG. 1, and the opening and closing movements of each of the valves 318, 320 and 328 are controlled with the controller 332.

As shown in FIG. 2, an air reservoir 330 surrounded with a cylindrical rib 331 is formed on an inner wall surface on an upper side in the spray tank 312.

The operation and the function at the time when water is adhered to the light-sensitive material 16 by spraying from the spray tank 312 are described below.

First, in FIG. 1, the upper valve 318 and the lower valve 320 are opened and the tank valve 328 is closed with the controller 332, and water is supplied from the pool tank 314 to the spray tank 312 through the pipe 316 by gravity to reserve water in the spray tank 312.

Accordingly, in FIG. 2, the piezoelectric elements 326 are deformed by electrification from the electric source to displace the head plate 322 of the spray tank 312 in the state where water is reserved in the spray tank 312 like this, which causes water to be ejected through each of the plural nozzle holes in the direction indicated by the arrow B, resulting in adherence of water to the light-sensitive material 16 during conveyance. Then, water is applied over the whole surface of the light-sensitive material 16 by continuously spraying water through the nozzle holes 324.

In this case, as shown in FIG. 3, the plurality of nozzle holes 324 for spraying water are linearly arranged at definite intervals along the direction to intersect the conveying direction of the light-sensitive material 16 , so that one displacement of the head plate 322 with the piezoelectric elements 326 makes it possible to widely adhere water to the light-sensitive material 16 . From the above, the particle size of sprayed water is determined by the nozzle holes 324 . Further, no mixing of gas and liquid results in no variation in the particle size, and the linear arrangement of the nozzle holes 324 at definite intervals causes no variation in adhering positions. Hence, the uniformity of water on a coated surface, a surface of the light-sensitive material 16 , is not deteriorated by the variations.

Further, the plurality of nozzle holes 324 are linearly arranged at definite intervals along the direction to intersect the conveying direction of the light-sensitive material 16 , so that it becomes unnecessary to scan the head plate 322 on a two-dimensional plane, making it possible to coating a large area for a short period of time. Furthermore, the head plate 322 having the nozzle holes 324 is not brought into contact with the light-sensitive material 16 , resulting in no clogging and no contamination, improvement in durability of the coating device 310, and lower precision prescribed of alignment.

On the other hand, the head plate 322 requires only the formation of the plurality of nozzle holes 324 , so that the integration technique becomes unnecessary. It becomes therefore possible to produce the coating device 310 at low cost.

When water is sprayed through the nozzle holes 324 , the upper valve 318 and the lower valve 320 are closed and the tank valve 328 is opened with the controller 332 , whereby the pressure in the vicinity of the nozzle holes 324 in the spray tank 312 becomes negative, which can prevent liquid leaks from the nozzle holes 324.

The light-sensitive materials and/or the completing agent sheets used in the present invention may have conductive heating layers as heating means for heat development. In this case, heating elements described in JP-A-61-145544 can be utilized.

In the heat development stage, the heating temperature is about 60° to 100° C., and the heating time is 0.1 to 60 seconds.

Heating methods in the development stage include methods of bringing the light-sensitive materials into contact with heated blocks, heated plates, hot pressers, heat rolls, heat drums, halogen lamp heaters and infrared or far infrared lamp heaters, and methods of passing them through atmospheres of high temperatures.

The light-sensitive materials can be overlaid with the complexing agent sheets by methods described in JP-A-62253159 and JP-A-61-147244, page 27.

In the present invention, supports which can endure processing temperatures are used as supports for light-sensitive materials and the complexing agent sheets. In general, the supports include photographic supports such as paper and synthetic polymers (films) described in *Shashin Kohgaku no Kiso* (*Ginen Shashin*) (The Fundamentals of Photographic Engineering (Silver Salt Photograph)), pages 223 to 240 , edited by Nippon Shashin Gakkai, Corona Publishing Co. Ltd. (1979). Specific examples thereof include polyethylene terephthalate, polyethylene naphthalate, polycarbonates, polyvinyl chloride, polystyrene, polypropylene, polyimides and cellulose derivatives (for example, cellulose triacetate).

They can be used alone or as supports coated with synthetic polymers such as polyethylene on one side or both sides.

In addition, supports described in JP-A-62-253159, pages 29 to 31, JP-A-1-161236, pages 14 to 17, JP-A-63-31848, JP-A-2-22651, JP-A-3-56955 and U.S. Pat. No. 5,001,033 can be used.

In particular, when requirements for heat resistance or curling characteristics are severe, supports described in JP-A-6-41281, JP-A-6-43581, JP-A-6-514126, JP-A-6-51437, JP-A6-51442, JP-A-6-82961, JP-A-6-82960, JP-A-6-82959, JP-A-667346, JP-A-6-202277, JP-A-6-175282, JP-A-118561, JP-A-7219129, JP-A-7-219144, JP-A-6-123937, JP-A-6-118561 and JP-A6-266050 can be used as the supports for the light-sensitive materials.

Supports formed of styrenic polymers mainly having the syndiotactic structure are also preferably used.

Further, in order to adhere the supports to the layers constituting the light-sensitive materials, surface treatment procedures are preferably employed. Examples thereof include surface activating treatment procedures such as chemical treatment, mechanical treatment, corona discharge treatment, flame treatment, ultraviolet treatment, high frequency treatment, glow discharge treatment, active plasma treatment, laser treatment, mixed acid treatment and ozone oxidation treatment. Of the surface treatment procedures, ultraviolet treatment, flame treatment, corona discharge treatment and glow discharge treatment are preferred.

Then, undercoating methods are described. Undercoat layers may be either monolayers or multilayers. Binders for the undercoat layers include polyethyleneimine, epoxy resins, grafted gelatin, nitrocellulose and gelatin, as well as copolymers using as starting materials monomers selected from the group consisting of vinyl chloride, vinylidene chloride, butadiene, methacrylic acid, acrylic acid, itaconic acid and maleic anhydride. Compounds for swelling the supports include resorcin and p-chlorophenol. Gelatin hardeners for the undercoat layers include chromium salts (such as chrome alum), aldehydes (such as formaldehyde and glutaraldehyde), isocyanates, active halogen compounds (such as 2,4-dichloro-6-hydroxy-s-triazine), epichlorohydrin resins and active vinyl sulfone compounds. $SiO_2$, $TiO_2$, fine particles of inorganic compounds or fine particles (0.01 to 10 $\mu$m) of polymethyl methacrylate copolymers may be added as matte agents.

It is preferred to use magnetic recording layers described in JP-A-4-124645, JP-A-5-40321, JP-A-6-35092 and Japanese Patent Application No. 5-58221 and JP-A-6-317875 as the supports to describe shooting information.

The magnetic recording layer is a layer in which an aqueous or organic solvent coating solution containing magnetic particles dispersed in a binder is applied to a support. The magnetic particles which can be used include ferromagnetic iron oxide such as $\gamma Fe_2O_3$, Co-coated $\gamma Fe_2O_3$, Co-coated magnetite, Co-containing magnetite, ferromagnetic chromium dioxide, ferromagnetic metals, ferromagnetic alloys, hexagonal Ba ferrite, Sr ferrite, Pb ferrite and Ca ferrite. Co-coated ferromagnetic iron oxide such as Co-coated $\gamma Fe_2O_3$ is preferred. The form thereof may be any of the acicular, rice grain, spherical, cubic and tabular forms. The specific surface area is preferably 20 $m^2/g$ in $S_{BET}$, and more preferably 30 $m^2/g$. The saturation magnetization ($\sigma_s$) is preferably from $3.0\times10^4$ to $3.0\times10^5$ A/m, and more preferably from $4.0\times10^4$ to $2.5\times10^5$ A/m. The ferromagnetic particles may be surface treated with silica and/or alumina, or organic materials. Further, the magnetic particles may be surface treated with silane coupling agents or titanium coupling agents as described in JP-A-6-161032. Magnetic particles coated with inorganic oe organic materials described in JP-A4-259911 and JP-A-5-81652 can also be used.

Binders used in the magnetic particles include thermoplastic resins, thermosetting resins, radiation curable resins, reactive resins, acid-, alkali- or bio-degradable polymers, natural polymers (such as cellulose derivatives and sugar derivatives) and mixtures thereof described in JP-A-4219569. The glass transition temperature (Tg) of the above-mentioned resins is −40° C. to 300° C., and the weight average molecular weight thereof is 2,000 to 1,000,000. Examples thereof include vinyl copolymers, cellulose derivatives such as cellulose diacetate, cellulose triacetate, cellulose acetate propionate, cellulose acetate butyrate and cellulose tripropionate, acrylic resins and polyvinylacetal resins. Gelatin is also preferably used. In particular, cellulose di(tri)acetate is preferred. The binders can be cured by adding epoxy, aziridine or isocyanate crosslinking agents. The isocyanate crosslinking agents include isocyanates such as tolylene diisocyanate, 4,4',-diphenylmethane diisocyanate, hexamethylene diisocyanate and xylylene diisocyanate, reaction products of these isocyanates and polyalcohols (for example, a reaction product of 3 mol of tolylene diisocyanate and 1 mol of trimethylolpropane), and polyisocyanates produced by condensation of these isocyanates, which are described, for example, in JP-A-6-59357.

The above-mentioned magnetic materials are dispersed in the above-mentioned binders preferably by use of kneaders, pin type mills, annular type mills or combinations thereof, as described in JP-A-6-35092. Dispersing agents described in JP-A-5-88283 and other known dispersing agents can be used. The thickness of the magnetic recording layers is 0.1 μm to 10 μm, preferably 0.2 μm to 5 μm, and more preferably 0.3 μm to 3 μm. The weight ratio of the magnetic particles to the binders is preferably 0.5:100 to 60:100, and more preferably 1:100 to 30:100. The coating amount of the magnetic particles is 0.005 to 3 $g/m^2$, preferably 0.01 to 2 $g/m^2$, more preferably 0.02 to 0.5 $g/m^2$. The transmission yellow density of the magnetic recording layers is preferably 0.01 to 0.50, more preferably 0.03 to 0.20, and most preferably 0.04 to 0.15. The magnetic recording layers can be formed on back surfaces of photographic supports wholly or in the stripe form. Coating methods for forming the magnetic recording layers include air doctor, blade, air knife, squeeze, immersion, reverse roll, transfer roll, gravure, kiss, cast, spray, dip, bar and extrusion processes. Coating solutions described in JP-A-5-341436 are preferably used.

Functions such as improved lubricity, curl control, static prevention, adhesion prevention and head abrasion may be given to the magnetic recording layers, and other functional layers may be provided to give these functions. It is preferred that at least one or more kinds of particles are abrasive of nonspherical inorganic particles having a Mohs hardness of 5 or more. The nonspherical inorganic particles are preferably fine powders of oxides such as aluminum oxide, chromium oxide, silicon dioxide and titanium dioxide, carbides such as silicon carbide and titanium carbide, and diamond. These abrasive may be surface treated with silane coupling agents or titanium coupling agents. These particles may be added to the magnetic recording layers or overcoated thereon (for example, protective layers or lubricant layers). As binders used herein, the binders described above can be used, and the same binders as in the magnetic recording layers are preferred. Light-sensitive materials having magnetic recording layers are described in U.S. Pat. Nos. 5,336,589, 5,250,404, 5,229,259 and 5,215,874, and EP-A-466,130.

Although polyester supports preferably used in the above-mentioned light-sensitive materials having magnetic recording layers are further described, details including the light-sensitive materials, treatments, cartridges and examples are described in Kohkai Gihoh (Journal of Technical Disclosure) 94-6023 (Hatsumei Kyokai, Mar. 15, 1994). Polyesters are formed from diols and aromatic dicarboxylic acids as essential components. The aromatic dicarboxylic acids include 2,6-, 1,5-, 1,4- and 2,7-naphthalenedicarboxylic acids, terephthalic acid, isophthalic acid and phthalic acid, and the diols include diethylene glycol, triethylene glycol, cyclohexanedimethanol, bisphenol A and bisphenol. The polymers include homopolymers such as polyethylene terephthalate, polyethylene naphthalate and polycyclohexanedimethanol terephthalate. Polyesters containing 50 mol % to 100 mol % of 2,6-naphthalenedicarboxylic acid are particularly preferred. Polyethylene 2,6-naphthalate is particularly preferred among others. The average molecular weight ranges from about 5,000 to 200,000. The glass transition temperature of the polyesters is 50° C. or more, and preferably 90° C. or more.

Then, in order to inhibit a tendency to curling, the polyester supports are heat treated at a temperature from 40° C. to less than Tg, more preferably from Tg-20° C. to less than Tg. The heat treatment may be carried out at a constant temperature, or while cooling. The heat-treatment time is 0.1 hour to 1,500 hours, and more preferably 0.5 hour to 200 hours. The heat treatment of the supports may be performed in the roll form or while conveying them in the web form. Surfaces of the supports may be roughened (for example, applying fine conductive inorganic particles such as $SnO_2$ and $Sb_2O_5$) to improve the surface properties. It is desirable to prevent cut reflection of core portions by knurling edges and somewhat heightening only the edges. The heat treatment may be conducted at any stage after film formation of the supports, after surface treatment, after coating of back layers (such as antistatic agents and lubricants) and after coating of undercoats. It is preferably conducted after coating of antistatic agents.

UV absorbers may be incorporated in the polyesters. Further, dyes or pigments commercially available for polyesters, for example, Diaresin manufactured by Mitsubishi Kasei Co. Ltd. and Kayaset manufactured by Nihon Kayaku Co. Ltd., can be incorporated in the polyesters to prevent light piping.

Then, film cartridges loadable with photographic materials are described. Main materials of the cartridges used in the present invention may be metals or synthetic plastics.

Preferred examples of the plastic materials are polystyrene, polyethylene, polypropylene and polyphenyl ether. The cartridges may further contain various antistatic agents, and carbon black, metal oxide particles, nonionic, anionic, cationic or betaine surfactants or polymers can be preferably used. These antistatic cartridges are described in JP-A-1-312537 and JP-A-1-312538. In particular, the resistance at 25° C. at 25% RH is preferably $10^{12}$ Ω or less. The plastic cartridges are usually produced of plastics in which carbon black or pigments are incorporated to give light shielding properties. The size of the cartridges may remain as the present 135 size, or it is also effective to reduce the diameter of the cartridges of the present 135 size from 25 mm to 22 mm or less. The volume of cartridge cases is preferably 30 $cm^3$ or less, and more preferably 25 $cm^3$ or less. The weight of plastics used to produce the cartridges and the cartridge cases is preferably 5 g to 15 g.

Further, a cartridge may be used in which a spool is rotated to send out a film. Furthermore, a cartridge may have the structure that a leading edge of a film is contained in a main body of the cartridge, and a spool shaft is rotated in the direction of sending out the film, thereby sending out the leading edge of the film from a port portion of the cartridge to the outside. They are described in U.S. Pat. Nos. 4,834,306 and 5,226,613.

As methods for preparing prints with color paper or heat developable light-sensitive materials using the color shooting materials, methods described in JP-A-5-241251, JP-A5-19364 and JP-A-5-19363.

The present invention will be further illustrated with reference to the following examples, which are, however, not to be construed as limiting the invention.

EXAMPLE 1

Preparation of Light-Sensitive Silver Halide Emulsion (I)

Solution (I) shown in Table 2 was added to an aqueous solution of gelatin having the composition shown in Table 1 with sufficient stirring for 1 minute. After an elapse of 20 seconds from the start of addition of solution (I), solution (II) was added for 40 seconds. After an elapse of 2 minutes, solution (III) and solution (IV) were concurrently added for 4 minutes.

TABLE 1

| COMPOSITION OF AQUEOUS SOLUTION OF GELATIN | |
|---|---|
| $H_2O$ | 650 cc |
| Lime-Treated Gelatin | 20 g |
| NaCl | 3 g |
| Solvent for Silver Halide (a) | 0.015 g |
| Temperature | 40° C. |

TABLE 2

| | Solution (I) | Solution (II) | Solution (III) | Solution (IV) |
|---|---|---|---|---|
| $AgNO_3$ | 14 g | | 86 g | |
| NaCl | | 4.91 g | | 29.5 g |
| Total Amount | Water to make 120 cc | Water to make 85.7 cc | Water to make 480 cc | Water to make 514 cc |

Solvent for Silver Halide (a)

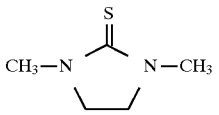

After conventional washing and salt removal (conducted at pH 4.0 using precipitant (b)), 22 g of delimed gelatin was added and dispersed therein. After adjustment to pH 6.0, 4 cc of a 10% aqueous solution of sodium chloride was added, and 70 mg of preservative (c) was further added thereto to obtain a silver chloride emulsion having a grain size of 0.15 μm. The yield of this emulsion was 630 g.

Precipitant (b)

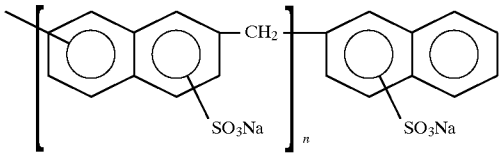

Preservative (c)

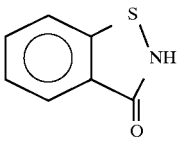

Preparation of Silver Halide Emulsion (II)

A silver chlorobromide emulsion containing 85 mol % of silver chloride was prepared in the same manner as with silver halide emulsion (I) with the exception that the composition of the aqueous solution of gelatin and the compositions of solutions (II) and (IV) were changed as shown in Tables 3 and 4, respectively.

TABLE 3

| COMPOSITION OF AQUEOUS SOLUTION OF GELATIN | |
|---|---|
| $H_2O$ | 650 cc |
| Lime-Treated Gelatin | 20 g |
| NaC1 | 3 g |
| KBr | 0.3 g |

TABLE 3-continued

| COMPOSITION OF AQUEOUS SOLUTION OF GELATIN | |
|---|---|
| Solvent for Silver Halide (a) | 0.015 g |
| Temperature | 40° C. |

TABLE 4

| | Solution (I) | Solution (II) | Solution (III) | Solution (IV) |
|---|---|---|---|---|
| $AgNO_3$ | 14 g | | 86 g | |
| NaCl | | 4.18 g | | 25.1 g |
| KBr | | 1.5 g | | 9.0 g |
| Total Amount | Water to make 120 cc | Water to make 85.7 cc | Water to make 480 cc | Water to make 514 cc |

Preparation of Silver Halide Emulsion (III)

A silver chlorobromide emulsion containing 70 mol % of silver chloride was prepared in the same manner as with silver halide emulsion (II) with the exception that the compositions of solutions (II) and (IV) were changed as shown in Table 5.

TABLE 5

| | Solution (I) | Solution (II) | Solution (III) | Solution (IV) |
|---|---|---|---|---|
| $AgNO_3$ | 14 g | | 86 g | |
| NaC1 | | 3.46 g | | 20.7 g |
| KBr | | 3.0 g | | 18.0 g |
| Total Amount | Water to make 120 cc | Water to make 85.7 cc | Water to make 480 cc | Water to make 514 cc |

Preparation of Silver Halide Emulsion (IV)

A silver chlorobromide emulsion containing 30 mol % of silver chloride was prepared in the same manner as with silver halide emulsion (II) with the exception that the compositions of solutions (II) and (IV) were changed as shown in Table 6.

TABLE 6

| | Solution (I) | Solution (II) | Solution (III) | Solution (IV) |
|---|---|---|---|---|
| $AgNO_3$ | 14 g | | 86 g | |
| NaC1 | | 1.47 g | | 8.83 g |
| KBr | | 7.0 g | | 42.0 g |
| Total Amount | Water to make 120 cc | Water to make 85.7 cc | Water to make 480 cc | Water to make 514 cc |

Preparation of Dispersion of Zinc Hydroxide

Sixteen grams of zinc hydroxide having a mean particle size of 0.2 μm was added to 84 cc of a 5% aqueous solution of lime-treated ossein gelatin in which 0.5 g of carboxymethyl cellulose and 0.2 g of polysodium acrylate were dissolved, and dispersed by use of glass beads in a mill for 30 minutes. After dispersion, the glass beads were separated to obtain a gelatin dispersion of zinc hydroxide.

Method for Preparing Emulsified Dispersion of Coupler

The oil phase ingredients and aqueous phase ingredients shown in Table 7 were each dissolved to form homogeneous solutions having a temperature of 60° C. Both the solutions were combined and dispersed in a 1-liter stainless steel vessel with a dissolver equipped with a 5-cm diameter disperser at 10,000 rpm for 20 minutes. Then, hot water was added in amounts shown in Table 7 as post water addition, followed by mixing at 2,000 rpm for 10 minutes. Thus, an emulsified dispersion was prepared.

TABLE 7

| | | Emulsion M |
|---|---|---|
| Oil Phase | Magenta Coupler (1) | 3.36 g |
| | Developing Agent D-2 | 5.02 g |
| | Antifoggant (3) | 0.01 g |
| | High Boiling Solvent (4) | 4.18 g |
| | Ethyl Acetate | 24 ml |
| Aqueous Phase | Lime-Treated Gelatin | 15.0 g |
| | Surfactant (5) | 0.40 g |
| | Water | 75.0 ml |
| | Post Water Addition (Hot Water) | 60.0 ml |

Magenta Coupler (1)

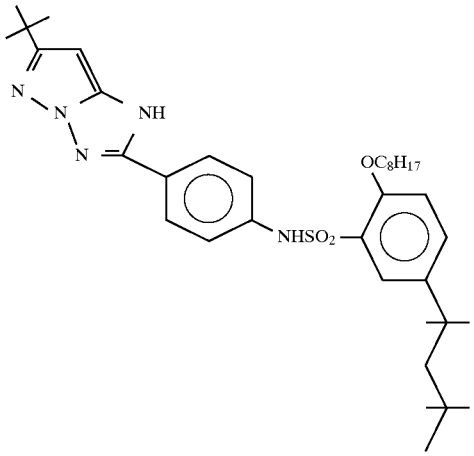

-continued

Developing Agent D-2

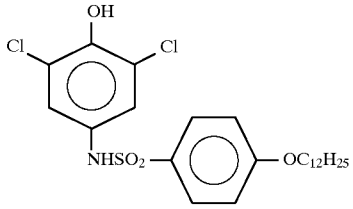

Antifoggant (3)

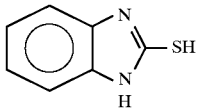

High Boiling Solvent (4)

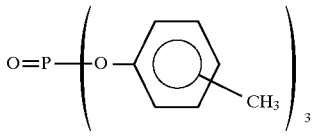

Surfactant (5)

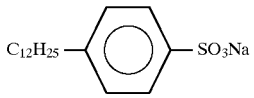

Using the materials thus obtained, color light-sensitive material 101 having the two-layer constitution shown in Table 8 was prepared. Optimum amounts of sensitizing dyes ($d_1$) and ($d_2$) were added in preparing the coating solution.

Sensitizing Dye ($d_1$)

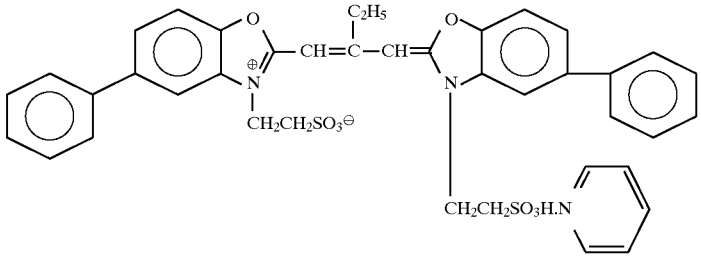

Sensitizing Dye ($d_2$)

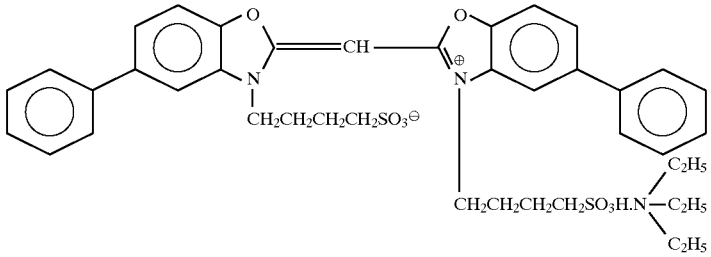

TABLE 8

| Layer Constitution | Material Added | Amount Added ($mg/m^2$) |
|---|---|---|
| 2nd Layer Protective Layer | Lime-Treated Gelatin | 1940 |
| | Matte Agent (Silica) | 200 |
| | Hardener (6) | 40 |
| | Surfactant (7) | 50 |
| | Surfactant (8) | 300 |
| | Zinc Hydroxide | 650 |
| | Water-Soluble Polymer (9) | 120 |
| 1st Layer Magenta Color Formation Layer | Lime-Treated Gelatin | 2000 |
| | Green-Sensitive Silver Halide Emulsion | 864 (converted to silver) |
| | Magenta Coupler (1) | 336 |
| | Developing Agent D-2 | 502 |
| | Antifoggant (3) | 1 |
| | High Boiling Solvent (4) | 490 |
| | Surfactant (5) | 40 |
| | Water-Soluble Polymer (9) | 20 |

Transparent PET Base (102 $\mu$m)

Hardener (6)

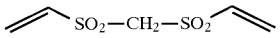

Surfactant (7)

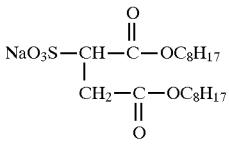

Surfactant (8)

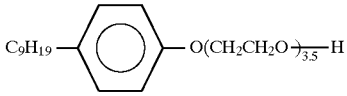

Water-Soluble Polymer (9)

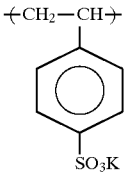

Then, complexing agent sheet R-1 shown in Table 9 was prepared.

TABLE 9

CONSTITUTION OF COMPLEXING AGENT SHEET R-1

| Layer Name | Additives | Amount Coated ($mg/m^2$) |
|---|---|---|
| 4th Layer (Protective Layer) | K Carrageenan | 58 |
| | Sumikagel L-5H (manufactured by Sumitomo Chemical) | 164 |
| | Lime-Treated Gelatin | 32 |
| | Surfactant (7) | 8 |
| | Surfactant (10) | 7 |
| | Surfactant (11) | 61 |
| | Potassium Nitrate | 25 |
| | Mercapto Compound | 82 |
| | 3.6 $\mu$m Silica | 9 |

TABLE 9-continued

CONSTITUTION OF COMPLEXING AGENT SHEET R-1

| Layer Name | Additives | Amount Coated ($mg/m^2$) |
|---|---|---|
| 3rd Layer (Intermediate Layer) | Lime-Treated Gelatin | 245 |
| | Sumikagel L5-H (manufactured by Sumitomo Chemical) | 26 |
| | Surfactant (7) | 9 |
| | Hardener (13) | 18 |
| 2nd Layer (Complexing Agent Layer) | Lime-Treated Gelatin | 1300 |
| | Sumikagel L5-H (manufactured by Sumitomo Chemical) | 124 |
| | Dextran | 620 |
| | Polymer Dispersion (Nipol LX814, manufactured by Nihon Zeon) | 600 |
| | Polymer (14) | 2280 |
| | Guanidine Picolinate | 2700 |
| | Surfactant (7) | 22 |
| lst Layer (Intermediate Layer) | Lime-treated Gelatin | 245 |
| | Sumikagel L5-H (manufactured by Sumitomo Chemical) | 8 |
| | Surfactant (7) | 9 |
| | Hardener (13) | 18 |

Support: Polyethylene Terephthalate (with a gelatin undercoat and a thickness of 100 $\mu$m)

Surfactant (10)

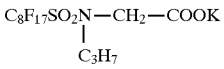

Surfactant (11)

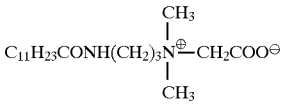

Mercapto Compound (12)

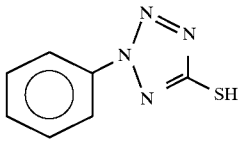

Hardener (13)

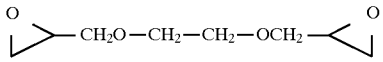

Polymer (14)

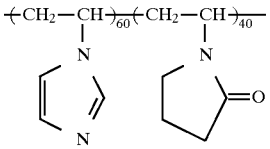

Then, photographic materials 102 to 112 were prepared which have the same composition as light-sensitive material 101 with the exception that the coupler,the developing agent and the light-sensitive silver halide were replaced as shown in Table 10. The amounts added were adjusted so as to be equimolar to light-sensitive material 101.

TABLE 10

| Light-Sensitive Material No. | Silver Halide Emulsion | Coupler | Developing Agent |
|---|---|---|---|
| 101 (Comparison) | IV | (1) | (2) |
| 102 (Comparison) | IV | C-1 | D-41 |
| 103 (Comparison) | IV | C-2 | D-56 |
| 104 (Comparison) | III | (1) | (2) |
| 105 (Comparison) | III | C-1 | D-41 |
| 106 (Comparison) | III | C-2 | D-56 |
| 107 (Invention) | II | (1) | (2) |
| 108 (Invention) | II | C-1 | D-41 |
| 109 (Invention) | II | C-2 | D-56 |
| 110 (Invention) | I | (1) | (2) |
| 111 (Invention) | I | C-1 | D-41 |
| 112 (Comparison) | I | C-1 | D |

Coupler C-1

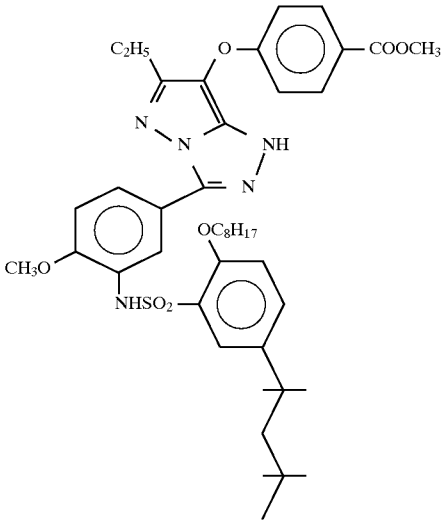

Coupler C-2

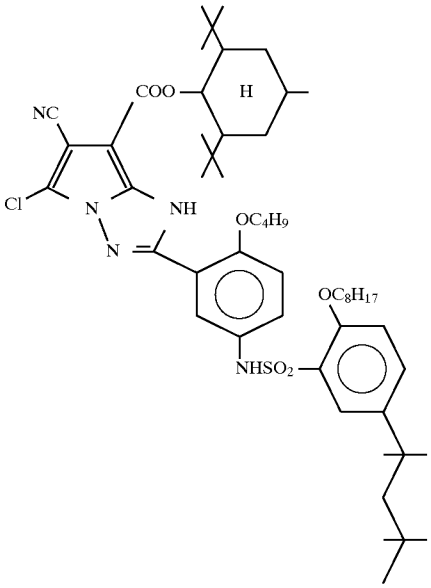

-continued

Developing Agent D-41

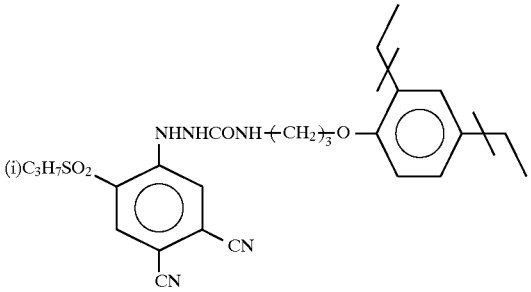

Developing Agent D-56

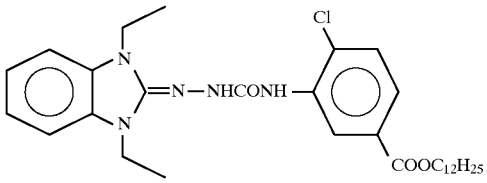

Developing Agent D

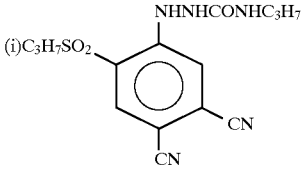

Further, complexing agent sheets R-2 to R-5 were prepared in the same manner as with R-1 with the exception that physical development nuclei and solvents for silver halide were added as shown in Table 11.

TABLE 11

| Complexing Agent Sheet No. | Additive | Added Layer | Amount Added ($mg/m^2$) |
|---|---|---|---|
| R-1 | — | — | — |
| R-2 | PdS Particles (0.02 $\mu$m) | 4 | 2.5 |
| R-3 | PdS Particles (0.02 $\mu$m) | 4 | 2.5 |
| | Sodium Sulfite | 2 | 1100 |
| R-4 | Colloidal Silver | 4 | 2.5 |
| | Potassium Hydantoin | 2 | 750 |
| R-5 | PdS Particles (0.02 $\mu$m) | 4 | 2.5 |
| | Uracil | 2 | 900 |

Light-sensitive materials 101 to 112 thus obtained were each exposed at 2000 luxes for 0.1 second through a G filter continuously varying in density. Each exposed sample was coated with water by use of the above-mentioned water coating device, and each of the complexing agent sheets was placed thereon so that an emulsion surface thereof comes into contact with a film surface of the complexing agent sheet, followed by heat development at 85° C. for 30 seconds by use of a heat drum. When the complexing agent sheet was thereafter peeled off, a magenta image was clearly obtained on the light-sensitive material, corresponding to the filter. The maximum density (Dmax) and the minimum density (Dmin) of the sample were measured with a densitometer immediately after processing. Further, the processed sample was exposed to white light at 200,000 luxes for 1 second, followed by standing in a dark room for 5 minutes. Thereafter, the Dmin was measured with a densitometer. Results thereof are shown in Tables 12 to 16.

TABLE 12

RESULTS FOR COMPLEXING AGENT SHEET R-1

| Light-Sensitive Material No. | Dmax | Dmin | Dmin after Exposure |
|---|---|---|---|
| 101 (Comparison) | 2.32 | 0.18 | 0.56 |
| 102 (Comparison) | 2.41 | 0.23 | 0.60 |
| 103 (Comparison) | 2.30 | 0.27 | 0.67 |
| 104 (Comparison) | 2.38 | 0.18 | 0.62 |
| 105 (Comparison) | 2.46 | 0.22 | 0.69 |
| 106 (Comparison) | 2.32 | 0.28 | 0.74 |
| 107 (Invention) | 2.45 | 0.19 | 0.73 |
| 108 (Invention) | 2.49 | 0.24 | 0.79 |
| 109 (Invention) | 2.40 | 0.27 | 0.82 |
| 110 (Invention) | 2.52 | 0.17 | 0.85 |
| 111 (Invention) | 2.57 | 0.23 | 0.92 |
| 112 (Comparison) | 2.45 | 0.28 | 1.25 |

TABLE 13

RESULTS FOR COMPLEXING AGENT SHEET R-2

| Light-Sensitive Material No. | Dmax | Dmin | Dmin after Exposure |
|---|---|---|---|
| 101 (Comparison) | 2.31 | 0.18 | 0.54 |
| 102 (Comparison) | 2.41 | 0.22 | 0.59 |
| 103 (Comparison) | 2.31 | 0.28 | 0.65 |
| 104 (Comparison) | 2.36 | 0.18 | 0.62 |
| 105 (Comparison) | 2.44 | 0.22 | 0.70 |
| 106 (Comparison) | 2.34 | 0.27 | 0.75 |
| 107 (Invention) | 2.45 | 0.19 | 0.73 |
| 108 (Invention) | 2.48 | 0.25 | 0.78 |
| 109 (Invention) | 2.40 | 0.27 | 0.81 |
| 110 (Invention) | 2.51 | 0.16 | 0.84 |
| 111 (Invention) | 2.56 | 0.24 | 0.90 |
| 112 (Comparison) | 2.46 | 0.27 | 1.30 |

TABLE 14

RESULTS FOR COMPLEXING AGENT SHEET R-3

| Light-Sensitive Material No. | Dmax | Dmin | Dmin after Exposure |
|---|---|---|---|
| 101 (Comparison) | 2.33 | 0.18 | 0.39 |
| 102 (Comparison) | 2.41 | 0.24 | 0.50 |
| 103 (Comparison) | 2.31 | 0.26 | 0.57 |
| 104 (Comparison) | 2.35 | 0.18 | 0.28 |
| 105 (Comparison) | 2.43 | 0.23 | 0.31 |
| 106 (Comparison) | 2.32 | 0.27 | 0.36 |
| 107 (Invention) | 2.44 | 0.18 | 0.21 |
| 108 (Invention) | 2.48 | 0.24 | 0.27 |
| 109 (Invention) | 2.40 | 0.26 | 0.29 |
| 110 (Invention) | 2.53 | 0.17 | 0.19 |
| 111 (Invention) | 2.58 | 0.22 | 0.23 |
| 112 (Comparison) | 2.46 | 0.28 | 0.52 |

TABLE 15

RESULTS FOR COMPLEXING AGENT SHEET R-4

| Light-Sensitive Material No. | Dmax | Dmin | Dmin after Exposure |
|---|---|---|---|
| 101 (Comparison) | 2.32 | 0.18 | 0.40 |
| 102 (Comparison) | 2.42 | 0.22 | 0.50 |
| 103 (Comparison) | 2.31 | 0.28 | 0.58 |

TABLE 15-continued

RESULTS FOR COMPLEXING AGENT SHEET R-4

| Light-Sensitive Material No. | Dmax | Dmin | Dmin after Exposure |
|---|---|---|---|
| 104 (Comparison) | 2.37 | 0.18 | 0.27 |
| 105 (Comparison) | 2.44 | 0.23 | 0.30 |
| 106 (Comparison) | 2.31 | 0.29 | 0.35 |
| 107 (Invention) | 2.46 | 0.19 | 0.21 |
| 108 (Invention) | 2.50 | 0.23 | 0.25 |
| 109 (Invention) | 2.41 | 0.28 | 0.30 |
| 110 (Invention) | 2.50 | 0.17 | 0.18 |
| 111 (Invention) | 2.55 | 0.22 | 0.23 |
| 112 (Comparison) | 2.44 | 0.27 | 0.53 |

TABLE 15

RESULTS FOR COMPLEXiNG AGENT SHEET R-5

| Light-Sensitive Material No. | Dmax | Dmin | Dmin after Exposure |
|---|---|---|---|
| 101 (Comparison) | 2.32 | 0.18 | 0.39 |
| 102 (Comparison) | 2.41 | 0.23 | 0.51 |
| 103 (Comparison) | 2.31 | 0.28 | 0.57 |
| 104 (Comparison) | 2.38 | 0.19 | 0.28 |
| 105 (Comparison) | 2.46 | 0.22 | 0.31 |
| 106 (Comparison) | 2.33 | 0.28 | 0.36 |
| 107 (Invention) | 2.45 | 0.18 | 0.20 |
| 108 (Invention) | 2.49 | 0.23 | 0.25 |
| 109 (Invention) | 2.40 | 0.27 | 0.29 |
| 110 (Invention) | 2.52 | 0.17 | 0.18 |
| 111 (Invention) | 2.56 | 0.24 | 0.26 |
| 112 (Comparison) | 2.44 | 0.27 | 0.54 |

The results shown in Tables 12 to 16 reveal that even the samples exposed at 200,000 luxes after processing indicate a small increase in Dmin for the systems of the present invention in which complexing agent sheets R-3 to R-5 used, proving that post development is hard to occur. In particular, for the systems in which the sheets are combined with light-sensitive materials 107 to 111 of the present invention, an increase in density is very slight. The results shows that post development easily takes place for light-sensitive material 112 using the developing agent not ballasted. From this fact, it is apparent that the present invention is effective.

For processed light-sensitive materials 107 to 111 using R-3, image information was read and output with an NSE unit of PICTROSTAT 330 manufactured by Fuji Photo Film Co., Ltd. like usual negative films. As a result, good green images were obtained.

Image information of processed light-sensitive materials 107 to 111 using R-3 was read with a Topaz negative film scanner using diffused light as reading light manufactured by Linotype Hell-Co., transferred to Macintosh Quadra 840AV manufactured by Apple Computer Co., and output with PICTROGRAPHY 300 manufactured by Fuji Photo Film Co., Ltd. As a result, good green images were obtained.

According to the present invention, the color image formation methods by heat development excellent in discrimination and color image stability after processing can be provided.

It should further be apparent to those skilled in the art that various changes in form and detail of the invention as shown and described above may be made. It is intended that such changes be inclinded within the spirit and scope of the claimed appended hereto.

What is claimed is:

1. A color image formation method comprising:

overlaying a heat developable color photographic material with a complexing agent sheet via a small amount of water therebetween after or during imagewise exposure, wherein the heat developable color photographic material comprises a support having provided thereon at least light-sensitive silver halide grains, a binder, a coupler, a reducing agent and a slightly water-soluble basic metal compound, and the complexing agent-sheet comprising a support having provided thereon at least a complex-forming compound with a metal ion constituting the basic metal compound; and heat developing the heat developable color photographic material to obtain a color image thereon, wherein the silver halide grains have a silver chloride content of 80 mol % or more, the complexing agent sheet comprises a physical nucleus and a solvent for a silver halide, and the reducing agent is a compound represented by at least one of the formulas (1) to (5):

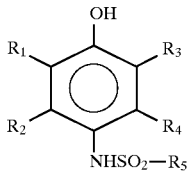

(1)

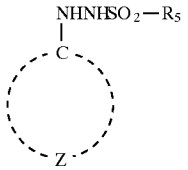

(2)

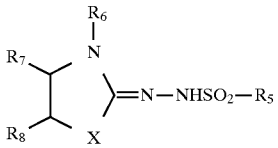

(3)

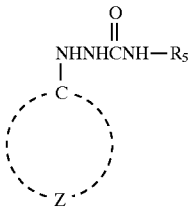

(4)

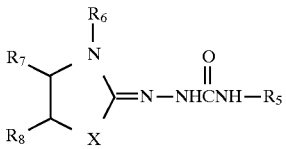

(5)

wherein $R_1$, $R_2$, $R_3$ and $R_4$ each represents a hydrogen atom, a halogen atom, an alkyl group, an aryl group, an alkylcarbonamido group, an arylcarbonamido group, an alkylsulfonamido group, an arylsulfonamido group, an alkoxyl group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl or an acyloxy group; $R_5$ represents an alkyl group, an aryl group or a heterocyclic group; Z represents an atomic group for forming an aromatic ring or a heterocyclic aromatic ring, wherein when Z is a benzene ring, the total of Hammett constants (σ) of substituent groups thereof is 1 or more; $R_6$ represents an alkyl group; X represents an oxygen atom, a sulfur atom, a selenium atom or an alkyl-substituted or aryl-substituted tertiary nitrogen atom; and $R_7$ and $R_8$, which may combine together to form a double bond or a ring, each represents a hydrogen atom or a substituent group, wherein the formulas (1) to (5) each contains at least one ballast group having 8 or more carbon atoms in order to impart oil solubility to the molecule thereof.

2. A color image formation method as claimed in claim 1, wherein said at least one light-sensitive silver halide grains contain at least one of silver chloride, silver iodochloride, silver chlorobromide and silver iodochlorobromide, and have a silver chloride content of 80 mol % or more and a silver iodide content of 10 mol % or less.

3. A color image formation method as claimed in claim 2, wherein said at least one light-sensitive silver halide grains have a silver iodide content of 1 mol % or less.

4. A color image formation method as claimed in claim 1, wherein the photographic material contains light-sensitive silver halide in an amount of 0.05 to 10 g/$m^2$.

5. A color image formation method as claimed in claim 1, wherein the coupler is used in an amount of 0.001 to 100 mmol/$m^2$.

6. A color image formation method as claimed in claim 1, wherein a molar ratio of the developing agent to the coupler is 0.01:1 to 100:1.

7. A color image formation method as claimed in claim 1, wherein the slightly water-soluble basic metal compound is an oxide, hydroxide or basic carbonate of zinc or aluminum.

8. A color image formation method as claimed in claim 1, wherein the slightly water-soluble basic metal compound is zinc oxide, zinc hydroxide or basic zinc carbonate.

9. A color image formation method as claimed in claim 1, wherein the slightly water-soluble basic metal compound is contained in an amount of 0.01 to 5 g per 1 $m^2$ of the photographic material.

10. A color image formation method as claimed in claim 1, wherein the solvent for the silver halide is a thiosulfate, a sulfite, a thiocyanate, a thioether compound, a urecil, a compound having a 5- or 6-membered imide ring, a compound represented by formula (6) or a mesoionic thiolate compound:

$$N(R^9)(R^{10})—C(=S)—X—R^{11} \quad (6)$$

wherein X represents a sulfur atom or an oxygen atom; $R^9$ and $R^{10}$, which may be the same or different, each represents an aliphatic group, an aryl group, a heterocyclic ring residue or an amino group; $R^{11}$ represents an aliphatic group or an aryl group; and $R^9$ and $R^{10}$ or $R^9$ and $R^{11}$ may combine together to form a 5- or 6-membered heterocyclic ring.

11. A color image formation method as claimed in claim 1, wherein the solvent for the silver halide is a sulfite, a urecil or a compound having a 5- or 6-membered imide ring.

12. A color image formation method as claimed in claim 1, wherein the solvent for the silver halide contained in the complexing agent sheet is 0.01 to 50 mmol/$m^2$ in total.

13. A color image formation method as claimed in claim 1, wherein the complex-forming compound is an aminopolycarboxylic acid, an aminophosphonic acid, a pyridinecarboxylic acid, or a salt thereof.

14. A color image formation method as claimed in claim 1, wherein the complex-forming compound is contained in an amount of 0.01 to 10 g per 1 $m^2$ of the complexing agent sheet.

15. A color image formation method as claimed in claim 1, wherein the physical nucleus is silver, silver sulfide or palladium sulfide.

16. A color image formation method as claimed in claim 1, wherein the physical nucleus is contained in an amount of $10^{-3}$ to 100 mg per 1 $m^2$ of the complexing agent sheet.

17. A color image formation method as claimed in claim 1, wherein the heat development is conducted at a temperature of 60° to 100° C.

* * * * *